US009362617B2

(12) United States Patent
Puente Baliarda et al.

(10) Patent No.: US 9,362,617 B2
(45) **Date of Patent: *Jun. 7, 2016**

(54) MULTILEVEL ANTENNAE

(71) Applicant: Fractus, S.A., Barcelona (ES)

(72) Inventors: Carles Puente Baliarda, Barcelona (ES); Carmen Borja Borau, Barcelona (ES); Jaume Anguera Pros, Castellon (ES); Jordi Soler Castany, Mataro (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 14/825,829

(22) Filed: Aug. 13, 2015

(65) Prior Publication Data

US 2015/0349413 A1 Dec. 3, 2015

Related U.S. Application Data

(63) Continuation of application No. 13/929,441, filed on Jun. 27, 2013, now Pat. No. 9,240,632, which is a continuation of application No. 13/732,743, filed on Jan. 2, 2013, now Pat. No. 8,976,069, which is a (Continued)

(51) Int. Cl.
*H01Q 1/36* (2006.01)
*H01Q 1/50* (2006.01)

(Continued)

(52) U.S. Cl.
CPC ..... *H01Q 1/50* (2013.01); *H01Q 1/241* (2013.01); *H01Q 1/36* (2013.01); *H01Q 1/38* (2013.01);

(Continued)

(58) Field of Classification Search
CPC ..... H01Q 1/36; H01Q 1/38; H01Q 5/10; H01Q 5/20; H01Q 5/307; H01Q 5/40; H01Q 5/50; H01Q 9/0407; H01Q 9/065; H01Q 9/28; H01Q 9/40
USPC ..... 343/700 MS, 702, 829, 846
See application file for complete search history.

(56) References Cited

U.S. PATENT DOCUMENTS 621,455 A 3/1899 Hess
646,850 A 4/1900 Lindemeyr (Continued)

FOREIGN PATENT DOCUMENTS

AU 2438199 9/1999
CA 2416437 1/2002

(Continued)

OTHER PUBLICATIONS

Kim , K. et al, Integrated dipole antennas on silicon substrates for intra-chip communication, Antennas and Propagation, IEEE Transactions on, Jan. 1, 1999.

(Continued)

*Primary Examiner* — Tho G Phan
(74) *Attorney, Agent, or Firm* — Edell, Shapiro & Finnan, LLC

(57) ABSTRACT

A multi-band antenna includes at least one structure useable at multiple frequency ranges. The structure includes at least two levels of detail, with one level of detail making up another level of detail. The levels of detail are composed of closed plane figures bounded by the same number of sides. An interconnection circuit links the multi-band antenna to an input/output connector and incorporates adaptation networks, filters or diplexers. Each of the closed plane figures is linked to at least one other closed plane figure to exchange electromagnetic power. For at least 75% of the closed plane figures, the region or area of contact, intersection, or interconnection between the closed plane figures is less than 50% of their perimeter or area. Not all of the closed plane figures have the same size, and the perimeter of the structure has a different number of sides than its constituent closed plane figures.

20 Claims, 14 Drawing Sheets

Related U.S. Application Data continuation of application No. 13/669,916, filed on Nov. 6, 2012, now abandoned, which is a continuation of application No. 13/411,212, filed on Mar. 2, 2012, now Pat. No. 8,330,659, which is a continuation of application No. 13/044,189, filed on Mar. 9, 2011, now Pat. No. 8,154,463, which is a continuation of application No. 12/400,888, filed on Mar. 10, 2009, now Pat. No. 8,009,111, which is a continuation of application No. 11/780,932, filed on Jul. 20, 2007, now Pat. No. 7,528,782, which is a continuation of application No. 11/179,257, filed on Jul. 12, 2005, now Pat. No. 7,397,431, which is a continuation of application No. 11/102,390, filed on Apr. 8, 2005, now Pat. No. 7,123,208, which is a continuation of application No. 10/963,080, filed on Oct. 12, 2004, now Pat. No. 7,015,868, which is a continuation of application No. 10/102,568, filed on Mar. 18, 2002, now abandoned, which is a continuation of application No. PCT/ES99/00296, filed on Sep. 20, 1999.

(51) Int. Cl.

| | |
|---|---|
| ***H01Q 1/24*** | (2006.01) |
| ***H01Q 1/38*** | (2006.01) |
| ***H01Q 9/04*** | (2006.01) |
| ***H01Q 9/06*** | (2006.01) |
| ***H01Q 9/28*** | (2006.01) |
| ***H01Q 9/40*** | (2006.01) |
| ***H01Q 5/10*** | (2015.01) |
| ***H01Q 5/20*** | (2015.01) |
| ***H01Q 5/357*** | (2015.01) |
| ***H01Q 5/307*** | (2015.01) |
| ***H01Q 5/00*** | (2015.01) |
| ***H01Q 5/01*** | (2006.01) |
| ***H01Q 5/40*** | (2015.01) |
| ***H01Q 5/50*** | (2015.01) |

(52) U.S. Cl.

CPC ..... *H01Q 5/001* (2013.01); *H01Q 5/0051* (2013.01); *H01Q 5/01* (2013.01); *H01Q 5/10* (2015.01); *H01Q 5/20* (2015.01); *H01Q 5/307* (2015.01); *H01Q 5/357* (2015.01); *H01Q 5/40* (2015.01); *H01Q 5/50* (2015.01); *H01Q 9/04* (2013.01); *H01Q 9/0407* (2013.01); *H01Q 9/065* (2013.01); *H01Q 9/28* (2013.01); *H01Q 9/40* (2013.01)

(56) References Cited

U.S. PATENT DOCUMENTS

| | | | |
|---|---|---|---|
| 2,759,183 | A | 8/1956 | Woodward |
| 3,079,602 | A | 2/1963 | Du Hamel |
| 3,521,284 | A | 7/1970 | Shelton |
| 3,599,214 | A | 8/1971 | Altmayer |
| 3,605,102 | A | 9/1971 | Frye |
| 3,622,890 | A | 11/1971 | Fujimoto |
| 3,680,135 | A | 7/1972 | Boyer |
| 3,683,376 | A | 8/1972 | Pronovost |
| 3,689,929 | A | 9/1972 | Moody |
| 3,818,490 | A | 6/1974 | Leahy |
| 3,858,221 | A | 12/1974 | Harrison |
| 3,967,276 | A | 6/1976 | Goubau |
| 3,969,730 | A | 7/1976 | Fuchser |
| 4,021,810 | A | 5/1977 | Urpo |
| 4,024,542 | A | 5/1977 | Ikawa |
| 4,038,662 | A | 7/1977 | Turner |
| 4,131,893 | A | 12/1978 | Munson |
| 4,141,014 | A | 2/1979 | Sletten |
| 4,141,016 | A | 2/1979 | Nelson |
| 4,157,548 | A | 6/1979 | Kaloi |
| 4,218,682 | A | 8/1980 | Yu |
| 4,243,990 | A | 1/1981 | Nemit |
| 4,290,071 | A | 9/1981 | Fenwick |
| 4,318,109 | A | 3/1982 | Weathers |
| 4,356,492 | A | 10/1982 | Kaloi |
| 4,398,199 | A | 8/1983 | Makimoto |
| 4,424,500 | A | 1/1984 | Viola |
| 4,471,358 | A | 9/1984 | Glasser |
| 4,471,493 | A | 9/1984 | Schober |
| 4,504,834 | A | 3/1985 | Garay |
| 4,509,056 | A | 4/1985 | Ploussios |
| 4,517,572 | A | 5/1985 | Dixon |
| 4,518,968 | A | 5/1985 | Hately |
| 4,521,784 | A | 6/1985 | Nemet |
| 4,527,164 | A | 7/1985 | Cestaro |
| 4,531,130 | A | 7/1985 | Powers |
| 4,536,725 | A | 8/1985 | Hubler |
| 4,543,581 | A | 9/1985 | Nemet |
| 4,553,146 | A | 11/1985 | Butler |
| 4,571,595 | A | 2/1986 | Phillips |
| 4,584,709 | A | 4/1986 | Kneisel |
| 4,608,572 | A | 8/1986 | Blakney |
| 4,623,894 | A | 11/1986 | Lee |
| 4,656,642 | A | 4/1987 | Apostolos |
| 4,673,948 | A | 6/1987 | Kuo |
| 4,709,239 | A | 11/1987 | Herrick |
| 4,723,305 | A | 2/1988 | Phillips |
| 4,730,195 | A | 3/1988 | Phillips |
| 4,792,809 | A | 12/1988 | Gilbert |
| 4,794,396 | A | 12/1988 | Pothier |
| 4,799,156 | A | 1/1989 | Shavit |
| 4,827,271 | A | 5/1989 | Berneking |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba |
| 4,857,939 | A | 8/1989 | Shimazaki |
| 4,860,019 | A | 8/1989 | Jiang |
| 4,890,114 | A | 12/1989 | Egashira |
| 4,894,663 | A | 1/1990 | Urbish |
| 4,907,011 | A | 3/1990 | Kuo |
| 4,912,481 | A | 3/1990 | Mace |
| 4,975,711 | A | 12/1990 | Lee |
| 5,014,346 | A | 5/1991 | Phillips |
| 5,030,963 | A | 7/1991 | Tadama |
| 5,033,385 | A | 7/1991 | Zeren |
| 5,046,080 | A | 9/1991 | Lee |
| 5,061,944 | A | 10/1991 | Powers |
| 5,074,214 | A | 12/1991 | Zeren |
| 5,075,691 | A | 12/1991 | Garay |
| 5,138,328 | A | 8/1992 | Zibrik |
| 5,164,980 | A | 11/1992 | Bush |
| 5,168,472 | A | 12/1992 | Lockwood |
| 5,172,084 | A | 12/1992 | Fiedziuszko |
| 5,197,140 | A | 3/1993 | Balmer |
| 5,200,756 | A | 4/1993 | Feller |
| 5,210,542 | A | 5/1993 | Pett |
| 5,212,742 | A | 5/1993 | Normile |
| 5,212,777 | A | 5/1993 | Gove |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makino |
| 5,255,002 | A | 10/1993 | Day |
| 5,257,032 | A | 10/1993 | Diamond |
| 5,258,765 | A | 11/1993 | Dorrie |
| 5,262,791 | A | 11/1993 | Tsuda et al. |
| 5,300,936 | A | 4/1994 | Izadian |
| 5,307,075 | A | 4/1994 | Huynh |
| 5,337,063 | A | 8/1994 | Takahira |
| 5,337,065 | A | 8/1994 | Bonnet |
| 5,347,291 | A | 9/1994 | Moore |
| 5,355,144 | A | 10/1994 | Walton |
| 5,355,318 | A | 10/1994 | Dionnet |
| 5,361,061 | A | 11/1994 | Mays |
| 5,363,114 | A | 11/1994 | Shoemaker |

(56) References Cited

U.S. PATENT DOCUMENTS

| | | | |
|---|---|---|---|
| 5,373,300 | A | 12/1994 | Jenness |
| 5,394,163 | A | 2/1995 | Bullen |
| 5,402,134 | A | 3/1995 | Miller |
| 5,410,322 | A | 4/1995 | Sonoda |
| 5,420,599 | A | 5/1995 | Erkocevic |
| 5,422,651 | A | 6/1995 | Chang |
| 5,438,357 | A | 8/1995 | McNelley |
| 5,451,965 | A | 9/1995 | Matsumoto |
| 5,451,968 | A | 9/1995 | Emery |
| 5,453,751 | A | 9/1995 | Tsukamoto |
| 5,453,752 | A | 9/1995 | Wang |
| 5,457,469 | A | 10/1995 | Diamond |
| 5,471,224 | A | 11/1995 | Barkeshli |
| 5,493,702 | A | 2/1996 | Crowley |
| 5,495,261 | A | 2/1996 | Baker |
| 5,508,709 | A | 4/1996 | Krenz |
| 5,534,877 | A | 7/1996 | Sorbello |
| 5,537,367 | A | 7/1996 | Lockwood |
| 5,557,293 | A | 9/1996 | McCoy |
| 5,559,524 | A | 9/1996 | Takei |
| 5,563,882 | A | 10/1996 | Bruno |
| 5,569,879 | A | 10/1996 | Gloton |
| 5,572,223 | A | 11/1996 | Phillips |
| H1631 | H | 2/1997 | Montgomery |
| 5,600,844 | A | 2/1997 | Shaw |
| 5,608,417 | A | 3/1997 | De Vall |
| 5,619,205 | A | 4/1997 | Johnson |
| 5,621,913 | A | 4/1997 | Tuttle |
| 5,627,550 | A | 5/1997 | Sanad |
| 5,646,635 | A | 7/1997 | Cockson |
| 5,646,637 | A | 7/1997 | Miller |
| 5,657,028 | A | 8/1997 | Sanad |
| 5,672,345 | A | 9/1997 | Curtiss |
| 5,680,144 | A | 10/1997 | Sanad |
| 5,684,672 | A | 11/1997 | Karidis |
| 5,703,600 | A | 12/1997 | Burrell |
| 5,710,458 | A | 1/1998 | Iwasaki |
| 5,712,640 | A | 1/1998 | Andou |
| 5,734,352 | A | 3/1998 | Seward |
| 5,742,258 | A | 4/1998 | Kumpfbeck |
| 5,764,190 | A | 6/1998 | Murch |
| 5,767,811 | A | 6/1998 | Mandai |
| 5,767,814 | A | 6/1998 | Conroy |
| 5,790,080 | A | 8/1998 | Apostolos |
| 5,798,688 | A | 8/1998 | Schofield |
| 5,805,113 | A | 9/1998 | Ogino |
| 5,808,586 | A | 9/1998 | Phillips |
| 5,809,433 | A | 9/1998 | Thompson |
| 5,821,907 | A | 10/1998 | Zhu |
| 5,841,403 | A | 11/1998 | West |
| 5,861,845 | A | 1/1999 | Lee |
| 5,870,066 | A | 2/1999 | Asakura |
| 5,872,546 | A | 2/1999 | Ihara |
| 5,898,404 | A | 4/1999 | Jou |
| 5,903,240 | A | 5/1999 | Kawahata |
| 5,913,174 | A | 6/1999 | Casarez |
| 5,918,183 | A | 6/1999 | Janky |
| 5,926,139 | A | 7/1999 | Korisch |
| 5,926,141 | A | 7/1999 | Lindenmeier |
| 5,926,208 | A | 7/1999 | Noonen |
| 5,929,822 | A | 7/1999 | Kumpfbeck |
| 5,929,825 | A | 7/1999 | Niu |
| 5,936,583 | A | 8/1999 | Sekine |
| 5,936,587 | A | 8/1999 | Gudilev |
| 5,943,020 | A | 8/1999 | Liebendoerfer |
| 5,945,954 | A | 8/1999 | Johnson |
| 5,963,871 | A | 10/1999 | Zhinong |
| 5,966,097 | A | 10/1999 | Fukasawa |
| 5,966,098 | A | 10/1999 | Qi |
| 5,969,689 | A | 10/1999 | Martek |
| 5,973,648 | A | 10/1999 | Lindenmeier |
| 5,973,651 | A | 10/1999 | Suesada |
| 5,982,337 | A | 11/1999 | Newman |
| 5,986,609 | A | 11/1999 | Spall |
| 5,986,610 | A | 11/1999 | Miron |
| 5,986,615 | A | 11/1999 | Westfall |
| 5,990,838 | A | 11/1999 | Burns |
| 5,995,052 | A | 11/1999 | Sadler |
| 5,995,064 | A | 11/1999 | Yanagisawa |
| 6,002,367 | A | 12/1999 | Engblom |
| 6,005,524 | A | 12/1999 | Hayes |
| 6,008,764 | A | 12/1999 | Ollikainen |
| 6,008,774 | A | 12/1999 | Wu |
| 6,011,518 | A | 1/2000 | Yamagishi |
| 6,011,699 | A | 1/2000 | Murray |
| 6,014,114 | A | 1/2000 | Westfall |
| 6,018,319 | A | 1/2000 | Lindmark |
| 6,028,568 | A | 2/2000 | Asakura |
| 6,031,495 | A | 2/2000 | Simmons |
| 6,031,499 | A | 2/2000 | Dichter |
| 6,031,505 | A | 2/2000 | Qi |
| 6,034,645 | A | 3/2000 | Legay |
| 6,037,902 | A | 3/2000 | Pinhas |
| 6,037,907 | A | 3/2000 | Ha |
| 6,039,583 | A | 3/2000 | Korsunsky |
| 6,040,803 | A | 3/2000 | Spall |
| 6,043,783 | A | 3/2000 | Endo |
| 6,049,314 | A | 4/2000 | Munson |
| 6,054,953 | A | 4/2000 | Lindmark |
| 6,057,801 | A | 5/2000 | Desclos |
| 6,069,592 | A | 5/2000 | Wass |
| 6,072,434 | A | 6/2000 | Papatheodorou |
| 6,075,485 | A | 6/2000 | Lilly et al. |
| 6,075,494 | A | 6/2000 | Milroy |
| 6,075,500 | A | 6/2000 | Kurz |
| 6,078,294 | A | 6/2000 | Mitarai |
| 6,081,237 | A | 6/2000 | Sato |
| 6,087,990 | A | 7/2000 | Thill |
| 6,091,365 | A | 7/2000 | Derneryd |
| 6,094,179 | A | 7/2000 | Davidson |
| 6,097,339 | A | 8/2000 | Filipovic |
| 6,097,345 | A | 8/2000 | Walton |
| 6,100,855 | A | 8/2000 | Vinson |
| 6,104,347 | A | 8/2000 | Snygg |
| 6,104,349 | A | 8/2000 | Cohen |
| 6,107,920 | A | 8/2000 | Eberhardt |
| 6,111,545 | A | 8/2000 | Saari |
| 6,112,102 | A | 8/2000 | Zhinong |
| 6,114,674 | A | 9/2000 | Baugh |
| 6,122,533 | A | 9/2000 | Zhang |
| 6,124,830 | A | 9/2000 | Yuanzhu |
| 6,127,977 | A | 10/2000 | Cohen |
| 6,130,651 | A | 10/2000 | Yanagisawa |
| 6,131,042 | A | 10/2000 | Lee |
| 6,133,879 | A | 10/2000 | Grangeat |
| 6,133,883 | A | 10/2000 | Munson |
| 6,140,966 | A | 10/2000 | Pankinaho |
| 6,140,969 | A | 10/2000 | Lindenmeier |
| 6,140,975 | A | 10/2000 | Cohen |
| 6,141,540 | A | 10/2000 | Richards |
| 6,147,652 | A | 11/2000 | Sekine |
| 6,147,655 | A | 11/2000 | Roesner |
| 6,154,176 | A | 11/2000 | Fathy |
| 6,154,180 | A | 11/2000 | Padrick |
| 6,157,348 | A | 12/2000 | Openlander |
| 6,160,513 | A | 12/2000 | Davidson |
| 6,166,694 | A | 12/2000 | Ying |
| 6,172,618 | B1 | 1/2001 | Hakozaki |
| 6,175,333 | B1 | 1/2001 | Smith |
| 6,181,281 | B1 | 1/2001 | Desclos |
| 6,195,048 | B1 | 2/2001 | Chiba |
| 6,198,442 | B1 | 3/2001 | Rutkowski |
| 6,198,943 | B1 | 3/2001 | Sadler |
| 6,201,501 | B1 | 3/2001 | Arkko |
| 6,204,826 | B1 | 3/2001 | Rutkowski |
| 6,211,824 | B1 | 4/2001 | Holden |
| 6,211,826 | B1 | 4/2001 | Aoki |
| 6,211,834 | B1 | 4/2001 | Durham |
| 6,211,889 | B1 | 4/2001 | Stoutamire |
| 6,215,447 | B1 | 4/2001 | Johnson |
| 6,215,474 | B1 | 4/2001 | Shah |
| 6,218,989 | B1 | 4/2001 | Schneider |
| 6,218,991 | B1 | 4/2001 | Sanad |
| 6,218,992 | B1 | 4/2001 | Sadler |

(56) References Cited

U.S. PATENT DOCUMENTS 6,222,497 B1 4/2001 Hu
6,236,366 B1 5/2001 Yamamoto
6,236,372 B1 5/2001 Lindenmeier
6,239,752 B1 5/2001 Blanchard
6,239,765 B1 5/2001 Johnson
6,243,592 B1 6/2001 Nakada
6,255,994 B1 7/2001 Saito
6,255,995 B1 7/2001 Asano
6,259,407 B1 7/2001 Tran
6,260,088 B1 7/2001 Gove
6,266,023 B1 7/2001 Nagy
6,266,538 B1 7/2001 Waldron
6,268,836 B1 7/2001 Faulkner
6,271,794 B1 8/2001 Geeraert
6,281,846 B1 8/2001 Puente
6,285,326 B1 9/2001 Diximus
6,285,342 B1 9/2001 Brady
6,288,680 B1 9/2001 Tsuru
6,292,154 B1 9/2001 Deguchi
6,297,711 B1 10/2001 Seward
6,300,910 B1 10/2001 Kim
6,300,914 B1 10/2001 Yang
6,304,220 B1 10/2001 Herve
6,304,222 B1 10/2001 Smith
6,307,511 B1 10/2001 Ying
6,307,512 B1 10/2001 Geeraert
6,310,578 B1 10/2001 Ying
6,317,083 B1 11/2001 Johnson
6,320,543 B1 11/2001 Ohata
6,320,547 B1 11/2001 Fathy et al.
6,323,811 B1 11/2001 Tsubaki
6,326,919 B1 12/2001 Diximus
6,326,927 B1 12/2001 Johnson
6,327,485 B1 12/2001 Waldron
6,329,951 B1 12/2001 Wen
6,329,954 B1 12/2001 Fuchs
6,329,962 B2 12/2001 Ying
6,333,716 B1 12/2001 Pontoppidan
6,333,720 B1 12/2001 Gottl
6,342,861 B1 1/2002 Packard
6,343,208 B1 1/2002 Ying
6,346,914 B1 2/2002 Annamaa
6,348,892 B1 2/2002 Annamaa
6,351,241 B1 2/2002 Wass
6,352,434 B1 3/2002 Emmert
6,353,443 B1 3/2002 Ying
6,360,105 B2 3/2002 Nakada
6,362,790 B1 3/2002 Proctor, Jr.
6,366,243 B1 4/2002 Isohatala
6,367,939 B1 4/2002 Carter
6,373,447 B1 4/2002 Rostoker
6,377,217 B1 4/2002 Zhu
6,380,895 B1 4/2002 Moren
6,380,902 B2 4/2002 Duroux
6,381,471 B1 4/2002 Dvorkin
6,384,790 B2 5/2002 Dishart
6,384,793 B2 5/2002 Scordilis
6,388,626 B1 5/2002 Gamalielsson
6,396,444 B1 5/2002 Goward
6,400,339 B1 6/2002 Edvardsson
6,407,710 B2 6/2002 Keilen
6,408,190 B1 6/2002 Ying
6,417,810 B1 7/2002 Huels
6,417,816 B2 7/2002 Sadler
6,421,014 B1 7/2002 Sanad
6,421,024 B1 7/2002 Stolle
6,424,315 B1 7/2002 Glenn
6,429,818 B1 8/2002 Johnson
6,431,712 B1 8/2002 Turnbull
6,445,352 B1 9/2002 Cohen
6,452,549 B1 9/2002 Lo
6,452,553 B1 9/2002 Cohen
6,456,249 B1 9/2002 Johnson
6,470,174 B1 10/2002 Schefte
6,476,766 B1 11/2002 Cohen
6,476,769 B1 * 11/2002 Lehtola ..... H01Q 1/243 343/700 MS
6,480,158 B2 11/2002 Apostolos
6,483,462 B2 11/2002 Weinberger
6,489,925 B2 12/2002 Thursby
6,492,952 B1 12/2002 Hu
6,496,154 B2 12/2002 Gyenes
6,498,586 B2 12/2002 Pankinaho
6,498,588 B1 12/2002 Callaghan
6,525,691 B2 2/2003 Varadan
6,538,604 B1 3/2003 Isohatala
6,539,608 B2 4/2003 McKinnon
6,545,640 B1 4/2003 Herve
6,552,690 B2 4/2003 Veerasamy
6,570,538 B2 5/2003 Vaisanen
6,603,434 B2 8/2003 Lindenmeier
6,628,784 B1 9/2003 Montane Condemines
6,639,560 B1 10/2003 Kadambi
6,650,294 B2 11/2003 Ying
6,683,571 B2 1/2004 Ghosh
6,693,603 B1 2/2004 Smith
6,697,024 B2 2/2004 Fuerst
6,707,428 B2 3/2004 Gram
6,727,855 B1 4/2004 Nalbandian
6,741,210 B2 5/2004 Brachat
6,756,944 B2 6/2004 Tessier
6,812,893 B2 11/2004 Waterman
6,831,606 B2 12/2004 Sajadinia
6,870,506 B2 * 3/2005 Chen ..... H01Q 1/243 343/700 MS
6,897,830 B2 5/2005 Bae
6,937,191 B2 8/2005 Puente
6,937,196 B2 8/2005 Korva
6,943,730 B2 9/2005 Poilasne
6,977,808 B2 12/2005 Lam
6,980,158 B2 12/2005 Iguchi
6,995,720 B2 2/2006 Shikata
7,015,868 B2 3/2006 Puente Baliarda et al.
7,047,040 B2 5/2006 Kim
7,072,698 B2 7/2006 Underbrink
7,075,483 B2 7/2006 Okado
7,091,911 B2 8/2006 Qi
7,095,372 B2 8/2006 Soler
7,102,577 B2 9/2006 Richard
7,116,273 B2 10/2006 Morikawa
7,119,748 B2 10/2006 Autti
7,126,537 B2 10/2006 Cohen
7,202,818 B2 4/2007 Anguera
7,209,081 B2 4/2007 Chang
7,256,743 B2 8/2007 Korva
7,256,751 B2 8/2007 Cohen
7,265,724 B1 9/2007 Tan
7,312,762 B2 12/2007 Puente
7,342,553 B2 3/2008 Soler
7,345,634 B2 * 3/2008 Ozkar ..... H01Q 1/38 343/700 MS
7,388,549 B2 6/2008 Chiang
7,394,432 B2 7/2008 Baliarda et al.
7,397,431 B2 7/2008 Baliarda et al.
7,403,159 B2 7/2008 Gooshchin
7,403,165 B2 7/2008 Qi
7,528,782 B2 5/2009 Baliarda et al.
7,619,569 B2 * 11/2009 Wu ..... H01Q 1/38 343/700 MS
7,659,864 B2 2/2010 Chen et al.
7,663,556 B2 2/2010 Desclos
7,755,546 B2 7/2010 Ishimiya
7,903,034 B2 3/2011 Anguera
7,911,014 B2 3/2011 Doan
8,072,389 B2 * 12/2011 Chang ..... H01Q 1/38 343/700 MS
8,369,950 B2 2/2013 Rawat
8,427,373 B2 4/2013 Jiang et al.
8,593,354 B2 * 11/2013 Tai ..... H01Q 9/0421 343/700 MS
2001/0011964 A1 8/2001 Sadler
2001/0018793 A1 9/2001 McKinnon
2001/0050635 A1 12/2001 Weinberger
2001/0050636 A1 12/2001 Weinberger

(56) References Cited

U.S. PATENT DOCUMENTS

| | | | |
|---|---|---|---|
| 2001/0050638 | A1 | 12/2001 | Ishitobi |
| 2002/0000940 | A1 | 1/2002 | Moren |
| 2002/0000942 | A1 | 1/2002 | Duroux |
| 2002/0025839 | A1 | 2/2002 | Usui |
| 2002/0036594 | A1 | 3/2002 | Gyenes |
| 2002/0058539 | A1 | 5/2002 | Underbrink |
| 2002/0105468 | A1 | 8/2002 | Tessier |
| 2002/0109633 | A1 | 8/2002 | Ow |
| 2002/0126054 | A1 | 9/2002 | Fuerst |
| 2002/0126055 | A1 | 9/2002 | Lindenmeier |
| 2002/0140615 | A1 | 10/2002 | Carles et al. |
| 2002/0171601 | A1 | 11/2002 | Puente Baliarda |
| 2002/0175866 | A1 | 11/2002 | Gram |
| 2002/0190904 | A1 | 12/2002 | Cohen |
| 2003/0160723 | A1 | 8/2003 | Cohen |
| 2003/0201942 | A1 | 10/2003 | Poilasne |
| 2004/0145529 | A1 | 7/2004 | Iguchi |
| 2006/0001576 | A1 | 1/2006 | Contopanagos |
| 2006/0033664 | A1 | 2/2006 | Soler |
| 2006/0077101 | A1 | 4/2006 | Puente |
| 2006/0145923 | A1 | 7/2006 | Autti |
| 2008/0252536 | A1 | 10/2008 | Anguera |
| 2013/0194153 | A1 | 8/2013 | Puente |
| 2013/0194154 | A1 | 8/2013 | Puente |
| 2013/0285859 | A1* | 10/2013 | Puente Baliarda ..... H01Q 1/36 343/700 MS |

FOREIGN PATENT DOCUMENTS

| | | |
|---|---|---|
| CN | 2224466 | 4/1996 |
| CN | 1559093 | 12/2004 |
| DE | 3337941 | 5/1985 |
| DE | 4313397 | 11/1994 |
| DE | 19511300 | 10/1996 |
| DE | 19929689 | 1/2001 |
| DE | 10206426 | 11/2002 |
| DE | 10138265 | 7/2003 |
| DE | 10204079 | 8/2003 |
| EP | 0096847 | 12/1983 |
| EP | 0297813 | 1/1989 |
| EP | 0358090 | 3/1990 |
| EP | 0431764 | 6/1991 |
| EP | 0543645 | 5/1993 |
| EP | 0590671 | 9/1993 |
| EP | 0571124 | 11/1993 |
| EP | 0688040 | 12/1995 |
| EP | 0765001 | 9/1996 |
| EP | 0753897 | 1/1997 |
| EP | 0814536 | 12/1997 |
| EP | 0856907 | 8/1998 |
| EP | 0871238 | 10/1998 |
| EP | 0892459 | 1/1999 |
| EP | 0902472 | 3/1999 |
| EP | 0929121 | 7/1999 |
| EP | 0932219 | 7/1999 |
| EP | 0938158 | 8/1999 |
| EP | 0942488 | 9/1999 |
| EP | 0969375 | 1/2000 |
| EP | 1024552 | 1/2000 |
| EP | 0986130 | 3/2000 |
| EP | 0997972 | 3/2000 |
| EP | 0993070 | 4/2000 |
| EP | 0997974 | 5/2000 |
| EP | 1018777 | 7/2000 |
| EP | 1018779 | 7/2000 |
| EP | 1026774 | 8/2000 |
| EP | 1063721 | 12/2000 |
| EP | 1067627 | 1/2001 |
| EP | 1071161 | 1/2001 |
| EP | 1077508 | 2/2001 |
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1198027 | 10/2001 |
| EP | 0749176 | 9/2002 |
| EP | 1237224 | 9/2002 |
| EP | 1258054 | 11/2002 |
| EP | 1267438 | 12/2002 |
| EP | 1326302 | 11/2003 |
| EP | 1378961 | 1/2004 |
| EP | 1317018 | 2/2004 |
| EP | 1396906 | 3/2004 |
| EP | 1401050 | 3/2004 |
| EP | 1414106 | 4/2004 |
| EP | 1424747 | 6/2004 |
| EP | 1443595 | 8/2004 |
| EP | 1453140 | 9/2004 |
| EP | 1465291 | 10/2004 |
| EP | 0843905 | 12/2004 |
| EP | 1515392 | 3/2005 |
| ES | 2112163 | 3/1998 |
| ES | 2142280 | 5/2000 |
| ES | 2156832 | 1/2002 |
| FR | 2543744 | 10/1984 |
| FR | 2704359 | 11/1994 |
| FR | 2837339 | 9/2003 |
| GB | 2112579 | 7/1983 |
| GB | 2161026 | 1/1986 |
| GB | 2215136 | 9/1989 |
| GB | 2289163 | 11/1995 |
| GB | 2317994 | 4/1998 |
| GB | 2330951 | 5/1999 |
| GB | 2355116 | 4/2001 |
| GB | 2361584 | 10/2001 |
| JP | 53009451 | 1/1978 |
| JP | 55123203 | 9/1980 |
| JP | 05007109 | 1/1993 |
| JP | 5129816 | 5/1993 |
| JP | 5147806 | 6/1993 |
| JP | 5267916 | 10/1993 |
| JP | 05-308223 | 11/1993 |
| JP | 05347507 | 12/1993 |
| JP | 06-037531 | 2/1994 |
| JP | 06-085530 | 3/1994 |
| JP | 6204908 | 7/1994 |
| JP | 6252629 | 9/1994 |
| JP | 09-252214 | 9/1997 |
| JP | 1997-246852 | 9/1997 |
| JP | 10-093332 | 4/1998 |
| JP | 10-163748 | 6/1998 |
| JP | 10-209744 | 8/1998 |
| JP | 10-303637 | 11/1998 |
| JP | 11-004113 | 1/1999 |
| JP | 11-027042 | 1/1999 |
| JP | 11088032 | 3/1999 |
| JP | 11136015 | 5/1999 |
| JP | 11-220319 | 8/1999 |
| JP | 11317610 | 11/1999 |
| JP | 2002-158529 | 5/2002 |
| JP | 3449484 | 9/2003 |
| JP | 2003283230 | 10/2003 |
| NZ | 508835 | 11/2002 |
| RU | 2170478 | 7/2001 |
| SE | 518988 | 12/2002 |
| TW | 554571 | 9/2003 |
| WO | 88/09065 | 11/1988 |
| WO | 93/12559 | 6/1993 |
| WO | 94/24722 | 10/1994 |
| WO | 94/24723 | 10/1994 |
| WO | 95/05012 | 2/1995 |
| WO | 95/11530 | 4/1995 |
| WO | 96/03783 | 2/1996 |
| WO | 96/04691 | 2/1996 |
| WO | 96/10276 | 4/1996 |
| WO | 96/27219 | 9/1996 |
| WO | 96/29755 | 9/1996 |
| WO | 96/38881 | 12/1996 |
| WO | 97/06578 | 2/1997 |
| WO | 97/11507 | 3/1997 |
| WO | 97/32355 | 9/1997 |
| WO | 97/33338 | 11/1997 |

(56) References Cited

FOREIGN PATENT DOCUMENTS

| | | |
|---|---|---|
| WO | 97/35360 | 11/1997 |
| WO | 97/47054 | 12/1997 |
| WO | 98/05088 | 2/1998 |
| WO | 98/12771 | 3/1998 |
| WO | 98/20578 | 5/1998 |
| WO | 98/31067 | 7/1998 |
| WO | 98/33234 | 7/1998 |
| WO | 98/36469 | 8/1998 |
| WO | 98/39814 | 9/1998 |
| WO | 99/03166 | 1/1999 |
| WO | 99/03167 | 1/1999 |
| WO | 99/03168 | 1/1999 |
| WO | 99/22420 | 5/1999 |
| WO | 99/25042 | 5/1999 |
| WO | 99/25044 | 5/1999 |
| WO | 99/27607 | 6/1999 |
| WO | 99/27608 | 6/1999 |
| WO | 99/31757 | 6/1999 |
| WO | 99/35691 | 7/1999 |
| WO | 99/43048 | 8/1999 |
| WO | 99/56345 | 11/1999 |
| WO | 99/56347 | 11/1999 |
| WO | 99/57785 | 11/1999 |
| WO | 99/60665 | 11/1999 |
| WO | 99/62139 | 12/1999 |
| WO | 99/65102 | 12/1999 |
| WO | 00/01028 | 1/2000 |
| WO | 00/03451 | 1/2000 |
| WO | 00/03453 | 1/2000 |
| WO | 00/08712 | 2/2000 |
| WO | 00/22695 | 4/2000 |
| WO | 00/30267 | 5/2000 |
| WO | 00/31825 | 6/2000 |
| WO | 00/36700 | 6/2000 |
| WO | 00/49680 | 8/2000 |
| WO | 00/52784 | 9/2000 |
| WO | 00/52787 | 9/2000 |
| WO | 00/55939 | 9/2000 |
| WO | 00/57511 | 9/2000 |
| WO | 00/67342 | 11/2000 |
| WO | 00/74172 | 12/2000 |
| WO | 00/77884 | 12/2000 |
| WO | 01/03238 | 1/2001 |
| WO | 01/05048 | 1/2001 |
| WO | 01/06594 | 1/2001 |
| WO | 01/08255 | 2/2001 |
| WO | 01/08257 | 2/2001 |
| WO | 01/08260 | 2/2001 |
| WO | 01/09976 | 2/2001 |
| WO | 01/11721 | 2/2001 |
| WO | 01/13464 | 2/2001 |
| WO | 01/15270 | 3/2001 |
| WO | 01/15271 | 3/2001 |
| WO | 01/17061 | 3/2001 |
| WO | 01/17063 | 3/2001 |
| WO | 01/17064 | 3/2001 |
| WO | 01/18904 | 3/2001 |
| WO | 01/18909 | 3/2001 |
| WO | 01/20714 | 3/2001 |
| WO | 01/20927 | 3/2001 |
| WO | 01/22528 | 3/2001 |
| WO | 01/24314 | 4/2001 |
| WO | 01/24316 | 4/2001 |
| WO | 01/26182 | 4/2001 |
| WO | 01/28035 | 4/2001 |
| WO | 01/29927 | 4/2001 |
| WO | 01/31739 | 5/2001 |
| WO | 01/33665 | 5/2001 |
| WO | 01/35491 | 5/2001 |
| WO | 01/37369 | 5/2001 |
| WO | 01/37370 | 5/2001 |
| WO | 01/39321 | 5/2001 |
| WO | 01/41252 | 6/2001 |
| WO | 01/48861 | 7/2001 |
| WO | 01/54225 | 7/2001 |
| WO | 01/65636 | 9/2001 |
| WO | 01/73890 | 10/2001 |
| WO | 01/78192 | 10/2001 |
| WO | 01/82410 | 11/2001 |
| WO | 01/86753 | 11/2001 |
| WO | 01/89031 | 11/2001 |
| WO | 02/01668 | 1/2002 |
| WO | 02/35646 | 5/2002 |
| WO | 02/35652 | 5/2002 |
| WO | 02/054538 | 7/2002 |
| WO | 02/065583 | 8/2002 |
| WO | 02/071535 | 9/2002 |
| WO | 02/078123 | 10/2002 |
| WO | 02/078124 | 10/2002 |
| WO | 02/080306 | 10/2002 |
| WO | 02/087014 | 10/2002 |
| WO | 02/089254 | 11/2002 |
| WO | 02/091518 | 11/2002 |
| WO | 02/096166 | 11/2002 |
| WO | 02/103843 | 12/2002 |
| WO | 03/003503 | 1/2003 |
| WO | 03/017421 | 2/2003 |
| WO | 03/023900 | 3/2003 |
| WO | 03/026064 | 3/2003 |
| WO | 2004/075011 | 9/2004 |

OTHER PUBLICATIONS

Kim , K. S. et al., Dual-frequency aperture-coupled square patch antenna with double notches, Microwave and Optical Technology Letters, Mar. 20, 2000, vol. 24, No. 6.

Kobayashi , K., Estimation of 3D fractal dimension of real electrical tree patterns, Properties and Applications of Dielectric Materials, 4th , 1994. International Conference on, Jul. 1, 1994.

Kraus , J. D., Antennas, McGraw-Hill Book Company, Jan. 1, 1988, Contents.

Kraus , J. D., Antennas—Chapter 2, McGraw-Hill Book Company, Jan. 1, 1988, p. 17-19 , 723-749.

Kronberger , R. et al., Multiband planar inverted-F car antenna for mobile phone and GPS, Antennas and Propagation Society (APS), 1999. IEEE International Symposium, Aug. 2, 1999.

Kuhlman , E. A., A directional flush mounted UHF communications antenna for high performance jet aircraft for the 225-400 MC frequency range, USAF Antenna Research and Development Program, 5th , 1955. Symposium on the, Oct. 1, 1955.

Kumar , G. ; Gupta , K., Nonradiating edges and four edges gap-coupled multiple resonator broadband microstrip antennas, Antennas and Propagation, IEEE Transactions on, Feb. 1, 1985.

Kumar , G. ; Gupta , K., Directly coupled multiple resonator wide-band microstrip antennas, Antennas and Propagation, IEEE Transactions on, Jun. 6, 1985, vol. AP-33.

Kumprasert , N., Theoretical study of dual resonant frequency and circular polarization of elliptical microstrip antennas, Antennas and Propagation Society (APS), 2000. IEEE International Symposium, Jul. 1, 2000.

Kuo , S., Frequency-independent log-periodic antenna arrays with increased directivity and gain, USAF Antenna Research and Development Program, 21th , 1971. Symposium on the, Oct. 12, 1971.

Kurpis , G. P., The New IEEE standard dictionary of electrical and electronics terms, IEEE Standards, Jan. 1, 1993, p. 90, 352, 393.

Kutter , R. E., Fractal antenna design, University of Dayton, Jan. 1, 1996.

Kyriacos , S. ; Buczkowski , S. et al., A modified box-counting method, Fractals, Jan. 1, 1994, vol. 2, No. 2, p. 321-324.

Lancaster , M. J. et al, Superconducting filters using slow-wave transmission lines, Advances in Superconductivity, 8th , New Delhi, 1996. International Symposium on, Jan. 1, 1996.

Lancaster , M. J. et al., Miniature superconducting filters, Microwave Theory and Techniques, IEEE Transactions on, Jul. 1, 1996.

Lauwerier , H., Fractals. Endlessly repeated geometrical figures, Princeton University Press, Jan. 1, 1991, Chapters 1, 3 and 5 for Space-filling.

Lee , J. C., Analysis of differential line length diplexers and long-stub filters, USAF Antenna Research and Development Program, 21th , 1971. Symposium on the, Oct. 12, 1971.

(56) References Cited

OTHER PUBLICATIONS

Liang , X., Multiband characteristics of two fractal antennas, Microwave and Optical Technology Letters, Nov. 20, 1999.
Liu , D., A multi-branch monopole antenna for dual-band cellular applications, Antennas and Propagation Society (APS), 1999. IEEE International Symposium, Sep. 3, 1999, vol. 3.
Liu , D., A dual band antenna for cellular applications, Antennas and Propagation Society (APS), 1998. IEEE International Symposium, Jun. 21, 1998.
Liu , Z. ; Hall , P. S., A novel dual-band antenna for hand-held portable telephone, Antennas and Propagation Society (APS), 1996. IEEE International Symposium, Jul. 21, 1996.
Liu , Z. D. ; Hall , P. S. ; Wake , D., Dual-frequency planar inverted-f antenna, Antennas and Propagation, IEEE Transactions on, Oct. 1, 1997.
Liu , Z. D. et al, Dual band antenna for handheld portable telephones, Electronics Letters, Mar. 28, 1996.
Lo , Y. T. ; Solomon , D. ; Richards , W. F., Theory and experiment on microstrip antennas, Antenna Applications, 1978. Symposium, Sep. 20, 1978.
Locus , S. S., Antenna design for high performance missile environment, USAF Antenna Research and Development Program, 5th , 1955. Symposium on the, Oct. 16, 1955.
Lu , J. H., Single-feed circularly polarized triangular microstrip antenna with triangular slot for compact operation, Microwave and Optical Technology Letters, Aug. 20, 2002.
Lu , J. H., Single feed circularly polarized triangular microstrip antennas, Antennas and Propagation Society (APS), 1999. IEEE International Symposium, Jul. 11, 1999.
Lu , J. H., Slot loaded rectangular microstrip antenna for dual frequency operation, Microwave and Optical Technology Letters, Feb. 20, 2000.
Lu , J. H., Single-feed dual-frequency rectangular microstrip antenna, Antennas and Propagation Society (APS), 2000. IEEE International Symposium, Jul. 1, 2000.
Lu , J. H. , Tang C. L. ; Wong , K. L., Novel dual-frequency and broad-band designs of slot-loaded equilateral triangular microstrip antennas, Antennas and Propagation, IEEE Transactions on, Jul. 1, 2000, vol. 48.
Lu , J. H. ; Tang , C. L. ; Wong , K. L., Single-feed slotted equilateral triangular microstrip antenna for circular polarization, Antennas and Propagation, IEEE Transactions on, Jul. 1, 1999.
Lu , J. H. ; Wong , K. L., Dual-frequency rectangular microstrip antenna with embedded spur lines and integrated reactive loading, Microwave and Optical Technology Letters, May 20, 1999, vol. 21.
Lu , J. H. ; Wong , K. L., Single-feed dual-frequency equilateral-triangular microstrip antenna with pair of spur lines, Electronics Letters, Jun. 11, 1998, vol. 34.
Lu , J. H. et al., Slot-loaded, Meandered Rectangular Microstrip Antenna With Compact Dualfrequency Operation, Electronics Letters, May 28, 1998, vol. 34, No. 11.
Luk, K. M. ; Guo , K. F. et al., L-probe proximity fed U-slot patch antenna, Electronics Letters, Sep. 17, 1998, vol. 34, No. 19, p. 1806-1807.
Lyon , J. ; Rassweiler , G. ; Chen , C., Ferrite-loading effects on helical and spiral antennas, USAF Antenna Research and Development Program, 15th , 1965. Symposium on the, Oct. 12, 1965.
Maci , S. et al., Dual-band Slot-loaded patch antenna, Microwaves, Antennas and Propagation, IEE Proceedings H, Jun. 1, 1995, vo1. 142, p. 225-232.
Maci , S. et al., Dual-frequency patch antennas, Antennas and Propagation Magazine, IEEE, Dec. 1, 1997.
Maci , S. et al., Single-layer dual frequency patch antenna, Electronics Letters, Aug. 3, 1993.
Mandelbrot , B. B., The fractal geometry of nature, H. B. Fenn and Company, Jan. 1, 1977, Pag.Contents.
Mandelbrot , B. B., Opinions (Benoit B. Mandelbrot), World Scientific Publishing Company, Jan. 1, 1993.
Mandelbrot, B. B., The fractal geometry of nature, Freeman and Company, Jan. 1, 1982, p. 32-35.
Martin , R. W. ; Stangel, J. J., An unfurlable, high-gain log-periodic antenna for space use, USAF Antenna Research and Development Program, 17th , 1967. Symposium on the, Nov. 14, 1967.
Martin, W. R., Flush vor antenna for c-121 aircraft, USAF Antenna Research and Development Program, 2th , 1952. Symposium on the, Oct. 19, 1952.
Matthaei , G. L., Microwave filters impedance-matching networks and coupling structures, Artech House, Jan. 1, 1980, p. 1096.
Matthaei , G. L. et al., Hairpin-comb filters for HTS and other narrow-band applications, Microwave Theory and Techniques, IEEE Transactions on, Aug. 1, 1997, vol. 45, No. 3.
May , M., Aerial magic, New Scientist, Jan. 31, 1998.
Mayes , P., Some broadband , low-profile antennas, Antenna Applications, 1985. Symposium, Sep. 18, 1985.
Mayes , P. E., High gain log-periodic antennas, USAF Antenna Research and Development Program, 10th , 1960. Symposium on the, Oct. 3, 1960.
Mayes , P. E, Multi-arm logarithmic spiral antennas, USAF Antenna Research and Development Program, 10th , 1960. Symposium on the, Oct. 3, 1960.
McCormick , J., A Low-profile electrically small VHF antenna, USAF Antenna Research and Development Program, 15th , 1965. Symposium on the, Oct. 12, 1965.
McDowell , E. P., Flush mounted X-band beacon antennas for aircraft, USAF Antenna Research and Development Program, 3th , 1953. Symposium on the, Oct. 18, 1953.
McDowell , E. P., High speed aircraft antenna problems and some specific solutions for MX-1554, USAF Antenna Research and Development Program, 2th , 1952. Symposium on the, Oct. 19, 1952.
McSpadden , J. O., Design and experiments of a high-conversion-efficiency 5.8-GHz rectenna, Microwave Theory and Techniques, IEEE Transactions on, Dec. 1, 1998, vol. 46.
Mehaute, A., Fractal Geometrics, CRC Press, Jan. 1, 1990, p. 3-35.
Meier , K. ; Burkhard , M. ; Schmid , T. et al, Broadband calibration of E-field probes in Lossy Media, Microwave Theory and Techniques, IEEE Transactions on, Oct. 1, 1996, vol. 44, No. 10.
Meinke , H. ; Gundlah , F. V., Radio engineering reference book—vol. 1—Radio components. Circuits with lumped parameters . . . , State energy publishing house, Jan. 1, 1961, p. 4.
Misra , S., Experimental investigations on the impedance and radiation properties of a three-element concentric microstrip square-ring antenna, Microwave and Optical Technology Letters, Feb. 5, 1996, vol. 11, No. 2.
Misra , S. ; Chowdhury , S. K., Study of impedance and radiation properties of a concentric microstrip triangular-ring antenna and Its modeling techniques using FDTD method, Antennas and Propagation, IEEE Transactions on, Apr. 1, 1998, vol. 46, No. 4.
Moheb , H., Design and development of co-polarized ku-band ground terminal system for very small aperture terminal (VSAT) application, Antennas and Propagation Society (APS), 1999. IEEE International Symposium, Jul. 11, 1999.
Moleiro , A. et al, Dual band microstrip patch antenna element with parasitic for gsm, Antennas and Propagation Society (APS), 2000. IEEE International Symposium, Jul. 1, 2000.
Moosavi Bafrooei , P., Characteristics of single and double layer microstrip square-ring antennas, Antennas and Propagation, IEEE Transactions on, Oct. 1, 1999.
Morioka , T. et al, Slot antenna with parasitic element for dual band operation, Electronics Letters, Dec. 4, 1997.
Munson , R., Antenna engineering Handbook—Chapter 7—Microstrip Antennas, Johnson , R. C.—McGraw-Hill—Third Edition, Jan. 1, 1993.
Munson , R., Conformal microstrip array for a parabolic dish, USAF Antenna Research and Development Program, 23th , 1973. Symposium on the, Oct. 1, 1973.
Munson , R., Microstrip phased array antennas, USAF Antenna Research and Development Program, 22th , 1972. Symposium on the, Oct. 11, 1972.
Munson , R. E., Conformal microstrip communication antenna, USAF Antenna Research and Development Program, 23th , 1973. Symposium on the, Oct. 10, 1973.

(56) References Cited

OTHER PUBLICATIONS

Mushiake, Y., Self-Complementary Antennas : Principle of Self Complementarity for Constant Impedance, Springer, Jan. 1, 1996, p. 81-86.
Na, The American Heritage Dictionary, Morris—William—(Second College edition), Jan. 1, 1982, p. 817 , 961.
Na, The American Heritage College Dictionary, Houghton Mifflin Comp.—3d ed., Jan. 1, 1997, pp. 684 and 1060.
Na, The handbook of antenna design—Index, Rudge, A. W. et al.—Peter Peregrinus—Institution of Electrical Engineers, Jan. 1, 1986, vol. 1-2.
Na, IEEE Standard Dictionary of Electrical and Electronics Terms, IEEE Press (6th ed.), Jan. 1, 1996, p. 359, 688, and 878.
Na, Webster's New Collegiate Dictionary, G & C Merriam Co., Oct. 1, 1981, p. 60, 237, 746.
Na, The American Century Dictionary, Oxford University Press, Jan. 1, 1995, p. 376, 448.
Na, IEEE Standard dictionary of electrical and electronics terms, IEEE Standard (6th ed.), Jan. 1, 1996, pp. 229, 431, 595, 857.
Na, Collins Dictionary, Collins, Jan. 1, 1979, p. 608.
Na, The Random House Dictionary, Random House, Jan. 1, 1984, p. 1029, 1034.
Na, The American Heritage Dictionary, New College ed. (2nd ed. ), Jan. 1, 1982, p. 311, 1208.
Na, Merriam-Webster's Collegiate Dictionary (1993)—Declaration of J. Baxter—Exhibit CC, Merriam-Webster's., Jan. 1, 1993, p. 863.
Na, American Heritage College Dictionary (1997), Mifflin Comp. , Jan. 1, 1997, p. 340 , 1016.
Na, IEEE Standard Definitions of Terms for Antennas, IEEE Std. 145-1993 (1993), The Institute of Electrical and Electronics Engineers , Mar. 18, 1993.
Na, User's guide, Nokia, Jun. 7, 1998.
Na, User's Guide RIM 950 Wireless Handheld, RIM, Jan. 1, 1997, Version 1.7.
Na, Rockwell B-1B Lancer, <http://home.att.net/~jbaugher2/newb1_2.html>, Oct. 12, 2001.
Na, Digital cellular telecommunications system (Phase 2) : Types of Mobile Stations (MX) (GSM 02.06), European Telecommunications Standard Institute (ETSI), May 9, 1996.
Na, Digital cellular telecommunications system (Phase2). Mobile Station MS Conformance specifiaction Part 1 Conformance Specification GSM11.10-1), European Telecommunications Standard Institute (ETSI), Mar. 1, 1996.
Na, IEEE Standard definitions of terms for antennas, IEEE Std. 145-1983, The Institute of Electrical and Electronic Engineers (IEEE), Jun. 22, 1983.
Na, Int'l Electro-Technical Commission IEV No. 712-01-04—Electropedia : the world's online electrotechnical vocabulary, Electropedia—http://www.electropedia.org, Apr. 1, 1998.
Na, Fractus web—www.fractus.com/main/fractus/corporate/, Fractus SA, Oct. 7, 2010.
Na, FractalComs web—www.tsc.upc.es/fractalcoms/, Universitat Politecnica de Catalunya (UPC).
Na, RIM 950 product—Photos of, RIM, Jun. 30, 1998.
Na, Nokia 8860—Internal photos—FCC ID: LJPNSW-6NX, Nokia and Federal Communications Commission ( FCC ), Jun. 24, 1999.
Na, Nokia 8850, Nokia, Jan. 1, 1999.
Na, Nokia 8810, Nokia, Jan. 1, 1998.
Na, Nokia 8265, Nokia, Mar. 4, 2002.
Na, Nokia 8260, Nokia, Sep. 8, 2000.
Na, Nokia 8210, Nokia, Jan. 1, 1999.
Na, Nokia 3360, Nokia, May 3, 2001.
Na, Nokia 3210, Nokia, Jan. 1, 1999.
Gianvittorio , J. P., Fractal element antennas—a compilation of configurations with novel characteristics, Antennas and Propagation Society (APS), 2000. IEEE International Symposium, Jul. 16, 2000.
Gilbert , R. ; Pirrung , A. ; Kopf , D. et al., Structurally-integrated optically-reconfigurable antenna array, Antenna Applications, 1995. Symposium, Sep. 20, 1995.
Gillespie , E. S., Glide slope antenna in the nose radome of the F-104 A and B, USAF Antenna Research and Development Program, 7th , 1957. Symposium on the, Oct. 21, 1957.
Gobien , A. T., Investigation of low profile antenna designs for use in hand-held radios—Master of Science, Virginia Polytechnic Institute and State University, Aug. 1, 2007.
Gonzalez , J. M. ; Navarro , M. ; Puente , C. et al, Active zone self-similarity of fractal-sierpinski antenna verified using infra-red thermograms, Electronics Letters, Aug. 19, 1999, vol. 35, No. 17.
Gough , C. E. ; Porch , A. ; Lancaster , M. J. et al, High Tc coplanar resonators for microwave applications and scientific studies, Physica C, Aug. 1, 1997, vol. 282-287, No. 2001, p. 395-398.
Graf, R, Modern dictionary of electronics, Butterworth-Heinemann (6th Ed.), Jan. 1, 1984, pp. 209, 644.
Gray , D. ; Lu , J. W. ; Thiel , D. V., Electronically steerable Yagi-Uda microstrip patch antenna array, Antennas and Propagation, IEEE Transactions on, May 1, 1998, vol. 46.
Greiser , J. W. and Brown , G. S., A 500:1 scale model of warla : A wide aperture radio location array, USAF Antenna Research and Development Program, 13th , 1963. Symposium on the, Oct. 14, 1963.
Griffin , D. W. ; Parfitt , A. J., Electromagnetic design aspect of packages for monolithic microwave integrated circuit based arrays with integrated antenna elements, Antennas and Propagation, IEEE Transactions on, Sep. 1, 1995, vol. 43, No. 9.
Guo , Y., Dual band slot loaded short circuited patch antenna, Electronics Letters, Feb. 17, 2000.
Guo , Y. X. ; Luk , K. F. Lee ; Chow , Y. L., Double U-slot rectangular patch antenna, Electronics Letters, Sep. 17, 1998.
Gupta , K. C., Broadbanding techniques for microstrip patch antennas—a review, Antenna Applications, 1988. Sysmposium, Sep. 21, 1988.
Gupta , K. C. ; Benalla , A., Microstrip antenna design, Artech House, Jan. 1, 1988.
Haapala , P. ; Vainikainen , P., Helical antennas for multi-mode mobile phones, Microwave Conference (EuMC), 26th , 1996. European, Sep. 9, 1996.
Hagström , P., Novel ceramic antenna filters for GSM / DECT and GSM / PCN network terminals, Personal Indoor and Mobile Radio Communications (PIMRC), 8th , 1997. Waves of the year 2000. International Symposium on, Sep. 1, 1997.
Hall , P. S., System applications—the challenge for active integrated antennas, Antennas and Propagarion (AP2000), Davos, 2000. Millenium Conference on, Apr. 1, 2000.
Halloran , T. W., A dual channel VHF telemetry antenna system for re-entry vehicle applications, USAF Antenna Research and Development Program, 11th , 1961. Symposium on the, Oct. 16, 1961.
Hammad , H. F. et al, Dual band aperture coupled antenna using spur line, Antennas and Propagation Society (APS), 1997. IEEE International Symposium, Jul. 24, 1997.
Hansen , R. C., Fundamental limitations in antennas, Proceedings of the IEEE, Feb. 1, 1981 vol. 69, No. 2, p. 170-182.
Hara Prasad , R. V., Microstrip fractal patch antenna for multiband communication, Electromagnetic Letters, IEEE, Jul. 6, 2000, vol. 36, No. 14, p. 1179-1180.
Hart , N. ; Chalmers , A., Fractal element antennas, Digital Image Computer Techniques and Applications (DICTA) , Auckland, 1997, Jun. 2, 1997.
Heberling , D. ; Geisser , M., Trends on handset antennas, Microwave Conference (EuMC), 29th , 1999. European, Mar. 3, 1999, vol. 1.
Henderson West , B, The Prentice-Hall encyclopedia of mathematics, Prentice-Hall, Jan. 1, 1982, p. 404-425.
Herscovici , N., New considerations in the design of microstrip antennas, Antennas and Propagation, IEEE Transactions on, Jun. 1, 1998.
Hikita , M. ; Shibagaki , N. ; Asal , K. et al, New miniature saw antenna duplexer used in GHz-band digital mobile cellular radios, Ultrasonics Symposium, IEEE, Nov. 7, 1995.
Hikita , M. M et al, Miniature SAW antenna duplexer for 800-Mhz portable telephone used in cellular radio systems, Microwave Theory and Techniques, IEEE Transactions on, Jun. 1, 1988.

(56) References Cited

OTHER PUBLICATIONS

Hill , J. E. ; Bass , J. F., An integrated strip-transmission-line antenna system for J-band, USAF Antenna Research and Development Program, 23th , 1973. Symposium on the, Oct. 10, 1973.
Hofer , D. A. ; Kesler , Dr. O. B. ; Loyet , L. L., A compact multi-polarized broadband antenna, Antenna Applications, 1989. Symposium, Sep. 20, 1989.
Hoffmeister , M., The dual-frequency-inverted-F monopole antenna for mobile communications, N/A, Jan. 6, 1999.
Hohlfeld , R. G. ; Cohen N., Self-similarity and the geometric requirements for frequency independence in antennae, Fractals, Jan. 17, 1999, vol. 7, No. 1, p. 79-84.
Holtum , A. G., A dual frequency dual polarized microwave antenna, USAF Antenna Research and Development Program, 16th , 1966. Symposium on the, Oct. 11, 1966.
Holzschuh , D. L, Hardened antennas for atlas and titan missile site communications, USAF Antenna Research and Development Program, 13th , 1963. Symposium on the, Oct. 14, 1963.
Hong , J. S. ; Lancaster , M. J., Recent advances in microstrip filters for communications and other applications, Advances in Passive Microwave Components, 1997. IEE Colloquium on, May 22, 1997.
Hong , J. S. ; Lancaster , M. J., Compact microwave elliptic function filter using novel microstrip meander open-loop resonators, Electronics Letters, Mar. 14, 1996, vol. 32, p. 563-564.
Hsieh , G. B.; Pan , S. C., Dual-frequency slotted triangular microstrip antenna with an inset microstrip-line feed, Microwave and Optical Technology Letters, Dec. 5, 2000, vol. 27, No. 5.
Huynh , T ; Lee , K. F., Single-layer single-patch wideband microstrip antenna, Electronics Letters, Aug. 3, 1995, vol. 31.
Hyneman , R. F. ; Mayes , P. E. ; Becker , R. C., Homing antennas for aircraft ( 450-2500 MC ), USAF Antenna Research and Development Program, 5th , 1955. Symposium on the, Oct. 16, 1955.
Ikata , O. ; Satoh , Y. ; Uchishiba , H. et al, Development of small antenna duplexer using saw filters for handheld phones, Ultrasonics Symposium, IEEE, Oct. 31, 1993.
Ingerson , P. G. ; Mayes , P. E., Asymmetrical feeders for log-periodic antennas, USAF Antenna Research and Development Program, 17th , 1967. Symposium on the, Nov. 14, 1967.
Isbell , D. E., Multiple terminal log-periodic antennas, USAF Antenna Research and Development Program, 8th , 1958. Symposium on the, Oct. 20, 1958.
Isbell , D. E., Non-planar logarithmically periodic antenna structures, USAF Antenna Research and Development Program, 7th , 1957. Symposium on the, Oct. 21, 1957.
Ishikawa , Y. ; Hattori , J. ; Andoh , M. et al., 800 MHz High Power Bandpass Filter Using TM Dual Mode Dielectric Resonators, Microwave Conference (EuMC), 21st , 1991. European, Sep. 9, 1991, vol. 2.
Iwasaki , H. ; Suzuki , Y., Electromagnetically coupled circular patch antenna consisting of multilayered configuration, Antennas and Propagation, IEEE Transactions on, Jun. 1, 1996.
Jaggard , D. L., Fractal electrodynamics and modeling, Directions in electromagnetic wave modeling, Jan. 1, 1991, p. 435-446.
Jaggard , D. L., Diffraction by Bandlimited Fractal Screens, Journal of the Optical Society of America, Jun. 1, 1987, vol. 4, No. 6.
James , J. R. ; Hall , P. S., Handbook of microstrip antennas, Peter Peregrinus Ltd., Jan. 1, 1989, vol. 1, p. 3-4 , 205-207.
Johnson , R. C., Antenna engineering handbook—Table of contents, McGraw-Hill, Jan. 1, 1993.
Jones , H. S., Conformal and Small antenna designs, Proceedings of the Antennas Applications Symposium, Aug. 1, 1981.
Katsibas , K. D. ; Balanis , C. A. ; Panayiotis , A. T. ; Birtcher , C. R., Folded loop antenna for mobile hand-held units, Antennas and Propagation, IEEE Transactions on, Feb. 1, 1998, vol. 46, No. 2.
Theiler , J., Estimating fractal dimension, Journal of the Optical Society of America (JOSA), Jun. 1, 1990, vol. 7, No. 6, p. 1055-1073.
Turner , E. M., Broadband passive electrically small antennas for TV application, Antenna Applications, 1977. Symposium, Apr. 27, 1977.
Turner , E. M. ; Richard , D. J., Development of an electrically small broadband antenna, USAF Antenna Research and Development Program, 18th , 1968. Symposium on the, Oct. 15, 1968.
Verdura, O., Miniature fractal antenna : Antena fractal miniatura, Universitat Politecnica de Catalunya (UPC), Sep. 1, 1997.
Viratelle , D. ; Langley , R. J., Dual band PIFA antenna, Microwaves, Antennas and Propagation, IEE Proceedings H, Jan. 3, 2000.
Virga , K. L., Low-profile enhanced-bandwidth PIFA antennas for wireless communications packaging, Microwave Theory and Techniques, IEEE Transactions on, Oct. 10, 1997, vol. 45.
Volgov , V. A., Parts and units of radio electronic equipment, Energiya, Jan. 1, 1967.
Walker , G. J. et al, Fractal volume antennas, Electronics Letters, Aug. 6, 1998.
Wall , H. ; Davies , H. W., Communications antennas for mercury space capsule, USAF Antenna Research and Development Program, 11th , 1961. Symposium on the, Oct. 16, 1961.
Watanabe , T. ; Furutani , K. ; Nakajima , N. et al, Antenna switch duplexer for dualband phone (GSM / DCS) using LTCC multilayer technology, Microwave Symposium Digest (MTT-S), 1999. IEEE International, Jun. 19, 1999.
Waterhouse , R. B., Printed antenna suitable for mobile communication handsets, Electronics Letters, Oct. 23, 1997.
Watson , T. ; Friesser , J., A phase shift direction finding technique, USAF Antenna Research and Development Program, 7th , 1957. Symposium on the, Oct. 21, 1957.
Weeks , W. L., Eletromagnetic theory for engineering applications, John Wiley & Sons, Jan. 1, 1964. p. 46-50.
Weeks , W. L., Antenna engineering, McGraw-Hill Book Company, Jan. 1, 1968, p. 167-180.
Wegner , D. E., B-70 antenna system, USAF Antenna Research and Development Program, 13th , 1963. Symposium on the, Oct. 14, 1963.
Werner , D. H., Frequency independent features of self-similar fractal antennas, Radio Science, Nov. 1, 1996.
Werner , D. H., Radiation characteristics of thin-wire ternary fractal trees, Electronics Letters, Apr. 15, 1999.
Werner , D. H., Fractal antenna engineering—The theory and design of fractal antenna arrays, Antennas and Propagation Magazine, IEEE, Oct. 1, 1999.
Werner , D. H. ; Werner , P. L. ; Ferrare , A. J., Frequency independent features of self-similar fractal antennas, Antennas and Propagation Society (APS), 1996. IEEE International Symposium, Jul. 21, 1996.
Werner , D. H. et al, On the synthesis of fractal radiation patterns, Radio Science, Feb. 1, 1995.
Werner , D. H. et al., Frontiers in electromagnetics—The theory and design of fractal antenna arrays, IEEE Press, Jan. 1, 1999, Chapter 3, p. 94-95.
West , B.H. et al., The Prentice-Hall Encyclopedia of Mathematics (1982), Prentice-Hall, Jan. 1, 1982, p. 404-405.
Wheeler , H. A., Fundamental limitations of small antennas, Proceedings of the IRE, Jan. 1, 1947.
Wheeler , H. A., Small antennas, USAF Antenna Research and Development Program, 23th , 1973. Symposium on the, Oct. 10, 1973.
Wheeler , H. A., The radiansphere around a small antenna, Proceedings of the IRE, Aug. 1, 1959.
Wikka , K., Letter to FCC that will authorize the appointment of Morton FLOM Eng and/or FLOMAssociates Inc to act as their Agent in all FCC matters, Nokia Mobile Phones, Aug. 5, 1999.
Williams , T. et al, Dual band meander antenna for wireless telephones, Microwave and Optical Technology Letters, Jan. 20, 2000.
Wong , K. L., Modified planar inverted F antenna, Electronics Letters, Jan. 8, 1998.
Wong , K. L., Broadband triangular microstrip antenna with U-shaped slot, Electronics Letters, Dec. 4, 1997, vol. 33, No. 25.
Wong , K. L., Single-feed small circularly polarised square microstrip antenna, Electronics Letters, Oct. 28, 1997, vol. 33, No. 22, p. 1833-1834.
Wong , K. L. ; Chiou , T. W., Single patch broadband circularly polarized microstrip antennas, Antennas and Propagation Society (APS), 2000. IEEE International Symposium, Jul. 16, 2000.

(56) References Cited

OTHER PUBLICATIONS

Wong , K. L. ; Sze , J. Y., Dual-frequency slotted rectangular microstrip antenna, Electronics Letters, Jul. 9, 1998.
Wong , K. L. ; Yang , K. P., Small dual-frequency microstrip antenna with cross slot, Electronics Letters, Nov. 6, 1997, vol. 33, No. 23.
Wu , C. K. et al., Slot-coupled Meandered Microstrip Antenna for Compact Dual-frequency Operation, Electronics Letters, May 28, 1998, vol. 34, No. 11.
Wu , D. I., Dual-Frequency Microstrip Reflectarray, Antennas and Propagation Society (APS), 1995. IEEE International Symposium, Jan. 1, 1995.
Yang , K. P., Compact dual-frequency operation of rectangular microstrip antennas, Antennas and Propagation Society (APS), 1999. IEEE International Symposium, Jul. 1, 1999.
Yang , X. ; Chiochetti , J. ; Papadopoulos , D. et al, Fractal antenna elements and arrays, Applied Microwave & Wireless, May 1, 1999.
Yang , X. H. ; Shafai , L., Multifrequency operation technique for aperture coupled microstrip antennas, Antennas and Propagation Society (APS), 1994. IEEE International Symposium, Jun. 20, 1994.
Zhang , D. ; Liang , G. C. ; Shih , C. F., Narrowband lumped element microstrip filters using capacitively loaded inductors, Microwave Symposium Digest (MTT-S), 1995. IEEE International, May 16, 1995, p. 379-382.
Zhong , S. S. ; Cui , J. H., Compact dual frequency microstrip antenna, Antennas and Propagation Society (APS), 2000. IEEE International Symposium, Jul. 16, 2000.
Zurcher , J. F., A compact dual-port dual-frequency SSFIP / PIFA antenna with high decoupling, Microwave and Optical Technology Letters, Sep. 20, 1999.
Claim construction and motion for summary judgement—Markman Hearing—[Defendants], Defendants, Sep. 2, 2010.
Claimant's notice to admit facts, Hogan Lovells International, Jan. 14, 2011.
Consent order, Court, Nov. 15, 2011.
Defence, Taylor Wessing, Nov. 10, 2010.
Defendants' invalidity contentions including appendix A and exhibits 1, 2, 3, 4, 5, 10, 11 referenced Multilevel Antenna patent, Defendants, Feb. 24, 2010.
Demonstratives presented by Dr. Steven Best during trial, Defendants, May 19, 2011.
Demonstratives presented by Dr. Stuart Long during trial, Fractus, May 18, 2011.
Document 0001—Complaint for patent infringement, Susman Godfrey, May 5, 2009.
Document 0014—Amended complaint for patent infringement, Fractus, May 6, 2009.
Na, Motorola 2000x pager, Motorola, Jun. 13, 1997.
Na, Motorola P935, Motorola, Aug. 13, 1997.
Na, Motorola Bravo Plus pager, Motorola, Mar. 3, 1995.
Na, Motorola Advisor Gold FLX pager, Motorola, Aug. 1, 1996.
Na, Motorola Advisor Elite mobile phone—Antenna photos—User manual, Motorola, Jan. 1, 1997.
Na, Hagenuk mobile phone—Antenna photo—Technical specs—User manual, Hagenuk Telecom GmbH, Jan. 1, 1996.
Na, Nokia 8260—FCC ID GMLNSW-4DX, Nokia, Apr. 1, 1999.
Na, Letter to FCC—Application form 731 and Engineering Test Report by Nokia Mobile Phones for FCC ID: LJPNSW-6NX, M. Flom Associates (MFA), Apr. 1, 1999.
Na, Nokia 8860—External photos—OET Exhibits list for FCC ID: LJPNSW-6NX, Federal Communications Commission (FCC), Jul. 8, 1999.
Na, Research in Motion receives FCC approval for the new Inter(at)ctive Pager 850, PR Newswire, Jul. 12, 1999.
Na, Software—Box counting dimension [electronic], Sewanee—http://www.sewanee.edu/Physics/PHYSICS123/BOX%20COUNTING%20DIMENSION.html, Apr. 1, 2002.
Na, Digital cellular telecommunications system (Phase2) : Abbreviations and acronyms (GSM01.04) GSM Technical Specification vs. 5.0.0, European Telecommunications Standard Institute (ETSI), Mar. 1, 1996.
Na, Digital cellular telecommunications system (Phase 2 plus) ; Radio transmission and reception (GSM 05.05), European Telecommunications Standard Institute (ETSI), Jul. 1, 1996.
Na, GSM Technical specification and related materials, European Telecommunications Standard Institute (ETSI), Mar. 1, 1996.
Na, Digital cellular telecommunications system (Phase2); Mobile Station (MS) conformance specification; Part 1: Conformance specification (GSM 11.10-1 version 421.1), European Telecommunications Standard Institute (ETSI), Aug. 1, 1998.
Na, FCC—United States table of frequency allocations, Federal Communications Commission (FCC), Oct. 1, 1999, p. 377-538.
Na, United States Table of Frequency allocations—The Radio Spectrum, United States Department of Commerce, Mar. 1, 1996.
Nadan , T. ; Coupez , J. P., Integration of an antenna filter device, using a multi-layer, multi-technology process, Microwave Conference (EuMC), 28th , 1988. European, Oct. 1, 1988, vol. 1.
Nagai , K. ; Mikuni , Y. ; Iwasaki , H., A mobile radio antenna system having a self-diplexing function, Vehicular Technology (VTC), 29th , 1979. IEEE Conference, Nov. 1, 1979, vol. 28.
Nagy , L. L, Antenna engineering handbook—Chapter 39—Automobile antennas, Volakis , J.—McGraw-Hill; 4th edition, Jan. 1, 2007, Chapter 39.
Naik , A. ; Bathnagar , P. S., Experimental study on stacked ring coupled triangular microstrip antenna, Antenna Applications, 1994. Symposium, Sep. 21, 1994.
Nakano , H. ; Vichien , K., Dual-frequency square patch antenna with rectangular notch, Electronics Letters, Aug. 3, 1989, vol. 25.
Navarro , M., Original and translation in English of Final Degree Project—Diverse modifications applied to the Sierpinski antenna, a multi-band fractal antenna, Universitat Politecnica de Catalunya (UPC), Oct. 1, 1997.
Navarro , M. ; Gonzalez , J. M. ; Puente , C. ; Romeu , J., Comprobacion del comportamiento autosimilar de la distribucion de corrientes sobre la superficie de la antena fractal de Sierpinski mediante termografias de infrarojos, Unión Cientifica Internacional de la Radio (URSI), 12th , Bilbao, 1997. Simposium Nacional de la, Sep. 1, 1998.
Navarro , M. ; Gonzalez , J. M. ; Puente , C. ; Romeu , J. ; Aguasca , A., Self-similar surface current distribution on fractal Sierpinski antenna verified infra-red thermographs, Antennas and Propagation Society (APS), 1999. IEEE International Symposium, Jul. 11, 1999.
Navarro , M. ; Puente , C. et al, Modificacion de la antenna de Sierpinski para el ajuste de las bandas operativas—Perturbation of the Sierpinski antenna to allocate operating bands, Unión Cientifica Internacional de la Radio (URSI), 12th , Bilbao, 1997. Simposium Nacional de la, Sep. 1, 1997.
Nelson , T. R. ; Jaggard , D. L., Fractals in the Imaging Sciences, Journal of the Optical Society of America, Jan. 1, 1999.
Ng, V., Diagnosis of melanoma with fractal dimensions, TENCON, 1993, IEEE Conference, Jan. 1, 1993.
Nishikawa, T., Ishikawa, Y., Hattori, J. and Wakino, K., Dielectric receiving filter with Sharp stopband using the active feedback resonator method for cellular base stations, Microwave Theory and Techniques, IEEE Transactions on, Dec. 1, 1989, vol. 37.
Nurnberger , M. W. ; Volakis , J. L., A new planar feed for slot spiral antennas, Antennas and Propagation, IEEE Transactions on, Jan. 1, 1996.
Ollikainen , J. et al., Thin dual resonant stacked shorted patch antenna for mobile communications, Electronics Letters, Mar. 18, 1999.
Omar, A. A. ; Antar , Y. M. M., A new broad band dual frequency coplanar waveguide fed slot antenna, Antennas and Propagation Society (APS), 1999. IEEE International Symposium, Jul. 11, 1999.
Ou , J. D., An analysis of annular, annular sector, and circular sector microstrip antennas, Antenna Applications, 1981. Symposium, Sep. 23, 1981.
Palit , S. K. ; Hamadi , A. ; Tan , D., Design of a wideband dual-frequency notched microstrip antenna, Antennas and Propagation Society (APS), 1998. IEEE International Symposium, Jun. 1, 1998.
Pan , S. C. ; Wong , K. L., Dual frequency triangular microstrip antenna with a shorting pin, Antennas and Propagation, IEEE Transactions on, Dec. 1, 1997.

(56) References Cited

OTHER PUBLICATIONS

Pan, S. et al., Single-feed dual-frequency microstrip antenna with two patches, Antennas and Propagation Society (APS), 1999. IEEE International Symposium, Aug. 1, 1999.
Papapolymerou , I. ; Franklin , R. ; K. ; Katehi , L. P. B., Micromachined patch antennas, Antennas and Propagation, IEEE Transactions on, Feb. 1, 1998, vol. 46, No. 2.
Parker , E. A. ; El Sheikh , A. N. A., Convoluted array elements and reduced size unit cells for frequency selective surfaces, Microwaves, Antennas and Propagation, IEE Proceedings H, Feb. 1, 1991, p. 19-22.
Parker , S., McGraw-Hill Dictionary of Scientific and Technical Terms (5th ed. 1994), McGraw-Hill, Jan. 1, 1994, p. 1542.
Parker, E. A. ; El Sheikh , A. N. A., Convoluted dipole array elements, Electronics Letters, Feb. 14, 1991.
Paschen , D. A., Broadband microstrip matching techniques, Antenna Applications, 1983. Symposium, Sep. 21, 1983.
Paschen , D. A., Structural stopband elimination with the monopole-slot antenna, Antenna Applications, 1982. Symposium, Sep. 22, 1982.
Paschen , D. A. ; Olson , S., A crossed-slot antenna with an infinite balun feed, Antenna Applications, 1995. Symposium, Sep. 20, 1995.
Peitgen , H. O. ; Jargens , H. ; Saupe , D., Chaos and fractals. New frontiers of science, Springer, Feb. 12, 1993 p. 212-216 ; 387-388.
Peitgen , H. O. ; Saupe , H., The science of fractal images, Springer, Jan. 1, 1988, pp. 1-3, 24-27, 58-61.
Peitgen , H. O. et al, Chaos and fractals : new frontiers of science, Springer, Jan. 1, 1992, pp. 22-26, 62-66, 94-105, 212-219, 229-243.
Penn , A., Fractal dimension of low-resolution medical images, Engineering in Medicine and Biology Society (EMBS), 18th ,1996. IEEE Annual International Conference of the, Jan. 1, 1996.
Phelan , R., A wide-band parallel-connected balun, Microwave Theory and Techniques, IEEE Transactions on, May 1, 1970.
Pozar , D. M., Microwave Engineering—Chapter 12: Introduction to Microwave Systems, Addison-Wesley, Jan. 1, 1990, p. 663-666 , 675-676.
Pozar , D. M. ; Newman , E. H., Analysis of a Monopole Mounted near or at the Edge of a Half-Plane, Antennas and Propagation, IEEE Transactions on, May 1, 1981, vol. AP-29, No. 3.
Document 0783—Order, Court, Apr. 1, 2011.
Document 0841—Stipulation of Dismissal of all Claims and Counterclaims re '850 and '822, Defendants, Apr. 15, 2011.
Document 0843—Joint Motion to Dismiss Claims and Counterclaims re '850 and '822, Defendants, Apr. 15, 2011.
Document 0854—Defendants' Motion to Clarify Claim Construction, Defendants, Apr. 18, 2011.
Document 0868—Order, Court, Apr. 19, 2011.
Document 0876—Fractus's surreply to defendants' Motion for Summary Judgment re publication dates of three references, Susman Godfrey, Apr. 20, 2011.
Document 0887—Fractus's Response to Defendants' Motion to Clarify Claim Construction, Susman Godfrey, Apr. 25, 2011.
Document 0889—Reply in support of defendants' motion to clarify claim construction, Defendants, Apr. 27, 2011.
Document 0893—Fractus SA's surreply to defendant's motion to clarify claim construction, Susman Godfrey, Apr. 29, 2011.
Document 0900—Order, Court, Apr. 29, 2011.
Document 0901—Report and recommendation of United States Magistrate Judge, Court, May 2, 2011.
Document 0902—Fractus SA's objections to defendants' prior art notice, Susman Godfrey, May 2, 2011.
Document 0915—Defendants' response to plaintiff's objections to defendants notice of prior art, Defendants, May 5, 2011.
Document 0933—Defendants' motion for reconsideration of, and objections to, the May 2, 2011 report and recommendation clarifying claim construction, Defendants, May 9, 2011.
Document 0939—Fractus's response to defendants' motion for reconsideration of and objections to the May 2, 2011, report and recommendations clarifying claim construction, Susman Godfrey, May 10, 2011.
Document 0968—Order, Court, May 13, 2011.
Document 0971—Order, Court, May 13, 2011.
Document 1082—Joint motion to dismiss HTC, Susman Godfrey LLP, Sep. 13, 2011.
Document 1083—Order—Final consent judgement HTC, Court, Sep. 15, 2011.
Document 1088—Samsung's motion to determine intervening rights in view of new Federal Circuit case law or, in the alternative, to stay the case pending the outcome of reexamination, Defendants, Oct. 19, 2011.
Document 1091—Fractus's response to Samsung's motion to determine intervening rights or to stay the case pending the outcome of reexamination, Susman Godfrey LLC, Nov. 2, 2011.
Document 1092—Samsung's reply in support of its motion to determine intervening rights in view of new Federal Circuit case law or, in the alternative, to stay the case pending the outcome of reexamination, Defendants, Nov. 14, 2011.
Document 1113—Memorandum opinion and order, Court, Jun. 28, 2012.
Document 1114—Final judgement, Court, Jun. 28, 2012.
Document 1143—Notice of appeal dated on Aug. 23, 2012, USPTO, Aug. 23, 2012.
Expert report of Dr. Warren L. Stutzman (redacted)—expert witness retained by Fractus, Fractus, Feb. 23, 2011.
Expert report of Dwight L. Jaggard (redacted)—expert witness retained by Fractus, Fractus, Feb. 23, 2011.
Expert report of Stuart Long (redacted)—expert witness retained by Fractus, Fractus, Feb. 23, 2011.
Fractus' Claim Construction Presentation—Markman Hearing, Fractus, Sep. 2, 2010.
Grounds of Invalidity, Hogan Lovells International LLP, Sep. 15, 2010.
Infringement Chart—HTC Dash, Fractus, Nov. 5, 2009.
Infringement Chart—HTC Dash. Patent: 7015868, Fractus, Nov. 5, 2009.
Infringement Chart—HTC Dash. Patent: 7123208, Fractus, Nov. 5, 2009.
Infringement Chart—HTC Dash. Patent: 7394432, Fractus, Nov. 5, 2009.
Infringement Chart—HTC Dash. Patent: 7397431, Fractus, Nov. 5, 2009.
Infringement Chart—HTC Dash. Patent: 7528782, Fractus, Nov. 5, 2009.
Infringement Chart—HTC Diamond, Fractus, Nov. 5, 2009.
Infringement Chart—HTC Diamond. Patent: 7015868, Fractus, Nov. 5, 2009.
Infringement Chart—HTC Diamond. Patent: 7123208, Fractus, Nov. 5, 2009.
Infringement Chart—HTC Diamond. Patent: 7397431, Fractus, Nov. 5, 2009.
Infringement Chart—HTC Diamond. Patent: 7528782, Fractus, Nov. 5, 2009.
Infringement Chart—HTC G1 Google., Fractus, Nov. 5, 2009.
Infringement Chart—HTC G1 Google. Patent: 7015868, Fractus, Nov. 5, 2009.
Infringement Chart—HTC G1 Google. Patent: 7123208, Fractus, Nov. 5, 2009.
Infringement Chart—HTC G1 Google. Patent: 7394432, Fractus, Nov. 5, 2009.
Infringement Chart—HTC G1 Google. Patent: 7397431, Fractus, Nov. 5, 2009.
Infringement Chart—HTC G1 Google. Patent: 7528782, Fractus, Nov. 5, 2009.
Infringement Chart—HTC My Touch., Fractus, Nov. 5, 2009.
Infringement Chart—HTC My Touch. Patent: 7015868, Fractus, Nov. 5, 2009.
Infringement Chart—HTC My Touch. Patent: 7123208, Fractus, Nov. 5, 2009.
Infringement Chart—Kyocera Jax. Patent: 7015868, Fractus, Nov. 5, 2009.
Infringement Chart—Kyocera Jax. Patent: 7123208, Fractus, Nov. 5, 2009.

(56) References Cited

OTHER PUBLICATIONS

Infringement Chart—Kyocera Jax. Patent: 7394432, Fractus, Nov. 5, 2009.
Infringement Chart—Kyocera Jax. Patent: 7397431, Fractus, Nov. 5, 2009.
Infringement Chart—Kyocera Jax. Patent: 7528782, Fractus, Nov. 5, 2009.
Infringement Chart—Kyocera MARBL, Fractus, Nov. 5, 2009.
Infringement Chart—Kyocera MARBL. Patent: 7015868, Fractus, Nov. 5, 2009.
Infringement Chart—Kyocera MARBL. Patent: 7123208, Fractus, Nov. 5, 2009.
Infringement Chart—Kyocera MARBL. Patent: 7397431, Fractus, Nov. 5, 2009.
Infringement Chart—Kyocera MARBL. Patent: 7528782, Fractus, Nov. 5, 2009.
Infringement Chart—Kyocera NEO E1100, Fractus, Nov. 5, 2009.
Infringement Chart—Kyocera NEO E1100. Patent: 7015868, Fractus, Nov. 5, 2009.
Infringement Chart—Kyocera NEO E1100. Patent: 7123208, Fractus, Nov. 5, 2009.
Infringement Chart—Kyocera NEO E1100. Patent: 7394432, Fractus, Nov. 5, 2009.
Infringement Chart—Kyocera NEO E1100. Patent: 7397431, Fractus, Nov. 5, 2009.
Infringement Chart—Kyocera NEO E1100. Patent: 7528782, Fractus, Nov. 5, 2009.
Infringement Chart—Kyocera S2400, Fractus, Nov. 5, 2009.
Infringement Chart—Kyocera S2400. Patent: 7015868, Fractus, Nov. 5, 2009.
Infringement Chart—Kyocera S2400. Patent: 7123208, Fractus, Nov. 5, 2009.
Infringement Chart—Kyocera S2400. Patent: 7394432, Fractus, Nov. 5, 2009.
Infringement Chart—Kyocera S2400. Patent: 7397431, Fractus, Nov. 5, 2009.
Infringement Chart—Kyocera S2400. Patent: 7528782, Fractus, Nov. 5, 2009.
Infringement Chart—Kyocera Wildcard M1000, Fractus, Nov. 5, 2009.
Infringement Chart—Kyocera Wildcard M1000. Patent: 7015868, Fractus, Nov. 5, 2009.
Infringement Chart—Kyocera Wildcard M1000. Patent: 7123208, Fractus, Nov. 5, 2009.
Infringement Chart—Kyocera Wildcard M1000. Patent: 7397431, Fractus, Nov. 5, 2009.
Infringement Chart—Kyocera Wildcard M1000. Patent: 7528782, Fractus, Nov. 5, 2009.
Infringement Chart—LG 300G., Fractus, Nov. 5, 2009.
Infringement Chart—LG 300G. Patent: 7015868, Fractus, Nov. 5, 2009.
Infringement Chart—LG 300G. Patent: 7123208, Fractus, Nov. 5, 2009.
Infringement Chart—LG 300G. Patent: 7397431, Fractus, Nov. 5, 2009.
Infringement Chart—LG 300G. Patent: 7528782, Fractus, Nov. 5, 2009.
Infringement Chart—LG Aloha LX140., Fractus, Nov. 5, 2009.
Infringement Chart—LG Aloha LX140. Patent: 7015868, Fractus, Nov. 5, 2009.
Infringement Chart—LG Aloha LX140. Patent: 7123208, Fractus, Nov. 5, 2009.
Infringement Chart—LG Aloha LX140. Patent: 7397431, Fractus, Nov. 5, 2009.
Infringement Chart—LG Aloha LX140. Patent: 7528782, Fractus, Nov. 5, 2009.
Infringement Chart—LG AX155., Fractus, Nov. 5, 2009.
Infringement Chart—LG AX155. Patent: 7015868, Fractus, Nov. 5, 2009.
Infringement Chart—LG AX155. Patent: 7123208, Fractus, Nov. 5, 2009.
Infringement Chart—LG AX155. Patent: 7397431, Fractus, Nov. 5, 2009.
Infringement Chart—LG AX155. Patent: 7528782, Fractus, Nov. 5, 2009.
Infringement Chart—LG AX300, Fractus, Nov. 5, 2009.
Infringement Chart—LG AX300. Patent: 7015868, Fractus, Nov. 5, 2009.
Infringement Chart—LG AX300. Patent: 7123208, Fractus, Nov. 5, 2009.
Infringement Chart—LG AX300. Patent: 7397431, Fractus, Nov. 5, 2009.
Infringement Chart—LG AX300. Patent: 7528782, Fractus, Nov. 5, 2009.
Infringement Chart—LG AX380, Fractus, Nov. 5, 2009.
Infringement Chart—LG AX380. Patent: 7015868, Fractus, Nov. 5, 2009.
Infringement Chart—LG AX380. Patent: 7123208, Fractus, Nov. 5, 2009.
Infringement Chart—LG EnV2 VX9100. Patent: 7528782, Fractus, Nov. 5, 2009.
Infringement Chart—LG EnV2. Patent: 7015868, Fractus, Nov. 5, 2009.
Infringement Chart—LG EnV3 VX9200., Fractus, Nov. 5, 2009.
Infringement Chart—LG ENV3 VX9200. Patent: 7015868, Fractus, Nov. 5, 2009.
Infringement Chart—LG EnV3 VX9200. Patent: 7123208, Fractus, Nov. 5, 2009.
Infringement Chart—LG EnV3 VX9200. Patent: 7394432, Fractus, Nov. 5, 2009.
Infringement Chart—LG EnV3 VX9200. Patent: 7397431, Fractus, Nov. 5, 2009.
Infringement Chart—LG EnV3 VX9200. Patent: 7528782, Fractus, Nov. 5, 2009.
Infringement Chart—LG Flare LX165, Fractus, Nov. 5, 2009.
Infringement Chart—LG Flare LX165. Patent: 7015868, Fractus, Nov. 5, 2009.
Infringement Chart—LG Flare LX165. Patent: 7123208, Fractus, Nov. 5, 2009.
Infringement Chart—LG Flare LX165. Patent: 7397431, Fractus, Nov. 5, 2009.
Infringement Chart—LG Flare LX165. Patent: 7528782, Fractus, Nov. 5, 2009.
Infringement Chart—LG GT365 NEON., Fractus, Nov. 5, 2009.
Infringement Chart—LG GT365 NEON. Patent: 7015868, Fractus, Nov. 5, 2009.
Infringement Chart—LG GT365 NEON. Patent: 7123208, Fractus, Nov. 5, 2009.
Infringement Chart—LG GT365 NEON. Patent: 7394432, Fractus, Nov. 5, 2009.
Infringement Chart—LG GT365 NEON. Patent: 7397431, Fractus, Nov. 5, 2009.
Infringement Chart—LG GT365 NEON. Patent: 7528782, Fractus, Nov. 5, 2009.
Infringement Chart—LG Lotus, Fractus, Nov. 5, 2009.
Infringement Chart—LG Lotus. Patent: 7015868, Fractus, Nov. 5, 2009.
Infringement Chart—LG Lotus. Patent: 7123208, Fractus, Nov. 5, 2009.
Infringement Chart—LG Lotus. Patent: 7397431, Fractus, Nov. 5, 2009.
Infringement Chart—LG Lotus. Patent: 7528782, Fractus, Nov. 5, 2009.
Infringement Chart—LG MUZIQ LX570, Fractus, Nov. 5, 2009.
Infringement Chart—LG MUZIQ LX570. Patent: 7015868, Fractus, Nov. 5, 2009.
Infringement Chart—LG MUZIQ LX570. Patent: 7123208, Fractus, Nov. 5, 2009.
Infringement Chart—MUZIQ LX570. Patent: 7394432, Fractus, Nov. 5, 2009.
Infringement Chart—LG MUZIQ LX570. Patent: 7397431, Fractus, Nov. 5, 2009.

(56) References Cited

OTHER PUBLICATIONS

Infringement Chart—LG MUZIQ LX570. Patent: 7528782, Fractus, Nov. 5, 2009.
Infringement Chart—LG Rumor, Fractus, Nov. 5, 2009.
Infringement Chart—LG Rumor 2., Fractus, Nov. 5, 2009.
Infringement Chart—LG Rumor 2. Patent: 7015868, Fractus, Nov. 5, 2009.
Infringement Chart—LG Rumor 2. Patent: 7123208, Fractus, Nov. 5, 2009.
Infringement Chart—LG Rumor 2. Patent: 7394432, Fractus, Nov. 5, 2009.
Infringement Chart—LG Rumor 2. Patent: 7397431, Fractus, Nov. 5, 2009.
Infringement Chart—LG Rumor 2. Patent: 7528782, Fractus, Nov. 5, 2009.
Infringement Chart—LG Rumor. Patent: 7015868, Fractus, Nov. 5, 2009.
Infringement Chart—LG Rumor. Patent: 7123208, Fractus, Nov. 5, 2009.
Infringement Chart—LG Rumor. Patent: 7397431, Fractus, Nov. 5, 2009.
Infringement Chart—LG Rumor. Patent: 7528782, Fractus, Nov. 5, 2009.
Infringement Chart—LG Shine CU720, Fractus, Nov. 5, 2009.
Infringement Chart—LG Shine CU720. Patent: 7015868, Fractus, Nov. 5, 2009.
Infringement Chart—LG Shine CU720. Patent: 7123208, Fractus, Nov. 5, 2009.
Infringement Chart—LG Shine CU720. Patent: 7394432, Fractus, Nov. 5, 2009.
Infringement Chart—LG Shine CU720. Patent: 7397431, Fractus, Nov. 5, 2009.
Infringement Chart—LG Shine CU720. Patent: 7528782, Fractus, Nov. 5, 2009.
Infringement Chart—LG UX280, Fractus, Nov. 5, 2009.
Infringement Chart—LG UX280. Patent: 7015868, Fractus, Nov. 5, 2009.
Infringement Chart—LG UX280. Patent: 7123208, Fractus, Nov. 5, 2009.
Infringement Chart—LG UX280. Patent: 7394432, Fractus, Nov. 5, 2009.
Infringement Chart—LG UX280. Patent: 7397431, Fractus, Nov. 5, 2009.
Infringement Chart—LG UX280. Patent: 7528782, Fractus, Nov. 5, 2009.
Infringement Chart—LG Versa VX9600, Fractus, Nov. 5, 2009.
Infringement Chart—LG Versa VX9600. Patent: 7015868, Fractus, Nov. 5, 2009.
Infringement Chart—LG Versa VX9600. Patent: 7123208, Fractus, Nov. 5, 2009.
Infringement Chart—LG Versa VX9600. Patent: 7397431, Fractus, Nov. 5, 2009.
Infringement Chart—LG Versa VX9600. Patent: 7528782, Fractus, Nov. 5, 2009.
Infringement Chart—LG Voyager VX10000, Fractus, Nov. 5, 2009.
Infringement Chart—LG Voyager VX10000. Patent: 7015868, Fractus, Nov. 5, 2009.
Infringement Chart—LG Voyager VX10000. Patent: 7123208, Fractus, Nov. 5, 2009.
Infringement Chart—LG Voyager VX10000. Patent: 7397431, Fractus, Nov. 5, 2009.
Infringement Chart—LG Voyager VX10000. Patent: 7528782, Fractus, Nov. 5, 2009.
Infringement Chart—LG VU CU920, Fractus, Nov. 5, 2009.
Infringement Chart—LG Vu CU920. Patent: 7015868, Fractus, Nov. 5, 2009.
Infringement Chart—LG Vu CU920. Patent: 7123208, Fractus, Nov. 5, 2009.
Infringement Chart—LG VU CU920. Patent: 7394432, Fractus, Nov. 5, 2009.
Infringement Chart—LG VU CU920. Patent: 7397431, Fractus, Nov. 5, 2009.
Infringement Chart—LG Vu CU920. Patent: 7528782, Fractus, Nov. 5, 2009.
Infringement Chart—LG VX5400, Fractus, Nov. 5, 2009.
Infringement Chart—LG VX5400. Patent: 7015868, Fractus, Nov. 5, 2009.
Infringement Chart—LG VX5400. Patent 7123208, Fractus, Nov. 5, 2009.
Infringement Chart—LG VX5400. Patent: 7397431, Fractus, Nov. 5, 2009.
Infringement Chart—LG VX5400. Patent: 7528782, Fractus, Nov. 5, 2009.
Infringement Chart—LG VX5500, Fractus, Nov. 5, 2009.
Infringement Chart—LG VX5500. Patent: 7015868, Fractus, Nov. 5, 2009.
Infringement Chart—LG VX5500. Patent: 7123208, Fractus, Nov. 5, 2009.
Infringement Chart—LG VX5500. Patent: 7397431, Fractus, Nov. 5, 2009.
Infringement Chart—LG VX5500. Patent: 7528782, Fractus, Nov. 5, 2009.
Infringement Chart—LG VX8350, Fractus, Nov. 5, 2009.
Infringement Chart—LG VX8350. Patent: 7015868, Fractus, Nov. 5, 2009.
Infringement Chart—LG VX8350. Patent: 7123208, Fractus, Nov. 5, 2009.
Infringement Chart—LG VX8350. Patent: 7397431, Fractus, Nov. 5, 2009.
Infringement Chart—LG VX8350. Patent: 7528782, Fractus, Nov. 5, 2009.
Infringement Chart—LG VX8360., Fractus, Nov. 5, 2009.
Infringement Chart—LG VX8360. Patent: 7015868, Fractus, Nov. 5, 2009.
Infringement Chart—LG VX8360. Patent: 7123208, Fractus, Nov. 5, 2009.
Infringement Chart—LG VX8360. Patent: 7394432, Fractus, Nov. 5, 2009.
Infringement Chart—LG VX8360. Patent: 7397431, Fractus, Nov. 5, 2009.
Infringement Chart—LG VX8360. Patent: 7528782, Fractus, Nov. 5, 2009.
Infringement Chart—LG VX8500, Fractus, Nov. 5, 2009.
Infringement Chart—LG VX8500. Patent: 7015868, Fractus, Nov. 5, 2009.
Infringement Chart—LG VX8500. Patent: 7123208, Fractus, Nov. 5, 2009.
Infringement Chart—LG VX8500. Patent: 7397431, Fractus, Nov. 5, 2009.
Infringement Chart—LG VX8500. Patent: 7528782, Fractus, Nov. 5, 2009.
Infringement Chart—LG VX8560 Chocolate 3, Fractus, Nov. 5, 2009.
Infringement Chart—LG VX8560 Chocolate 3. Patent: 7015868, Fractus, Nov. 5, 2009.
Infringement Chart—LG VX8560 Chocolate 3. Patent: 7123208, Fractus, Nov. 5, 2009.
Infringement Chart—LG VX8560 Chocolate 3. Patent: 7394432, Fractus, Nov. 5, 2009.
Infringement Chart—LG VX8560 Chocolate 3. Patent: 7397431, Fractus, Nov. 5, 2009.
Infringement Chart—Pantech C740. Patent: 7123208, Fractus, Nov. 5, 2009.
Infringement Chart—Pantech C740. Patent: 7394432, Fractus, Nov. 5, 2009.
Infringement Chart—Pantech C740. Patent: 7397431, Fractus, Nov. 5, 2009.
Infringement Chart—Pantech C740. Patent: 7528782, Fractus, Nov. 5, 2009.
Infringement Chart—Pantech DUO C810., Fractus, Nov. 5, 2009.
Infringement Chart—Pantech DUO C810. Patent: 7015868, Fractus, Nov. 5, 2009.

(56) References Cited

OTHER PUBLICATIONS

Infringement Chart—Pantech DUO C810. Patent: 7123208, Fractus, Nov. 5, 2009.
Infringement Chart—Pantech DUO C810. Patent: 7394432, Fractus, Nov. 5, 2009.
Infringement Chart—Pantech DUO C810. Patent: 7397431, Fractus, Nov. 5, 2009.
Infringement Chart—Pantech DUO C810. Patent: 7528782, Fractus, Nov. 5, 2009.
Infringement Chart—Pantech Slate C530, Fractus, Nov. 5, 2009.
Infringement Chart—Pantech Slate C530. Patent: 7015868, Fractus, Nov. 5, 2009.
Infringement Chart—Pantech Slate C530. Patent: 7123208, Fractus, Nov. 5, 2009.
Infringement Chart—Pantech Slate C530. Patent: 7394432, Fractus, Nov. 5, 2009.
Infringement Chart—Pantech Slate C530. Patent: 7397431, Fractus, Nov. 5, 2009.
Infringement Chart—Pantech Slate C530. Patent: 7528782, Fractus, Nov. 5, 2009.
Infringement Chart—Phone: LG Dare VX9700, Fractus, Nov. 5, 2009.
Infringement Chart—RIM Blackberry 8100. Patent: 7015868, Fractus, Nov. 5, 2009.
Infringement Chart—RIM Blackberry 8100. Patent: 7123208, Fractus, Nov. 5, 2009.
Infringement Chart—RIM Blackberry 8100. Patent: 7394432, Fractus, Nov. 5, 2009.
Infringement Chart—RIM Blackberry 8100. Patent: 7397431, Fractus, Nov. 5, 2009.
Infringement Chart—RIM Blackberry 8100. Patent: 7528782, Fractus, Nov. 5, 2009.
Infringement Chart—RIM Blackberry 8110, Fractus, Nov. 5, 2009.
Infringement Chart—RIM Blackberry 8110. Patent: 7015868, Fractus, Nov. 5, 2009.
Infringement Chart—RIM Blackberry 8110. Patent: 7123208, Fractus, Nov. 5, 2009.
Infringement Chart—RIM Blackberry 8110. Patent: 7394432, Fractus, Nov. 5, 2009.
Infringement Chart—RIM Blackberry 8110. Patent: 7397431, Fractus, Nov. 5, 2009.
Infringement Chart—RIM Blackberry 8110. Patent: 7528782, Fractus, Nov. 5, 2009.
Infringement Chart—RIM Blackberry 8120, Fractus, Nov. 5, 2009.
Infringement Chart—RIM Blackberry 8120. Patent: 7015868, Fractus, Nov. 5, 2009.
Infringement Chart—RIM Blackberry 8120. Patent: 7123208, Fractus, Nov. 5, 2009.
Infringement Chart—RIM Blackberry 8120. Patent: 7394432, Fractus, Nov. 5, 2009.
Infringement Chart—RIM Blackberry 8120. Patent: 7397431, Fractus, Nov. 5, 2009.
Infringement Chart—RIM Blackberry 8120. Patent: 7528782, Fractus, Nov. 5, 2009.
Infringement Chart—RIM Blackberry 8130, Fractus, Nov. 5, 2009.
Infringement Chart—RIM Blackberry 8130. Patent: 7015868, Fractus, Nov. 5, 2009.
Infringement Chart—RIM Blackberry 8130. Patent: 7123208, Fractus, Nov. 5, 2009.
Infringement Chart—RIM Blackberry 8130. Patent: 7528782, Fractus, Nov. 5, 2009.
Infringement Chart—RIM Blackberry 8220, Fractus, Nov. 5, 2009.
Infringement Chart—RIM Blackberry 8220. Patent: 7015868, Fractus, Nov. 5, 2009.
Infringement Chart—RIM Blackberry 8220. Patent: 7123208, Fractus, Nov. 5, 2009.
Infringement Chart—RIM Blackberry 8220. Patent: 7394432, Fractus, Nov. 5, 2009.
Infringement Chart—RIM Blackberry 8220. Patent: 7397431, Fractus, Nov. 5, 2009.
Infringement Chart—RIM Blackberry 8220. Patent: 7528782, Fractus, Nov. 5, 2009.
Infringement Chart—RIM Blackberry 8310, Fractus, Nov. 5, 2009.
Infringement Chart—RIM Blackberry 8310. Patent: 7015868, Fractus, Nov. 5, 2009.
Infringement Chart—RIM Blackberry 8310. Patent: 7123208, Fractus, Nov. 5, 2009.
Infringement Chart—RIM Blackberry 8310. Patent: 7394432, Fractus, Nov. 5, 2009.
Infringement Chart—RIM Blackberry 8310. Patent: 7397431, Fractus, Nov. 5, 2009.
Infringement Chart—RIM Blackberry 8310. Patent: 7528782, Fractus, Nov. 5, 2009.
Infringement Chart—RIM Blackberry 8320, Fractus, Nov. 5, 2009.
Infringement Chart—RIM Blackberry 8320. Patent: 7015868, Fractus, Nov. 5, 2009.
Infringement Chart—RIM Blackberry 8320. Patent: 7123208, Fractus, Nov. 5, 2009.
Infringement Chart—RIM Blackberry 8320. Patent: 7394432, Fractus, Nov. 5, 2009.
Infringement Chart—RIM Blackberry 8320. Patent: 7397431, Fractus, Nov. 5, 2009.
Infringement Chart—RIM Blackberry 8320. Patent: 7528782, Fractus, Nov. 5, 2009.
Infringement Chart—RIM Blackberry 8330, Fractus, Nov. 5, 2009.
Infringement Chart—RIM Blackberry 8330. Patent: 7015868, Fractus, Nov. 5, 2009.
Infringement Chart—RIM Blackberry 8330. Patent: 7123208, Fractus, Nov. 5, 2009.
Infringement Chart—RIM Blackberry 8330. Patent: 7397431, Fractus, Nov. 5, 2009.
Infringement Chart—RIM Blackberry 8330. Patent: 7528782, Fractus, Nov. 5, 2009.
Infringement Chart—RIM Blackberry 8820, Fractus, Nov. 5, 2009.
Infringement Chart—RIM Blackberry 8820. Patent: 7015868, Fractus, Nov. 5, 2009.
Infringement Chart—RIM Blackberry 8820. Patent: 7123208, Fractus, Nov. 5, 2009.
Infringement Chart—RIM Blackberry 8820. Patent: 7394432, Fractus, Nov. 5, 2009.
Infringement Chart—RIM Blackberry 8820. Patent: 7397431, Fractus, Nov. 5, 2009.
Infringement Chart—RIM Blackberry 8820. Patent: 7528782, Fractus, Nov. 5, 2009.
Infringement Chart—RIM Blackberry 8830, Fractus, Nov. 5, 2009.
Infringement Chart—RIM Blackberry 8830. Patent: 7015868, Fractus, Nov. 5, 2009.
Infringement Chart—RIM Blackberry 8830. Patent: 7123208, Fractus, Nov. 5, 2009.
Infringement Chart—RIM Blackberry 8830. Patent: 7394432, Fractus, Nov. 5, 2009.
Infringement Chart—RIM Blackberry 8830. Patent: 7397431, Fractus, Nov. 5, 2009.
Infringement Chart—RIM Blackberry 8830. Patent: 7528782, Fractus, Nov. 5, 2009.
Infringement Chart—RIM Blackberry 8900, Fractus, Nov. 5, 2009.
Infringement Chart—RIM Blackberry 8900. Patent: 7015868, Fractus, Nov. 5, 2009.
Infringement Chart—RIM Blackberry 8900. Patent: 7123208, Fractus, Nov. 5, 2009.
Infringement Chart—RIM Blackberry 8900. Patent: 7394432, Fractus, Nov. 5, 2009.
Infringement Chart—RIM Blackberry 8900. Patent: 7397431, Fractus, Nov. 5, 2009.
Infringement Chart—RIM Blackberry 8900. Patent: 7528782, Fractus, Nov. 5, 2009.
Infringement Chart—RIM Blackberry 9630, Fractus, Nov. 5, 2009.
Infringement Chart—RIM Blackberry 9630. Patent: 7015868, Fractus, Nov. 5, 2009.
Infringement Chart—RIM Blackberry 9630. Patent: 7123208, Fractus, Nov. 5, 2009.
Infringement Chart—RIM Blackberry 9630. Patent: 7394432, Fractus, Nov. 5, 2009.

(56) References Cited

OTHER PUBLICATIONS

Infringement Chart—RIM Blackberry 9630. Patent: 7397431, Fractus, Nov. 5, 2009.
Infringement Chart—RIM Blackberry Bold 9000., Fractus, Nov. 5, 2009.
Infringement Chart—RIM Blackberry Bold 9000. Patent: 7015868, Fractus, Nov. 5, 2009.
Infringement Chart—RIM Blackberry Bold 9000. Patent: 7123208, Fractus, Nov. 5, 2009.
Infringement Chart—RIM Blackberry Bold 9000. Patent: 7394432, Fractus, Nov. 5, 2009.
Infringement Chart—RIM Blackberry Bold 9000. Patent: 7397431, Fractus, Nov. 5, 2009.
Infringement Chart—RIM Blackberry Bold 9000. Patent: 7528782, Fractus, Nov. 5, 2009.
Infringement Chart—RIM Blackberry Pearl 8100, Fractus, Nov. 5, 2009.
Infringement Chart—RIM Blackberry Storm 9530., Fractus, Nov. 5, 2009.
Infringement Chart—RIM Blackberry Storm 9530. Patent: 7015868, Fractus, Nov. 5, 2009.
Infringement Chart—RIM Blackberry Storm 9530. Patent: 7123208, Fractus, Nov. 5, 2009.
Infringement Chart—RIM Blackberry Storm 9530. Patent: 7394432, Fractus, Nov. 5, 2009.
Infringement Chart—RIM Blackberry Storm 9530. Patent: 7397431, Fractus, Nov. 5, 2009.
Infringement Chart—RIM Blackberry Storm 9530. Patent: 7528782, Fractus, Nov. 5, 2009.
Infringement Chart—RIM Blackberry Tour 9630. Patent: 7528782, Fractus, Nov. 5, 2009.
Infringement Chart—Samsung Blackjack II SGH-i617., Fractus, Nov. 5, 2009.
Infringement Chart—Samsung Blackjack II SGH-i617. Patent: 7015868, Fractus, Nov. 5, 2009.
Sanchez Hernandez , D. et al, Triple band microstrip patch antenna using a spur-line filter and a perturbation segment technique, Electronics Letters, Aug. 19, 1993, vol. 29.
Sandlin , B. ; Terzouli , A. J., A genetic antenna desig for improved radiation over earth, Antenna Applications, 1997. Symposium, Sep. 17, 1997.
Sarkar , N., An efficient differential box-counting approach to compute fractal dimension of image, Systems, Man and Cybernetics, 1994. IEEE International Conference on, Jan. 3, 1994, vol. 24, No. 1.
Saunders , S. R., Antennas and Propagation for Wireless Communication Systems—Chapter 4, John Wiley & Sons, Jan. 1, 1999.
Sawaya , K. ; Ishizone , T. ; Mushiake , Y., A simplified Expression of Dyadic Green's Function for a Conduction Half Sheet vol. AP-29, No. 5 (Sep. 1981), Antennas and Propagation, IEEE Transactions on, Sep. 1, 1981, vol. AP-29, No. 5.
Scharfman , W., Telemetry antennas for high altitude missiles, USAF Antenna Research and Development Program, 8th , 1958. Symposium on the, Oct. 20, 1958.
Schaubert , D. H. ; Chang , W. C. ; Wunsch , G. J., Measurement of phased array performance at arbitrary scan angles, Antenna Applications, 1994. Symposium, Sep. 21, 1994.
Sclater , N. ; Markus , J., McGraw-Hill Electronics Dictionary, McGraw Hill, Jan. 1, 1997, p. 21, 35, 183, 263, 298, 300.
Seavey , J., C-band paste-on and floating ring reflector antennas, USAF Antenna Research and Development Program, 23th , 1973. Symposium on the, Oct. 10, 1973.
Serrano-Vaello , A. et al, Printed antennas for dual-band GSM/DCS 1800 mobile handsets, Electronics Letters, Jan. 22, 1998.
Shen , Z. ; Sze , Chen , T. ; Law , C. L., A circularly polarized microstrip-fed T-slot antenna, Antennas and Propagation Society (APS), 2000. IEEE International Symposium, Jul. 16, 2000.
Shenoy , A. et al., Notebook satcom terminal technology development, Digital Satellite Communications, 10th , 1995. International Conference on, May 15, 1995.
Shibagaki , N., Saw antenna duplexer module using saw-resonator-coupled filter for PCN system, Ultrasonics Symposium, IEEE, Oct. 5, 1998, vol. 1.
Shibagaki , N. ; Sakiyama , K. ; Nikita , M., Miniature saw antenna duplexer module for 1.9GHz PCN systems using saw-resonator-coupled filters, Ultrasonics Symposium, IEEE, Oct. 5, 1998, vol. 1.
Shimoda , R. Y., A variable impedance ratio printed circuit balun, Antenna Applications, 1979. Symposium, Sep. 26, 1979.
Shnitkin , H., Analysis of log-periodic folded dipole array, Antenna Applications, 1992. Symposium, Sep. 10, 1992.
Sinclair, G., Theory of models of electromagnetic systems, Proceedings of the IRE, Nov. 1, 1948.
Sindou , M. et al, Multiband and wideband properties of printed fractal branched antennas, Electronics Letters, Feb. 4, 1999.
Snow , W. L., UHF crossed-slot antenna and applications, USAF Antenna Research and Development Program, 13th , 1963. Symposium on the, Sep. 1, 1963.
Snow , W. L., Ku-band planar spiral antenna, USAF Antenna Research and Development Program, 19th , 1969. Symposium on the, Oct. 14, 1969.
So , P. et al, Box-counting dimension without boxes—Computing D0 from average expansion rates, Physical Review, Jul. 1, 1999, vol. 60, No. 1.
Soler , J. ; Garcia , D. ; Puente , C. ; Anguera , J., Novel combined mod-p multiband antenna structures inspired by fractal geometries, Microwave and Optical Technology Letters, Jun. 5, 2004, vol. 41, No. 5.
Soler , J. ; Puente , C., Analysis of the Sierpinski fractal multiband antenna using the multiperiodic traveling wave v model, Antenna Workshop on Innovative Periodic Antennas (ESA), 24th , 2001. European Space Agency, Jun. 1, 2001, p. 53-57.
Soler , J. ; Puente , C. ; Anguera , J., Results on a new extended analytic model to understand the radiation performance of mod-p Sierpinski fractal multiband antennas, Antennas and Propagation Society (APS), 2003. IEEE International Symposium, Jun. 22, 2003.
Soler , J. ; Puente , C. ; Anguera , J., Solutions to tailor the radiation patterns of 2D and 3D multiband antennas based on the Sierpinski fractal, Antennas and Propagation Society (APS), 2003. IEEE International Symposium, Jun. 22, 2003.
Soler , J. ; Puente , C. ; Munduate , A., Novel broadband and multiband solutions for planar monople antenas, Antennas and Propagation Society (APS), 2002. IEEE International Symposium, Jun. 16, 2002.
Soler , J. ; Romeu , J., Antenas de Sierpinski de modulo-p, Unión Cientifica Internacional de la Radio (URSI), 15th , Zaragoza, 2000. Simposium Nacional de la, Sep. 1, 2000.
Soler , J. ; Romeu , J. ; Puente , C., Mod-P Sierpinski fractal multiband antenna, Antennas and Propagarion (AP2000), Davos, 2000. Millenium Conference on, Apr. 9, 2000.
Soler Castany , J., Multi-band antennas for wireless communication systems : Antenes multibanda per sistemes de comunicaions inalámbriques, Universitat Politecnica de Catalunya (UPC), Sep. 1, 1999.
Song , C. T. P. et al, Triple band planar inverted F antennas for handheld devices, Electronics Letters, Jan. 20, 2000.
Song , C. T. P. et al, Sierpinski monopole antenna with controlled band spacing and input impedance, Electronics Letters, Jun. 24, 1999.
Song, C. T. P., Fractal stacked monopole with very wide bandwidth, Electronics Letters, Jun. 1, 1999, vol. 35, p. 945-946.
Song, C. T. P., Triple-band planar inverted F antenna, Antennas and Propagation Society (APS), 1999. IEEE International Symposium, Jul. 11, 1999.
Srivastava , G. P. et al, Dual band tunable microstrip patch antenna, Electronics Letters, Aug. 19, 1999.
Stang , P. F., Balanced flush mounted log-periodic antenna for aerospace vehicles—in Abstracts of the Twelfth Annual Symposium USAF antenna research, USAF Antenna Research and Development Program, 12th , 1962. Symposium on the, Oct. 16, 1962, vol. 1.
Strugatsky , A. et al, Multimode multiband antenna, Tactical Communications: Technology in Transition, 1992. Conference of, Apr. 28, 1992.

(56) References Cited

OTHER PUBLICATIONS

Stutzman , W. L. ; Thiele , G., Antenna theory and design, John Wiley and Sons, Jan. 1, 1981 pp. 18, 36.
Stutzman , W. L. ; Thiele , G. A., Antenna theory and design, John Wiley and Sons, Jan. 1, 1998, p. 8-9 , 43-48 , 210-219.
Stutzman , W. L. ; Thiele , G. A., Antenna theory and design—Chapter 5—Resonant Antennas: Wires and Patches, Wiley, Jan. 1, 1998, Chapter 5, p. 210.
Sze , J. Y. ; Wong , K. L., Designs of broadband microstrip antennas with embedded slots, Antennas and Propagation Society (APS), 1999. IEEE International Symposium, Jul. 11, 1999.
Taga , T., Performance analysis of a built-in planar inverted F antenna for 800 MHz band portable radio units, Journal on Selected Areas in Communications , IEEE, Jan. 1, 1987, vol. 5, No. 5.
Tai , C. T ; Long , S., Antenna engineering handbook—Chapter 4—Dipoles and Monopoles, Johnson , R. Mc Graw Hill—(3rd Ed.), Jan. 1, 1993, pp. 4-26-4-33.
Tang , Y., The application of fractal analysis to feature extraction, IEEE, Jan. 1, 1999.
Tanidokoro , H. ; Konishi , N. et al, I-wavelength loop dielectric chip antennas, Antennas and Propagation, IEEE Transactions on, Jan. 1, 1998.
Tanner , R. L. ; O'Reilly , G. A., Electronic counter measure antennas for a modern electronic reconnaissance aircraft, USAF Antenna Research and Development Program, 4th , 1954. Symposium on the, Oct. 17, 1954.
Targonski , S. D. ; Pozar , D. M., Dual band dual polarised printed antenna element, Electronics Letters, Nov. 1, 1998, vol. 34, p. 2193-2194.
Teeter , W. L. ; Bushore , K. R., A variable-ratio microwave power divider and multiplexer, Microwave Theory and Techniques, IEEE Transactions on, Oct. 1, 1957.
Tehrani , H. ; Chang , K., A multifrequency microstrip fed annular slot antenna, Antennas and Propagation Society (APS), 2000. IEEE International Symposium, Jul. 1, 2000.
Terman , F. E., Radio engineering, McGraw-Hill Book Company, Inc., Jan. 1, 1947, p. 73-74, 690-691, 730.
The Glenn L. Martin Company, Antennas for USAF B-57 series bombers, USAF Antenna Research and Development Program, 2th , 1952. Symposium on the, Oct. 19, 1952.
Infringement Chart—Samsung Blackjack II SGH-i617. Patent: 7123208, Fractus, Nov. 5, 2009.
Infringement Chart—Samsung Blackjack II SGH-i617. Patent: 7394432, Fractus, Nov. 5, 2009.
Infringement Chart—Samsung Blackjack II SGH-i617. Patent: 7397431, Fractus, Nov. 5, 2009.
Infringement Chart—Samsung Blackjack II SGH-i617. Patent: 7528782, Fractus, Nov. 5, 2009.
Infringement Chart—Samsung Blast SGH T729, Fractus, Nov. 5, 2009.
Infringement Chart—Samsung Blast SGH T729. Patent: 7397431, Fractus, Nov. 5, 2009.
Infringement Chart—Samsung Blast SGH-T729. Patent: 7015868, Fractus, Nov. 5, 2009.
Infringement Chart—Samsung Blast SGH-T729. Patent: 7123208, Fractus, Nov. 5, 2009.
Infringement Chart—Samsung Blast SGH-T729. Patent: 7394432, Fractus, Nov. 5, 2009.
Infringement Chart—Samsung Blast SGH-T729. Patent: 7528782, Fractus, Nov. 5, 2009.
Infringement Chart—Samsung EPIX SGH-I907, Fractus, Nov. 5, 2009.
Infringement Chart—Samsung FlipShot SCH-U900, Fractus, Nov. 5, 2009.
Infringement Chart—Samsung FlipShot SCH-U900. Patent: 7015868, Fractus, Nov. 5, 2009.
Infringement Chart—Samsung FlipShot SCH-U900. Patent: 7123208, Fractus, Nov. 5, 2009.
Infringement Chart—Samsung FlipShot SCH-U900. Patent: 7394432, Fractus, Nov. 5, 2009.
Infringement Chart—Samsung FlipShot SCH-U900. Patent: 7397431, Fractus, Nov. 5, 2009.
Infringement Chart—Samsung FlipShot SCH-U900. Patent: 7528782, Fractus, Nov. 5, 2009.
Infringement Chart—Samsung Instinct M800, Fractus, Nov. 5, 2009.
Infringement Chart—Samsung Instinct M800. Patent: 7015868, Fractus, Nov. 5, 2009.
Infringement Chart—Samsung Instinct M800. Patent: 7123208, Fractus, Nov. 5, 2009.
Infringement Chart—Samsung Instinct M800. Patent: 7394432, Fractus, Nov. 5, 2009.
Infringement Chart—Samsung Instinct M800. Patent: 7397431, Fractus, Nov. 5, 2009.
Infringement Chart—Samsung Instinct M800. Patent: 7528782, Fractus, Nov. 5, 2009.
Infringement Chart—Samsung M320, Fractus, Nov. 5, 2009.
Infringement Chart—Samsung M320. Patent: 7397431, Fractus, Nov. 5, 2009.
Infringement Chart—Samsung M320. Patent: 7015868, Fractus, Nov. 5, 2009.
Infringement Chart—Samsung M320. Patent: 7123208, Fractus, Nov. 5, 2009.
Infringement Chart—Samsung M320. Patent: 7394432, Fractus, Nov. 5, 2009.
Infringement Chart—Samsung M320. Patent: 7528782, Fractus, Nov. 5, 2009.
Infringement Chart—Samsung Magnet (SGH-A257). Patent: 7015868, Fractus, Nov. 5, 2009.
Infringement Chart—Samsung Magnet (SGH-A257). Patent: 7123208, Fractus, Nov. 5, 2009.
Infringement Chart—Samsung Messager, Fractus, Nov. 5, 2009.
Infringement Chart—Samsung Messager. Patent: 7015868, Fractus, Nov. 5, 2009.
Infringement Chart—Samsung Messager. Patent: 7123208, Fractus, Nov. 5, 2009.
Infringement Chart—Samsung Messager. Patent: 7394432, Fractus, Nov. 5, 2009.
Infringement Chart—Samsung Messager. Patent: 7397431, Fractus, Nov. 5, 2009.
Infringement Chart—Samsung Messager. Patent: 7528782, Fractus, Nov. 5, 2009.
Infringement Chart—Samsung Omnia SGH-I900, Fractus, Nov. 5, 2009
Infringement Chart—Samsung Omnia SGH-I900. Patent: 7015868, Fractus, Nov. 5, 2009.
Infringement Chart—Samsung Omnia SGH-I900. Patent: 7123208, Fractus, Nov. 5, 2009.
Infringement Chart—Samsung Omnia SGH-I900. Patent: 7394432, Fractus, Nov. 5, 2009.
Infringement Chart—Samsung Omnia SGH-I900. Patent: 7397431, Fractus, Nov. 5, 2009.
Infringement Chart—Samsung Omnia SGH-I900. Patent: 7528782, Fractus, Nov. 5, 2009.
Infringement Chart—Samsung SCH A127, Fractus, Nov. 5, 2009.
Infringement Chart—Samsung SCH U340., Fractus, Nov. 5, 2009.
Infringement Chart—Samsung SCH U340. Patent: 7015868, Fractus, Nov. 5, 2009.
Infringement Chart—Samsung SCH U340. Patent: 7123208, Fractus, Nov. 5, 2009.
Infringement Chart—Samsung SCH U340. Patent: 7397431, Fractus, Nov. 5, 2009.
Infringement Chart—Samsung SCH U340. Patent: 7528782, Fractus, Nov. 5, 2009.
Infringement Chart—Samsung SCH U410., Fractus, Nov. 5, 2009.
Infringement Chart—Samsung SCH-R800. Patent: 7123208, Fractus, Nov. 5, 2009.
Infringement Chart—Samsung SCH-R800. Patent: 7397431, Fractus, Nov. 5, 2009.
Infringement Chart—Samsung SCH-R800. Patent: 7528782, Fractus, Nov. 5, 2009.
Infringement Chart—Samsung SCH-U310, Fractus, Nov. 5, 2009.
Infringement Chart—Samsung SCH-U310. Patent: 7015868, Fractus, Nov. 5, 2009.

(56) References Cited

OTHER PUBLICATIONS

Infringement Chart—Samsung SCH-U310. Patent: 7123208, Fractus, Nov. 5, 2009.
Infringement Chart—Samsung SCH-U310. Patent: 7397431, Fractus, Nov. 5, 2009.
Infringement Chart—Samsung SCH-U310. Patent: 7528782, Fractus, Nov. 5, 2009.
Infringement Chart—Samsung SCH-U430, Fractus, Nov. 5, 2009.
Infringement Chart—Samsung SCH-U430. Patent: 7015868, Fractus, Nov. 5, 2009.
Infringement Chart—Samsung SCH-U430. Patent: 7123208, Fractus, Nov. 5, 2009.
Infringement Chart—Samsung SCH-U430. Patent: 7397431, Fractus, Nov. 5, 2009.
Infringement Chart—Samsung SCH-U430. Patent: 7528782, Fractus, Nov. 5, 2009.
Infringement Chart—Samsung SCH-U470, Fractus, Nov. 5, 2009.
Infringement Chart—Samsung SCH-U470. Patent: 7015868, Fractus, Nov. 5, 2009.
Infringement Chart—Samsung SCH-U470. Patent: 7123208, Fractus, Nov. 5, 2009.
Infringement Chart—Samsung SCH-U470. Patent: 7397431, Fractus, Nov. 5, 2009.
Infringement Chart—Samsung SCH-U470. Patent: 7528782, Fractus, Nov. 5, 2009.
Infringement Chart—Samsung SCH-U520, Fractus, Nov. 5, 2009.
Infringement Chart—Samsung SCH-U520. Patent: 7015868, Fractus, Nov. 5, 2009.
Infringement Chart—Samsung SCH-U520. Patent: 7123208, Fractus, Nov. 5, 2009.
Infringement Chart—Samsung SCH-U520. Patent: 7394432, Fractus, Nov. 5, 2009.
Infringement Chart—Samsung SCH-U520. Patent: 7397431, Fractus, Nov. 5, 2009.
Infringement Chart—Samsung SCH-U520. Patent: 7528782, Fractus, Nov. 5, 2009.
Infringement Chart—Samsung SCH-U740, Fractus, Nov. 5, 2009.
Infringement Chart—Samsung SCH-U740. Patent: 7015868, Fractus, Nov. 5, 2009.
Infringement Chart—Samsung SCH-U740. Patent: 7123208, Fractus, Nov. 5, 2009.
Infringement Chart—Samsung SCH-U740. Patent: 7397431, Fractus, Nov. 5, 2009.
Infringement Chart—Samsung SCH-U740. Patent: 7528782, Fractus, Nov. 5, 2009.
Infringement Chart—Samsung SCH-U750, Fractus, Nov. 5, 2009.
Infringement Chart—Samsung SCH-U750. Patent: 7015868, Fractus, Nov. 5, 2009.
Infringement Chart—Samsung SCH-U750. Patent: 7123208, Fractus, Nov. 5, 2009.
Infringement Chart—Samsung SCH-U750. Patent: 7397431, Fractus, Nov. 5, 2009.
Infringement Chart—Samsung SCH-U750. Patent: 7528782, Fractus, Nov. 5, 2009.
Infringement Chart—Samsung SCH-U940, Fractus, Nov. 5, 2009.
Infringement Chart—Samsung SCH-U940. Patent: 7015868, Fractus, Nov. 5, 2009.
Infringement Chart—Samsung SCH-U940. Patent: 7123208, Fractus, Nov. 5, 2009.
Infringement Chart—Samsung SCH-U940. Patent: 7397431, Fractus, Nov. 5, 2009.
Infringement Chart—Samsung SCH-U940. Patent: 7528782, Fractus, Nov. 5, 2009.
Infringement Chart—Samsung SGH A117, Fractus, Nov. 5, 2009.
Infringement Chart—Samsung SGH A117. Patent: 7015868, Fractus, Nov. 5, 2009.
Infringement Chart—Samsung SGH A117. Patent: 7123208, Fractus, Nov. 5, 2009.
Infringement Chart—Samsung SGH A117. Patent: 7397431, Fractus, Nov. 5, 2009.
Infringement Chart—Samsung SGH A117. Patent: 7528782, Fractus, Nov. 5, 2009.
Infringement Chart—Samsung SGH A127. Patent 7123208, Fractus, Nov. 5, 2009.
Infringement Chart—Samsung SGH A127. Patent: 7015868, Fractus, Nov. 5, 2009.
Infringement Chart—Samsung SGH A127. Patent: 7397431, Fractus, Nov. 5, 2009.
Infringement Chart—Samsung SGH A127. Patent: 7528782, Fractus, Nov. 5, 2009.
Infringement Chart—Samsung SGH A437, Fractus, Nov. 5, 2009.
Infringement Chart—Samsung SGH A437. Patent: 7015868, Fractus, Nov. 5, 2009.
Infringement Chart—Samsung SGH A437. Patent: 7123208, Fractus, Nov. 5, 2009.
Infringement Chart—Samsung SGH A437. Patent: 7394432, Fractus, Nov. 5, 2009.
Infringement Chart—Samsung SGH A437. Patent: 7397431, Fractus, Nov. 5, 2009.
Infringement Chart—Samsung SGH A437. Patent: 7528782, Fractus, Nov. 5, 2009.
Infringement Chart—Samsung SGH A737, Fractus, Nov. 5, 2009.
Infringement Chart—Samsung SGH A737. Patent: 7015868, Fractus, Nov. 5, 2009.
Infringement Chart—Samsung SGH A737. Patent: 7123208, Fractus, Nov. 5, 2009.
Infringement Chart—Samsung SGH A737. Patent: 7394432, Fractus, Nov. 5, 2009.
Infringement Chart—Samsung SGH A737. Patent: 7397431, Fractus, Nov. 5, 2009.
Infringement Chart—Samsung SGH A737. Patent: 7528782, Fractus, Nov. 5, 2009.
Infringement Chart—Samsung SGH A867, Fractus, Nov. 5, 2009.
Infringement Chart—Samsung SGH A867. Patent: 7015868, Fractus, Nov. 5, 2009.
Infringement Chart—Samsung SGH A867. Patent: 7123208, Fractus, Nov. 5, 2009.
Infringement Chart—Samsung SGH A867. Patent: 7394432, Fractus, Nov. 5, 2009.
Infringement Chart—Samsung SGH A867. Patent: 7397431, Fractus, Nov. 5, 2009.
Infringement Chart—Samsung SGH A867. Patent: 7528782, Fractus, Nov. 5, 2009.
Infringement Chart—Samsung SGH T229, Fractus, Nov. 5, 2009.
Infringement Chart—Samsung SGH T229. Patent: 7015868, Fractus, Nov. 5, 2009.
Infringement Chart—Samsung SGH T229. Patent: 7123208, Fractus, Nov. 5, 2009.
Infringement Chart—Samsung SGH T229. Patent: 7394432, Fractus, Nov. 5, 2009.
Infringement Chart—Samsung SGH T229. Patent: 7397431, Fractus, Nov. 5, 2009.
Infringement Chart—Samsung SGH T229. Patent: 7528782, Fractus, Nov. 5, 2009.
Infringement Chart—Samsung SGH T439, Fractus, Nov. 5, 2009.
Infringement Chart—Samsung SGH T439. Patent: 7015868, Fractus, Nov. 5, 2009.
Infringement Chart—Samsung SGH T439. Patent: 7123208, Fractus, Nov. 5, 2009.
Infringement Chart—Samsung SGH T439. Patent: 7394432, Fractus, Nov. 5, 2009.
Infringement Chart—Samsung SGH T439. Patent: 7397431, Fractus, Nov. 5, 2009.
Infringement Chart—Samsung SGH T439. Patent: 7528782, Fractus, Nov. 5, 2009.
Infringement Chart—Samsung SGH T459, Fractus, Nov. 5, 2009.
Infringement Chart—Samsung SGH T459. Patent: 7015868, Fractus, Nov. 5, 2009.
Infringement Chart—Samsung SGH T459. Patent: 7123208, Fractus, Nov. 5, 2009.
Infringement Chart—Samsung SGH T459. Patent: 7394432, Fractus, Nov. 5, 2009.

(56) References Cited

OTHER PUBLICATIONS

Infringement Chart—Samsung SGH T459. Patent: 7397431, Fractus, Nov. 5, 2009.
Infringement Chart—Samsung SGH T459. Patent: 7528782, Fractus, Nov. 5, 2009.
Infringement Chart—Samsung SGH T919, Fractus, Nov. 5, 2009.
Infringement Chart—Samsung SGH T919. Patent: 7015868, Fractus, Nov. 5, 2009.
Infringement Chart—Samsung SGH T919. Patent: 7123208, Fractus, Nov. 5, 2009.
Infringement Chart—Samsung SGH T919. Patent: 7394432, Fractus, Nov. 5, 2009.
Infringement Chart—Samsung SGH T919. Patent: 7397431, Fractus, Nov. 5, 2009.
Infringement Chart—Samsung SGH-A237, Fractus, Nov. 5, 2009.
Infringement Chart—Samsung SGH-A237. Patent: 7015868, Fractus, Nov. 5, 2009.
Infringement Chart—Samsung SGH-A237. Patent: 7123208, Fractus, Nov. 5, 2009.
Infringement Chart—Samsung SGH-A237. Patent: 7394432, Fractus, Nov. 5, 2009.
Infringement Chart—Samsung SGH-A237. Patent: 7397431, Fractus, Nov. 5, 2009.
Infringement Chart—Samsung SGH-A237. Patent: 7528782, Fractus, Nov. 5, 2009.
Infringement Chart—Samsung SGH-A257, Fractus, Nov. 5, 2009.
Infringement Chart—Samsung SGH-A257. Patent: 7394432, Fractus, Nov. 5, 2009.
Infringement Chart—Samsung SGH-A257. Patent: 7397431, Fractus, Nov. 5, 2009.
Infringement Chart—Samsung SGH-A257. Patent: 7528782, Fractus, Nov. 5, 2009.
Infringement Chart—Samsung SGH-A630. Patent: 7123208, Fractus, Nov. 5, 2009.
Infringement Chart—Samsung SCH U410. Patent: 7015868, Fractus, Nov. 5, 2009.
Infringement Chart—Samsung SCH U410. Patent: 7123208, Fractus, Nov. 5, 2009.
Infringement Chart—Samsung SCH U410. Patent: 7397431, Fractus, Nov. 5, 2009.
Infringement Chart—Samsung SCH U410. Patent: 7528782, Fractus, Nov. 5, 2009.
Infringement Chart—Samsung SCH U700, Fractus, Nov. 5, 2009.
Infringement Chart—Samsung SCH U700. Patent: 7015868, Fractus, Nov. 5, 2009.
Infringement Chart—Samsung SCH U700. Patent: 7123208, Fractus, Nov. 5, 2009.
Infringement Chart—Samsung SCH U700. Patent: 7394432, Fractus, Nov. 5, 2009.
Infringement Chart—Samsung SCH U700. Patent: 7397431, Fractus, Nov. 5, 2009.
Infringement Chart—Samsung SCH U700. Patent: 7528782, Fractus, Nov. 5, 2009.
Infringement Chart—Samsung SCH-A630, Fractus, Nov. 5, 2009.
Infringement Chart—Samsung SCH-A630. Patent: 7015868, Fractus, Nov. 5, 2009.
Infringement Chart—Samsung SCH-A630. Patent: 7397431, Fractus, Nov. 5, 2009.
Infringement Chart—Samsung SCH-A630. Patent: 7528782, Fractus, Nov. 5, 2009.
Infringement Chart—Samsung SCH-A645, Fractus, Nov. 5, 2009.
Infringement Chart—Samsung SCH-A645. Patent: 7015868, Fractus, Nov. 5, 2009.
Infringement Chart—Samsung SCH-A645. Patent: 7123208, Fractus, Nov. 5, 2009.
Infringement Chart—Samsung SCH-A645. Patent: 7394432, Fractus, Nov. 5, 2009.
Infringement Chart—Samsung SCH-A645. Patent: 7397431, Fractus, Nov. 5, 2009.
Infringement Chart—Samsung SCH-A645. Patent: 7528782, Fractus, Nov. 5, 2009.
Infringement Chart—Samsung SCH-A870, Fractus, Nov. 5, 2009.
Infringement Chart—Samsung SCH-A870. Patent: 7015868, Fractus, Nov. 5, 2009.
Infringement Chart—Samsung SCH-A870. Patent: 7123208, Fractus, Nov. 5, 2009.
Infringement Chart—Samsung SCH-A870. Patent: 7397431, Fractus, Nov. 5, 2009.
Infringement Chart—Samsung SCH-A870. Patent: 7528782, Fractus, Nov. 5, 2009.
Infringement Chart—Samsung SCH-A887. Patent: 7394432, Fractus, Nov. 5, 2009.
Infringement Chart—Samsung SCH-I910, Fractus, Nov. 5, 2009.
Infringement Chart—Samsung SCH-I910. Patent: 7015868, Fractus, Nov. 5, 2009.
Infringement Chart—Samsung SCH-I910. Patent: 7123208, Fractus, Nov. 5, 2009.
Infringement Chart—Samsung SCH-I910. Patent: 7394432, Fractus, Nov. 5, 2009.
Infringement Chart—Samsung SCH-I910. Patent: 7397431, Fractus, Nov. 5, 2009.
Infringement Chart—Samsung SCH-I910. Patent: 7528782, Fractus, Nov. 5, 2009.
Infringement Chart—Samsung SCH-R430, Fractus, Nov. 5, 2009.
Infringement Chart—Samsung SCH-R430. Patent: 7015868, Fractus, Nov. 5, 2009.
Infringement Chart—Samsung SCH-R430. Patent: 7123208, Fractus, Nov. 5, 2009.
Infringement Chart—Samsung SCH-R430. Patent: 7394432, Fractus, Nov. 5, 2009.
Infringement Chart—Samsung SCH-R430. Patent: 7397431, Fractus, Nov. 5, 2009.
Infringement Chart—Samsung SCH-R430. Patent: 7528782, Fractus, Nov. 5, 2009.
Infringement Chart—Samsung SCH-R500., Fractus, Nov. 5, 2009.
Infringement Chart—Samsung SCH-R500. Patent: 7015868, Fractus, Nov. 5, 2009.
Infringement Chart—Samsung SCH-R500. Patent: 7123208, Fractus, Nov. 5, 2009.
Infringement Chart—Samsung SCH-R500. Patent: 7397431, Fractus, Nov. 5, 2009.
Infringement Chart—Samsung SCH-R500. Patent: 7528782, Fractus, Nov. 5, 2009.
Infringement Chart—Samsung SCH-R600, Fractus, Nov. 5, 2009.
Infringement Chart—Samsung SCH-R600. Patent: 7015868, Fractus, Nov. 5, 2009.
Infringement Chart—Samsung SCH-R600. Patent: 7123208, Fractus, Nov. 5, 2009.
Infringement Chart—Samsung SCH-R600. Patent: 7397431, Fractus, Nov. 5, 2009.
Infringement Chart—Samsung SCH-R600. Patent: 7528782, Fractus, Nov. 5, 2009.
Infringement Chart—Samsung SCH-R800, Fractus, Nov. 5, 2009.
Infringement Chart—Samsung SCH-R800. Patent: 7015868, Fractus, Nov. 5, 2009.
Infringement Chart—Samsung SGH-A837, Fractus, Nov. 5, 2009.
Infringement Chart—Samsung SGH-A837. Patent: 7015868, Fractus, Nov. 5, 2009.
Infringement Chart—Samsung SGH-A837. Patent: 7123208, Fractus, Nov. 5, 2009.
Infringement Chart—Samsung SGH-A837. Patent: 7394432, Fractus, Nov. 5, 2009.
Infringement Chart—Samsung SGH-A837. Patent: 7397431, Fractus, Nov. 5, 2009.
Infringement Chart—Samsung SGH-A837. Patent: 7528782, Fractus, Nov. 5, 2009.
Infringement Chart—Samsung SGH-A887, Fractus, Nov. 5, 2009.
Infringement Chart—Samsung SGH-A887. Patent: 7123208, Fractus, Nov. 5, 2009.
Infringement Chart—Samsung SGH-A887. Patent: 7397431, Fractus, Nov. 5, 2009.

(56) References Cited

OTHER PUBLICATIONS

Infringement Chart—Samsung SGH-A887. Patent: 7528782, Fractus, Nov. 5, 2009.
Infringement Chart—Samsung SGH-1907. Patent: 7015868, Fractus, Nov. 5, 2009.
Infringement Chart—Samsung SGH-I907. Patent: 7123208, Fractus, Nov. 5, 2009.
Infringement Chart—Samsung SGH-I907. Patent: 7394432, Fractus, Nov. 5, 2009.
Infringement Chart—Samsung SGH-I907. Patent: 7397431, Fractus, Nov. 5, 2009.
Infringement Chart—Samsung SGH-I907. Patent: 7528782, Fractus, Nov. 5, 2009.
Infringement Chart—Samsung SGH-T219., Fractus, Nov. 5, 2009.
Infringement Chart—Samsung SGH-T219. Patent: 7015868, Fractus, Nov. 5, 2009.
Infringement Chart—Samsung SGH-T219. Patent: 7123208, Fractus, Nov. 5, 2009.
Infringement Chart—Samsung SGH-T219. Patent: 7394432, Fractus, Nov. 5, 2009.
Infringement Chart—Samsung SGH-T219. Patent: 7397431, Fractus, Nov. 5, 2009.
Infringement Chart—Samsung SGH-T219. Patent: 7528782, Fractus, Nov. 5, 2009.
Infringement Chart—Samsung SGH-T239, Fractus, Nov. 5, 2009.
Infringement Chart—Samsung SGH-T239. Patent: 7015868, Fractus, Nov. 5, 2009.
Infringement Chart—Samsung SGH-T239. Patent: 7123208, Fractus, Nov. 5, 2009.
Infringement Chart—Samsung SGH-T239. Patent: 7397431, Fractus, Nov. 5, 2009.
Infringement Chart—Samsung SGH-T239. Patent: 7528782, Fractus, Nov. 5, 2009.
Infringement Chart—Samsung SGH-T559, Fractus, Nov. 5, 2009.
Infringement Chart—Samsung SGH-T559. Patent: 7015868, Fractus, Nov. 5, 2009.
Infringement Chart—Samsung SGH-T559. Patent: 7123208, Fractus, Nov. 5, 2009.
Infringement Chart—Samsung SGH-T559. Patent: 7394432, Fractus, Nov. 5, 2009.
Infringement Chart—Samsung SGH-T559. Patent: 7397431, Fractus, Nov. 5, 2009.
Infringement Chart—Samsung SGH-T559. Patent: 7528782, Fractus, Nov. 5, 2009.
Infringement Chart—Samsung SGH-T639, Fractus, Nov. 5, 2009.
Infringement Chart—Samsung SGH-T639. Patent: 7015868, Fractus, Nov. 5, 2009.
Infringement Chart—Samsung SGH-T639. Patent: 7123208, Fractus, Nov. 5, 2009.
Infringement Chart—Samsung SGH-T639. Patent: 7394432, Fractus, Nov. 5, 2009.
Infringement Chart—Samsung SGH-T639. Patent: 7397431, Fractus, Nov. 5, 2009.
Infringement Chart—Samsung SGH-T639. Patent: 7528782, Fractus, Nov. 5, 2009.
Infringement Chart—Samsung SGH-T739, Fractus, Nov. 5, 2009.
Infringement Chart—Samsung SGH-T739. Patent: 7015868, Fractus, Nov. 5, 2009.
Infringement Chart—Samsung SGH-T739. Patent: 7123208, Fractus, Nov. 5, 2009.
Infringement Chart—Samsung SGH-T739. Patent: 7394432, Fractus, Nov. 5, 2009.
Infringement Chart—Samsung SGH-T739. Patent: 7397431, Fractus, Nov. 5, 2009.
Infringement Chart—Samsung SGH-T739. Patent: 7528782, Fractus, Nov. 5, 2009.
Infringement Chart—Samsung SGH-T819, Fractus, Nov. 5, 2009.
Infringement Chart—Samsung SGH-T819. Patent: 7015868, Fractus, Nov. 5, 2009.
Infringement Chart—Samsung SGH-T819. Patent: 7123208, Fractus, Nov. 5, 2009.
Infringement Chart—Samsung SGH-T819. Patent: 7394432, Fractus, Nov. 5, 2009.
Infringement Chart—Samsung SGH-T819. Patent: 7397431, Fractus, Nov. 5, 2009.
Infringement Chart—Samsung SGH-T819. Patent: 7528782, Fractus, Nov. 5, 2009.
Infringement Chart—Samsung SGH-T929, Fractus, Nov. 5, 2009.
Infringement Chart—Samsung SGH-T929. Patent: 7015868, Fractus, Nov. 5, 2009.
Infringement Chart—Samsung SGH-T929. Patent: 7123208, Fractus, Nov. 5, 2009.
Infringement Chart—Samsung SGH-T929. Patent: 7394432, Fractus, Nov. 5, 2009.
Infringement Chart—Samsung SGH-T929. Patent: 7397431, Fractus, Nov. 5, 2009.
Infringement Chart—Samsung SGH-T929. Patent: 7528782, Fractus, Nov. 5, 2009.
Infringement Chart—Samsung SHT T919. Patent: 7528782, Fractus, Nov. 5, 2009.
Infringement Chart—Samsung Solstice (SGH-A887). Patent: 7015868, Fractus, Nov. 5, 2009.
Infringement Chart—Samsung Spex R210a, Fractus, Nov. 5, 2009.
Infringement Chart—Samsung Spex R210a. Patent: 7015868, Fractus, Nov. 5, 2009.
Infringement Chart—Samsung Spex R210a. Patent: 7123208, Fractus, Nov. 5, 2009.
Infringement Chart—Samsung Spex R210a. Patent: 7394432, Fractus, Nov. 5, 2009.
Infringement Chart—Samsung Spex R210a. Patent: 7397431, Fractus, Nov. 5, 2009.
Infringement Chart—Samsung Spex R210a. Patent: 7528782, Fractus, Nov. 5, 2009.
Infringement Chart—Samsung SPH M520, Fractus, Nov. 5, 2009.
Infringement Chart—Samsung SPH M520. Patent: 7015868, Fractus, Nov. 5, 2009.
Infringement Chart—Samsung SPH M520. Patent: 7123208, Fractus, Nov. 5, 2009.
Infringement Chart—Samsung SPH M520. Patent: 7394432, Fractus, Nov. 5, 2009.
Infringement Chart—Samsung SPH M520. Patent: 7397431, Fractus, Nov. 5, 2009.
Infringement Chart—Samsung SPH M520. Patent: 7528782, Fractus, Nov. 5, 2009.
Infringement Chart—Samsung SPH M540., Fractus, Nov. 5, 2009.
Infringement Chart—Samsung SPH M540. Patent: 7015868, Fractus, Nov. 5, 2009.
Infringement Chart—Samsung SPH M540. Patent: 7123208, Fractus, Nov. 5, 2009.
Infringement Chart—Samsung SPH M540. Patent: 7397431, Fractus, Nov. 5, 2009.
Infringement Chart—Samsung SPH M540. Patent: 7528782, Fractus, Nov. 5, 2009.
Infringement Chart—Samsung SPH-A523, Fractus, Nov. 5, 2009.
Infringement Chart—Samsung SPH-A523. Patent: 7015868, Fractus, Nov. 5, 2009.
Infringement Chart—Samsung SPH-A523. Patent: 7123208, Fractus, Nov. 5, 2009.
Infringement Chart—Samsung SPH-A523. Patent: 7394432, Fractus, Nov. 5, 2009.
Infringement Chart—Samsung SPH-A523. Patent: 7397431, Fractus, Nov. 5, 2009.
Infringement Chart—Samsung SPH-A523. Patent: 7528782, Fractus, Nov. 5, 2009.
Infringement Chart—Samsung SPH-M550, Fractus, Nov. 5, 2009.
Infringement Chart—Samsung SPH-M550. Patent: 7015868, Fractus, Nov. 5, 2009.
Infringement Chart—Samsung SPH-M550. Patent: 7123208, Fractus, Nov. 5, 2009.
Infringement Chart—Samsung SPH-M550. Patent: 7397431, Fractus, Nov. 5, 2009.

(56) References Cited

OTHER PUBLICATIONS

Infringement Chart—Samsung SPH-M550. Patent: 7528782, Fractus, Nov. 5, 2009.
Infringement Chart—Samsung Sway SCH-U650, Fractus, Nov. 5, 2009.
Infringement Chart—Samsung Sway SCH-U650. Patent: 7015868, Fractus, Nov. 5, 2009.
Infringement Chart—Samsung Sway SCH-U650. Patent: 7123208, Fractus, Nov. 5, 2009.
Infringement Chart—Samsung Sway SCH-U650. Patent: 7397431, Fractus, Nov. 5, 2009.
Infringement Chart—Samsung Sway SCH-U650. Patent: 7528782, Fractus, Nov. 5, 2009.
Infringement Chart—Sanyo Katana II. Patent: 7123208, Fractus, Nov. 5, 2009.
Infringement Chart—Sanyo Katana II., Fractus, Nov. 5, 2009.
Infringement Chart—Sanyo Katana II. Patent: 7015868, Fractus, Nov. 5, 2009.
Infringement Chart—Sanyo Katana II. Patent: 7394432, Fractus, Nov. 5, 2009.
Infringement Chart—Sanyo Katana II. Patent: 7397431, Fractus, Nov. 5, 2009.
Infringement Chart—Sanyo Katana II. Patent: 7528782, Fractus, Nov. 5, 2009.
Infringement Chart—Sanyo Katana LX, Fractus, Nov. 5, 2009.
Infringement Chart—Sanyo Katana LX. Patent: 7015868, Fractus, Nov. 5, 2009.
Infringement Chart—Sanyo Katana LX. Patent: 7123208, Fractus, Nov. 5, 2009.
Infringement Chart—Sanyo Katana LX. Patent: 7397431, Fractus, Nov. 5, 2009.
Infringement Chart—Sanyo Katana LX. Patent: 7528782, Fractus, Nov. 5, 2009.
Infringement Chart—Sanyo S1, Fractus, Nov. 5, 2009.
Infringement Chart—Sanyo S1. Patent: 7015868, Fractus, Nov. 5, 2009.
Infringement Chart—Sanyo S1. Patent: 7123208, Fractus, Nov. 5, 2009.
Infringement Chart—Sanyo S1. Patent: 7397431, Fractus, Nov. 5, 2009.
Infringement Chart—Sanyo S1. Patent: 7528782, Fractus, Nov. 5, 2009.
Infringement Chart—Sanyo SCP 2700., Fractus, Nov. 5, 2009.
Infringement Chart—Sanyo SCP 2700. Patent: 7015868, Fractus, Nov. 5, 2009.
Infringement Chart—Sanyo SCP 2700. Patent: 7123208, Fractus, Nov. 5, 2009.
Infringement Chart—Sanyo SCP 2700. Patent: 7397431, Fractus, Nov. 5, 2009.
Infringement Chart—Sanyo SCP 2700. Patent: 7528782, Fractus, Nov. 5, 2009.
Infringement Chart—Sharp Sidekick 2008., Fractus, Nov. 5, 2009.
Infringement Chart—Sharp Sidekick 2008. Patent: 7015868, Fractus, Nov. 5, 2009.
Infringement Chart—Sharp Sidekick 2008. Patent: 7123208, Fractus, Nov. 5, 2009.
Infringement Chart—Sharp Sidekick 2008. Patent: 7394432, Fractus, Nov. 5, 2009.
Infringement Chart—Sharp Sidekick 2008. Patent: 7397431, Fractus, Nov. 5, 2009.
Infringement Chart—Sharp Sidekick 2008. Patent: 7528782, Fractus, Nov. 5, 2009.
Infringement Chart—Sharp Sidekick 3, Fractus, Nov. 5, 2009.
Infringement Chart—Sharp Sidekick 3. Patent: 7015868, Fractus, Nov. 5, 2009.
Infringement Chart—Sharp Sidekick 3. Patent: 7123208, Fractus, Nov. 5, 2009.
Infringement Chart—Sharp Sidekick 3. Patent: 7394432, Fractus, Nov. 5, 2009.
Infringement Chart—Sharp Sidekick 3. Patent: 7397431, Fractus, Nov. 5, 2009.
Infringement Chart—Sharp Sidekick 3. Patent: 7528782, Fractus, Nov. 5, 2009.
Infringement Chart—Sharp Sidekick LX . Patent: 7015868, Fractus, Nov. 5, 2009.
Infringement Chart—Sharp Sidekick LX 2009., Fractus, Nov. 5, 2009.
Infringement Chart—Sharp Sidekick LX 2009. Patent: 7015868, Fractus, Nov. 5, 2009.
Infringement Chart—Sharp Sidekick LX 2009. Patent: 7123208, Fractus, Nov. 5, 2009.
Infringement Chart—Sharp Sidekick LX 2009. Patent: 7394432, Fractus, Nov. 5, 2009.
Infringement Chart—Sharp Sidekick LX 2009. Patent: 7397431, Fractus, Nov. 5, 2009.
Infringement Chart—Sharp Sidekick LX 2009. Patent: 7528782, Fractus, Nov. 5, 2009.
Infringement Chart—Sharp Sidekick LX. Patent: 7123208, Fractus, Nov. 5, 2009.
Infringement Chart—Sharp Sidekick LX. Patent: 7148850, Fractus, Nov. 5, 2009.
Infringement Chart—Sharp Sidekick LX. Patent: 7394432, Fractus, Nov. 5, 2009.
Infringement Chart—Sharp Sidekick LX. Patent: 7397431, Fractus, Nov. 5, 2009.
Infringement Chart—Sharp Sidekick LX. Patent: 7528782, Fractus, Nov. 5, 2009.
Infringement Chart—UTStarcom CDM7126., Fractus, Nov. 5, 2009.
Infringement Chart—UTStarcom CDM7126. Patent: 7015868, Fractus, Nov. 5, 2009.
Infringement Chart—UTStarcom CDM7126. Patent: 7123208, Fractus, Nov. 5, 2009.
Infringement Chart—UTStarcom CDM7126. Patent: 7394432, Fractus, Nov. 5, 2009.
Infringement Chart—UTStarcom CDM7126. Patent: 7397431, Fractus, Nov. 5, 2009.
Infringement Chart—UTStarcom CDM7126. Patent: 7411556, Fractus, Nov. 5, 2009.
Infringement Chart—UTStarcom CDM7126. Patent: 7528782, Fractus, Nov. 5, 2009.
Infringement Chart—UTStarcom Quickfire GTX75., Fractus, Nov. 5, 2009.
Infringement Chart—UTStarcom Quickfire GTX75. Patent: 7015868, Fractus, Nov. 5, 2009.
Infringement Chart—UTStarcom Quickfire GTX75. Patent: 7123208, Fractus, Nov. 5, 2009.
Infringement Chart—UTStarcom Quickfire GTX75. Patent: 7394432, Fractus, Nov. 5, 2009.
Infringement Chart—UTStarcom Quickfire GTX75. Patent: 7397431, Fractus, Nov. 5, 2009.
Infringement Chart—UTStarcom Quickfire GTX75. Patent: 7528782, Fractus, Nov. 5, 2009.
Letter from Baker Botts to Howison & Arnott LLP including exhibits, Defendants—Baker Boils, Nov. 5, 2009.
Letter from Baker Botts to Kenyon & Kenyon LLP, Winstead PC and Howison & Arnott LLP including exhibits., Defendants—Baker Botts, Oct. 28, 2009.
Oral and videotaped deposition of Dr. Stuart Long—vol. 1, , Mar. 11, 2011.
Oral and videotaped deposition of Dr. Stuart Long—vol. 2, Fractus, Mar. 13, 2011.
Oral and videotaped deposition of Dr. Stuart Long—vol. 3, Fractus, Mar. 14, 2011.
Oral and videotaped deposition of Dr. Warren L. Stutzman—vol. 1, Fractus, Mar. 3, 2011.
Oral and videotaped deposition of Dr. Warren L. Stutzman—vol. 2, Fractus, Mar. 4, 2011.
Rebuttal expert report of Dr. Dwight L. Jaggard (redacted version), Fractus, Feb. 16, 2011.
Rebuttal expert report of Dr. Stuart A. Long (redacted version), Fractus, Feb. 16, 2011.

(56) References Cited

OTHER PUBLICATIONS

Rebuttal expert report of Dr. Warren L. Stutzman (redacted version), Fractus, Feb. 16, 2011.
The oral and videotaped deposition of Dwight Jaggard. vol. 1, Defendants, Mar. 8, 2011.
The oral and videotaped deposition of Dwight Jaggard. vol. 2, Defendants, Mar. 9, 2011.
The oral and videotaped deposition of Dwight Jaggard. vol. 3, Defendants, Mar. 10, 2011.
Transcript of jury trial before the Honorable Leonard Davis—May 18, 2011—1:00 PM, Court, May 18, 2011.
Transcript of jury trial before the Honorable Leonard Davis—May 18, 2011—8:45 AM, Court, May 18, 2011.
Transcript of jury trial before the Honorable Leonard Davis—May 19, 2011—1:00 PM, Court, May 19, 2011.
Transcript of jury trial before the Honorable Leonard Davis—May 19, 2011—8:45 AM, Court, May 19, 2011.
Transcript of jury trial before the Honorable Leonard Davis—May 20, 2011—12:30 PM, Court, May 20, 2011.
Transcript of jury trial before the Honorable Leonard Davis—May 20, 2011—8:30 AM, Court, May 20, 2011.
Transcript of jury trial before the Honorable Leonard Davis—May 23, 2011—8:55 AM, Court, May 23, 2011.
Transcript of jury trial before the Honorable Leonard Davis US District Judge—May 17, 2011—8:00 AM, Court, May 17, 2011.
Transcript of jury trial before the Honorable Leonard Davis, US District Judge—May 17, 2011—1:10 PM, Court, May 17, 2011.
Transcript of pretrial hearing before the Honorable Leonard Davis, US District Judge—May 16, 2011—2:00 PM, Court, May 16, 2011.
CN00818542—Response to Office Action dated on Nov. 5, 2004, Herrero & Asociados, Mar. 31, 2005.
CN01823716—Office action dated on Feb. 16, 2007, CN-PTO, Feb. 16, 2007.
CN01823716—Office action dated Sep. 21, 2007, CN-PTO, Sep. 21, 2007.
CN01823716—Response to the office action dated on Feb. 16, 2007, CN-PTO, Aug. 21, 2007.
CN01823716—Response to the office action dated on Sep. 21, 2007, CN-PTO, Dec. 3, 2007.
EP00909089—Claims, Herrero & Asociados, Jan. 28, 2005.
EP00909089—Minutes from Oral Proceedings, EPO, Jan. 28, 2005.
EP00909089—Office Action dated on Feb. 7, 2003, EPO, Feb. 7, 2003.
EP00909089—Response to Office Action dated on Feb. 7, 2003, Herrero & Asociados, Aug. 14, 2003.
EP00909089—Response to the Office Action dated on Oct. 28, 2004, EPO, Dec. 16, 2004.
EP00909089—Summons to attend oral proceedings, EPO, Oct. 28, 2004.
EP00909089—Written submissions, Herrero & Asociados, Dec. 15, 2004.
EP05012854—Notice of appeal, Herrero & Asociados, Dec. 19, 2007.
EP05012854—Statement setting out the Grounds of appeal, Herrero & Asociados, Nov. 3, 2008.
EP10185339—Grounds for decision at the oral proceedings dated on Nov. 20, 2012, EPO, Jan. 2, 2013.
EP10185339—Substantiation of appeal, Grunecker, Apr. 24, 2013.
EP99974041—European Patent Office communication dated on Feb. 9, 2004. 3 pages., EPO, Feb. 9, 2004.
EP99974041—European Patent Office Communication dated on Aug. 27, 2002, 4 pages, EPO, Aug. 27, 2002.
EP99974041—European Patent Office Communication dated on Oct. 22, 2003, 4 pages., EPO, Oct. 22, 2003.
PCT/EP00/00411—International preliminary examination report dated Aug. 29, 2002—Invitation to restrict or to pay additional fees, EPO, Aug. 29, 2002.
PCT/ES99/00296—International Preliminary Examination Report, EPO, Dec. 19, 2001.
PCT/ES99/00296—International Search Report, ES-PTO, Mar. 29, 2001.
PCT/ES99/00296—Reply to the Written Opinion dated on Nov. 15, 2001—Declaration of J. Baxter—Exhibit FFF—, Herrero & Asociados, Nov. 15, 2001.
PCT/ES99/00296—Russian Patent Office Communication (with its English translation) from the corresponding Russian Patent Application, 10 pages, RU-PTO, Aug. 4, 2003.
U.S. Appl. No. 10/102,568—Amendment and response to the Office Action dated on Jan. 23, 2004, Jones Day, May 26, 2004.
U.S. Appl. No. 10/102,568—Notice of allowance dated Jun. 28, 2004, USPTO, Jun. 28, 2004.
U.S. Appl. No. 10/102,568—Office Action dated on Jan. 23, 2004, USPTO, Jan. 23, 2004.
U.S. Appl. No. 10/102,568—Preliminary Amendment—Exhibit CCCC, Rosenman & Colin LLP, Mar. 18, 2002.
U.S. Appl. No. 10/102,568—Supplemental Amendment to correct and inadvertent typographical error in the amendment filed in May 24, 2004, USPTO, Jun. 14, 2004.
U.S. Appl. No. 10/181,790—Office action dated on Aug. 27, 2004, USPTO, Aug. 27, 2004.
U.S. Appl. No. 10/181,790—Office action dated on Aug. 4, 2005, USPTO, Aug. 4, 2005.
U.S. Appl. No. 10/181,790—Office action dated on Jun. 2, 2005, USPTO, Jun. 2, 2005.
U.S. Appl. No. 10/181,790—Office action dated on Mar. 2, 2005, USPTO, Mar. 2, 2005.
U.S. Appl. No. 10/181,790—Response to office action dated on Aug. 27, 2004, Jones Day, Dec. 8, 2004.
U.S. Appl. No. 10/181,790—Response to the office action dated on Jun. 2, 2005, Jones Day, Jul. 20, 2005.
U.S. Appl. No. 10/181,790—Response to the office action dated on Mar. 2, 2005, Jones Day, Mar. 14, 2005.
U.S. Appl. No. 10/182,635—Amendment and response to office action dated on Dec. 13, 2004, Jones Day, Mar. 17, 2005.
U.S. Appl. No. 10/182,635—Amendment and response to office action dated on Oct. 4, 2004, Jones Day, Nov. 12, 2004.
U.S. Appl. No. 10/182,635—Notice of Allowance dated on Apr. 11, 2005, USPTO, Apr. 11, 2005.
U.S. Appl. No. 10/182,635—Office Action dated on Dec. 13, 2004, USPTO, Dec. 13, 2004.
U.S. Appl. No. 10/182,635—Office action dated on Oct. 4, 2004, USPTO, Oct. 4, 2004.
U.S. Appl. No. 10/422,578—Advisory Action before the filing of an Appeal Brief, USPTO, Jun. 23, 2005.
U.S. Appl. No. 10/422,578—Office Action dated on Apr. 7, 2005, USPTO, Apr. 7, 2005.
U.S. Appl. No. 10/422,578—Office Action dated on Aug. 23, 2007, USPTO, Aug. 23, 2007.
U.S. Appl. No. 10/422,578—Office Action dated on Aug. 24, 2005, USPTO, Aug. 24, 2005.
U.S. Appl. No. 10/422,578—Office Action dated on Jan. 26, 2006, USPTO, Jan. 26, 2006.
U.S. Appl. No. 10/422,578—Office Action dated on Jun. 23, 2005, USPTO, Jun. 23, 2005.
U.S. Appl. No. 10/422,578—Office Action dated on Mar. 12, 2007, USPTO, Mar. 12, 2007.
U.S. Appl. No. 10/422,578—Office action dated on Mar. 26, 2008, USPTO, Mar. 26, 2008.
U.S. Appl. No. 10/422,578—Office Action dated on Oct. 4, 2004, USPTO, Oct. 4, 2004.
U.S. Appl. No. 10/422,578—Request for Continued Examination with response to the office action dated on Apr. 7, 2005 and the advisory action dated on Jun. 23, 2005, Jones Day, Aug. 8, 2005.
U.S. Appl. No. 10/422,578—Response to the Office Action dated on Apr. 7, 2005, Jones Day, May 31, 2005.
U.S. Appl. No. 10/422,578—Response to the Office Action dated on Oct. 4, 2004, Jones Day, Jan. 6, 2005.
U.S. Appl. No. 10/797,732—Office action dated on Aug. 9, 2007, USPTO, Aug. 9, 2007.
U.S. Appl. No. 10/822,933—Notice of allowance dated on Oct. 18, 2007, USPTO, Oct. 18, 2007.

(56) References Cited

OTHER PUBLICATIONS

U.S. Appl. No. 10/822,933—Office Action dated on Oct. 5, 2006, USPTO, Oct. 5, 2006.
U.S. Appl. No. 10/822,933—Response to Office Action dated on Oct. 5, 2006, Jenkens & Gilchrist, Jan. 4, 2007.
U.S. Appl. No. 10/963,080—Amendment and response to Office Action dated on Jun. 15, 2005, Howison & Arnott, Aug. 8, 2005.
U.S. Appl. No. 10/963,080—Notice of allowance dated on Sep. 1, 2005., USPTO, Sep. 1, 2005.
U.S. Appl. No. 10/963,080—Office Action dated on Jun. 15, 2005, USPTO, Jun. 15, 2005.
U.S. Appl. No. 10/963,080—Preliminary amendment—Declaration of J. Baxter—Exhibit W, Jones Day, Dec. 10, 2004.
U.S. Appl. No. 11/021,597—Office action dated Oct. 30, 2007, USPTO, Oct. 30, 2007.
U.S. Appl. No. 11/021,597—Office Action dated on Mar. 12, 2007, USPTO, Mar. 12, 2007.
U.S. Appl. No. 11/021,597—Response to the Office Action dated Mar. 12, 2007, Winstead, Aug. 9, 2007.
U.S. Appl. No. 11/021,597—Response to the office action dated Oct. 30, 2007, Winstead, Dec. 28, 2007.
U.S. Appl. No. 11/033,788—Response to Office Action dated Feb. 7, 2006, Jenkens & Gilchrist, Jun. 1, 2006.
U.S. Appl. No. 11/102,390—Notice of allowance dated on Jul. 6, 2006., USPTO, Jun. 25, 2006.
U.S. Appl. No. 11/110,052—Notice of Allowance dated on May 30, 2006, USPTO, May 30, 2006.
U.S. Appl. No. 11/110,052—Preliminary amendment dated on Apr. 18, 2005, Howison & Arnott, Apr. 18, 2005.
U.S. Appl. No. 11/124,768—Amendment in response to non-final office action dated Aug. 23, 2006, Jenkens & Gilchrist, Nov. 13, 2006.
U.S. Appl. No. 11/179,250—Response office action, Howison & Arnott, Jul. 12, 2005.
U.S. Appl. No. 11/179,257—Amendment and response to office action dated on Feb. 4, 2008, Howison & Arnott, Feb. 27, 2008.
U.S. Appl. No. 11/179,257—Amendment and response to office action dated Sep. 21, 2006, Howison & Arnott, Oct. 4, 2006.
U.S. Appl. No. 11/179257—Notice of allowance dated on Abril 23, 2007, USPTO, Apr. 23, 2007.
U.S. Appl. No. 11/179,257—Notice of allowance dated on Apr. 15, 2008, USPTO, Apr. 15, 2008.
U.S. Appl. No. 11/179,257—Notice of allowance dated on Aug. 2, 2007, USPTO, Aug. 2, 2007.
U.S. Appl. No. 11/179,257—Notice of Allowance dated on Jun. 18, 2007, USPTO, Jun. 18, 2007.
U.S. Appl. No. 11/179,257—Notice of allowance dated on Nov. 26, 2007, USPTO, Nov. 26, 2007.
U.S. Appl. No. 11/179,257—Notice of allowance dated on Oct. 19, 2006, USPTO, Oct. 19, 2006.
U.S. Appl. No. 11/179,257—Office Action dated on Aug. 23, 2006, USPTO, Aug. 23, 2006.
U.S. Appl. No. 11/179,257—Office Action dated on Feb. 4, 2008, USPTO, Feb. 4, 2008.
U.S. Appl. No. 11/179,257—Office Action dated on Sep. 21, 2006, USPTO, Sep. 21, 2006.
U.S. Appl. No. 11/179,257—Response to office action dated Aug. 23, 2006, Howison & Arnott, Sep. 12, 2006.
U.S. Appl. No. 11/550,256—Amendment and response to office action dated on Jan. 15, 2008, Howison & Arnott, Feb. 27, 2008.
U.S. Appl. No. 11/550,256—Notice of allowance dated on Mar. 28, 2008., USPTO, Mar. 28, 2008.
U.S. Appl. No. 11/550,256—Office Action dated on Jan. 15, 2008, USPTO, Jan. 15, 2008.
U.S. Appl. No. 11/550,276—Amendment and response to Office Action dated on Jun. 9, 2008, Howison & Arnott, Jul. 7, 2008.
U.S. Appl. No. 11/550,276—Notice of allowance dated on Jan. 13, 2009., USPTO, Jan. 13, 2009.
U.S. Appl. No. 11/550,276—Notice of allowance dated on Sep. 17, 2008., USPTO, Sep. 17, 2008.
U.S. Appl. No. 11/550,276—Office Action dated on Jun. 9, 2008, USPTO, Jun. 9, 2008.
U.S. Appl. No. 11/780,932—Amendment and response to Office Action dated on Jul. 22, 2008, Howison & Arnott, Aug. 6, 2008.
U.S. Appl. No. 11/780,932—Notice of allowance dated on Jan. 28, 2009., USPTO, Jan. 28, 2009.
U.S. Appl. No. 11/780,932—Notice of allowance dated on Oct. 1, 2008, USPTO, Oct. 1, 2008.
U.S. Appl. No. 11/780,932—Office Action dated on Jul. 22, 2008, USPTO, Jul. 22, 2008.
U.S. Appl. No. 11/780,932—Preliminary amendment dated on Jul. 20, 2007, Howison & Arnott, Jul. 20, 2007.
U.S. Appl. No. 11/796,368—Office Action dated on Aug. 10, 2010, USPTO, Aug. 10, 2010.
U.S. Appl. No. 11/796,368—Office Action dated on Jun. 25, 2010, USPTO, Jun. 25, 2010.
U.S. Appl. No. 12/347,462—Office Action dated on Oct. 28, 2009, USPTO, Oct. 28, 2009.
U.S. Appl. No. 12/400,888—Amendment and response to Office Action dated on Dec. 10, 2010, Howison & Arnott, Dec. 22, 2010.
U.S. Appl. No. 12/400,888—Notice of allowance dated on Apr. 18, 2011, USPTO, Apr. 18, 2011.
U.S. Appl. No. 12/400,888—Notice of allowance dated on Feb. 7, 2011, USPTO, Feb. 7, 2011.
U.S. Appl. No. 12/400,888—Notice of allowance dated on Jun. 28, 2011, USPTO, Jun. 28, 2011.
U.S. Appl. No. 12/400,888—Office action dated on Dec. 10, 2010, USPTO, Dec. 12, 2010.
U.S. Appl. No. 12/400,888—Office action dated on Oct. 5, 2010, USPTO, Oct. 5, 2010.
U.S. Appl. No. 12/400,888—Response to Office Action dated on Oct. 5, 2010, Howison & Arnott, Nov. 2, 2010.
U.S. Appl. No. 13/036,819—Notice of allowance dated on Dec. 28, 2011, USPTO, Dec. 28, 2011.
U.S. Appl. No. 13/036,819—Notice of allowance dated on Feb. 15, 2012, USPTO, Feb. 15, 2012.
U.S. Appl. No. 13/036,819—Notice of allowance dated on Jun. 27 , 2011, USPTO, Jun. 27, 2011.
U.S. Appl. No. 13/036,819—Notice of allowance dated on Sep. 6, 2011, USPTO, Sep. 6, 2011.
U.S. Appl. No. 13/036,819—Notice of allowance dated on Sep. 21, 2011, USPTO, Sep. 21, 2011.
U.S. Appl. No. 13/044,189—Amendment and response to office action dated Aug. 8, 2011, Howison & Arnott, Sep. 1, 2011.
U.S. Appl. No. 13/044,189—Notice of Allowance dated on Dec. 28, 2011, USPTO, Dec. 28, 2011.
U.S. Appl. No. 13/044,189—Notice of allowance dated on Feb. 15, 2012, USPTO, Feb. 15, 2012.
U.S. Appl. No. 13/044,189—Notice of allowance dated on Oct. 11, 2011, USPTO, Oct. 11, 2011.
U.S. Appl. No. 13/044,189—Office action dated on Aug. 8, 2011, USPTO, Aug. 8, 2011.
U.S. Appl. No. 13/411,212—Amendment and response to office action dated on May 31, 2012, Howison & Arnott, Jun. 21, 2012.
U.S. Appl. No. 13/411,212—Notice of allowance dated on Aug. 8, 2012, USPTO, Aug. 8, 2012.
U.S. Appl. No. 13/411,212—Office action dated on May 31, 2012, USPTO, May 31, 2012.
U.S. Appl. No. 13/669,916—Notice of allowance dated on Dec. 17, 2012, USPTO, Dec. 17, 2012.
U.S. Appl. No. 95/000,586—Request for inter partes reexamination of U.S. Pat. No. 7,397,431 including exhibits CC1-CC6, Kyocera, Nov. 12, 2010.
U.S. Appl. No. 95/000,588—Request for inter partes reexamination of U.S. Pat. No. 7,394,432 including exhibits CC1-CC6, Kyocera, Nov. 12, 2010.
U.S. Appl. No. 95/000,588—U.S. Appl. No. 95/001,483—Inter partes reexamination examiner's answer for the U.S. Pat. No. 7,394,432, USPTO, Jul. 3, 2013.
U.S. Appl. No. 95/000,589—Request for inter partes reexamination of U.S. Pat. No. 7,015,868 including exhibits CC1-CC5, Kyocera, Nov. 16, 2010.

(56) References Cited

OTHER PUBLICATIONS

U.S. Appl. No. 95/000,591—Request for inter partes reexamination of U.S. Pat. No. 7,123,208 including exhibits CC1-CC4, Kyocera, Nov. 16, 2010.
U.S. Appl. No. 95/000,595—Request for inter partes reexamination of U.S. Pat. No. 7,528,782 including exhibits CC1-CC4, Kyocera, Nov. 17, 2010.
U.S. Appl. No. 95/000,595—U.S. Appl. No. 95/001,455—Inter partes reexamination examiner's answer for the U.S. Pat. No. 7,528,782, USPTO, Jun. 7, 2013.
U.S. Appl. No. 95/001,389—Corrected patent owner's response to first office action for the U.S. Pat. No. 7,123,208 dated on Aug. 12, 2010 with exhibit, Sterne Kessler Goldstein Fox, Apr. 11, 2011.
U.S. Appl. No. 95/001,389—Office Action for the U.S. Pat. No. 7,123,208 dated on Aug. 12, 2010, USPTO, Aug. 12, 2010.
U.S. Appl. No. 95/001,389—Patent owner's rebuttal brief for U.S. Pat. No. 7,123,208, Edell, Shapiro & Finnan, LLC, Jul. 25, 2013.
U.S. Appl. No. 95/001,389—Request for inter partes reexamination of U.S. Pat. No. 7,123,208 including exhibits CC-A-CC-C and OTH-B, Samsung, Jul. 1, 2010.
U.S. Appl. No. 95/001,389—Response to the Office Action dated for the U.S. Pat. No. 7,123,208 on Aug. 12, 2010, Sterne Kessler Goldstein Fox, Nov. 12, 2010.
U.S. Appl. No. 95/001,389—Third party requester's comments to patent owner's reply of Apr. 11, 2011 for U.S. Pat. No. 7,123,208, Samsung, Apr. 29, 2011.
U.S. Appl. No. 95/001,389—Third party requester's comments to patent owner's reply of Oct. 3, 2011 for U.S. Pat. No. 7,123,208, Samsung, Dec. 19, 2011.
U.S. Appl. No. 95/001,389—Third party requester's replacement comments to patent owner's reply of Nov. 12, 2010 for U.S. Pat. No. 7,123,208, Samsung, Mar. 7, 2011.
U.S. Appl. No. 95/001,389—U.S. Appl. No. 95/000,591—Action closing prosecution for the U.S. Pat. No. 7,123,208, USPTO, Apr. 27, 2012.
U.S. Appl. No. 95/001,389—U.S. Appl. No. 95/000,591—Action Closing Prosecution for U.S. Pat. No. 7,123,208 dated Jul. 26, 2012, USPTO, Jul. 26, 2012.
U.S. Appl. No. 95/001,389—U.S. Appl. No. 95/000,591—Inter partes reexamination examiner's answer for the U.S. Pat. No. 7,123,208, USPTO, Jun. 25, 2013.
U.S. Appl. No. 95/001,389—U.S. Appl. No. 95/000,591—Patent owner's notice of appeal in interpartes reexamination for the U.S. Pat. No. 7,123,208, Edell , Shapiro & Finnan , LLC, Jan. 10, 2013.
U.S. Appl. No. 95/001,389—U.S. Appl. No. 95/000,591—Patent owner's petition requesting continued reexamination for U.S. Pat. No. 7,123,208, Edell , Shpairo & Finnan, Feb. 8, 2013.
U.S. Appl. No. 95/001,389—U.S. Appl. No. 95/000,591—Patent owner's reply to action closing prosecution mailed on Jul. 26, 2012 for U.S. Pat. No. 7,123,208, Edell , Shapiro & Finnan , LLC, Aug. 27, 2012.
U.S. Appl. No. 95/001,389—U.S. Appl. No. 95/000,591—Patents owner's appeal brief for the U.S. Pat. No. 7,123,208, Edell, Shapiro & Finnan, May 6, 2013.
U.S. Appl. No. 95/001,389—U.S. Appl. No. 95/000,591—Patents owner's reply to right of appeal notice for the U.S. Pat. No. 7,123,208, Edell , Shapiro & Finnan, Feb. 8, 2013.
U.S. Appl. No. 95/001,389—U.S. Appl. No. 95/000,591—Petition for suspension of inter-partes reexamination proceedings including exhibits O-1 through O-19 for U.S. Pat. No. 7,123,208, Edell , Shapiro & Finnan , LLC, Oct. 1, 2012.
U.S. Appl. No. 95/001,389—U.S. Appl. No. 95/000,591—Response to the action closing prosecution mailed on Apr. 27, 2012 for U.S. Pat. No. 7,123,208, Edell , Shapiro & Finnan , LLC, Jun. 27, 2012.
U.S. Appl. No. 95/001,389—U.S. Appl. No. 95/000,591—Right of appeal notice for the U.S. Pat. No. ,7,213,208, USPTO, Dec. 10, 2012.
U.S. Appl. No. 95/001,389—U.S. Appl. No. 95/000,591—Third party requester's comments to patent owner's ACP reply of Aug. 27, 2012 for the U.S. Pat. No. 7,123,208 dated on Aug. 31, 2012, Edell , Shapiro & Finnan , LLC, Aug. 31, 2012.
U.S. Appl. No. 95/001,389—U.S. Appl. No. 95/000,591—Third party requester's respondent brief for the U.S. Pat. No. 7,123,208, Samsung—Kyocera, Jun. 6, 2013.
U.S. Appl. No. 95/001,389—U.S. Appl. No. 95/000,591—U.S. Appl. No. 95/001,501—Decision sua sponte to merge reexamination proceedings of U.S. Pat. No. 7,123,208, USPTO, Jun. 1, 2011.
U.S. Appl. No. 95/001,389—U.S. Appl. No. 95/000,591—U.S. Appl. No. 95/001,501—Office action for U.S. Pat. No. 7,123,208 dated on Jul. 1, 2011, USPTO, Jul. 1, 2011.
U.S. Appl. No. 95/001,389—U.S. Appl. No. 95/000,591—U.S. Appl. No. 95/001,501—Patent owner's response to first office action dated on Jul. 1, 2011 of U.S. Pat. No. 7,123,208, Sterne Kessler Goldstein Fox, Oct. 3, 2011.
U.S. Appl. No. 95/001,390—Corrected response to office action for the U.S. Pat. No. 7,015,868 dated on Aug. 19, 2010, Sterne Kessler Goldstein Fox, Apr. 11, 2011.
U.S. Appl. No. 95/001,390—Corrected response to office action for the U.S. Pat. No. 7,015,868 dated on Aug. 19, 2010—Exhibit 1, Sterne Kessler Goldstein Fox, Apr. 11, 2011.
U.S. Appl. No. 95/001,390—Exhibits of patent owner's reponse to first office action of U.S. Pat. No. 7,015,868 dated on Jul. 1, 2011, Sterne Kessler Goldstein Fox, Oct. 3, 2011.
U.S. Appl. No. 95/001,390—Office Action for the U.S. Pat. No. 7,015,868 dated Aug. 19, 2010, USPTO, Aug. 19, 2010.
U.S. Appl. No. 95/001,390—Patent owner's rebuttal brief for U.S. Pat. No. 7,015,868, Edell, Shapiro & Finnan, Jul. 22, 2013.
U.S. Appl. No. 95/001,390—Patent owner's reponse to first office action of U.S. Pat. No. 7,015,868 dated on Jul. 1, 2011, Sterne Kessler Goldstein Fox, Oct. 3, 2011.
U.S. Appl. No. 95/001,390—Request for inter partes reexamination of U.S. Pat. No. 7,015,868 including exhibits CC-A-CC-G and OTH-A-OTH-B, Samsung, Jul. 2, 2010.
U.S. Appl. No. 95/001,390—Response to the Office Action for the U.S. Pat. No. 7,015,868 dated on Aug. 19, 2010, Sterne Kessler Goldstein Fox, Nov. 19, 2010.
U.S. Appl. No. 95/001,390—Third party requester's comments to patent owner's reply of Apr. 11, 2011 for U.S. Pat. No. 7,015,868, Samsung, Dec. 19, 2011.
U.S. Appl. No. 95/001,390—Third party requester's comments to patent owner's reply of Apr. 11, 2011 for U.S. Pat. No. 7,015,868, Samsung, May 2, 2011.
U.S. Appl. No. 95/001,390—Third party requester's replacement comments to patent owner's reply of Nov. 19, 2010 for U.S. Pat. No. 7,015,868, Samsung, Mar. 7, 2011.
U.S. Appl. No. 95/001,390—U.S. Appl. No. 95/000,589—Action closing prosecution dated Jul. 26, 2012 for U.S. Pat. No. 7,015,868, USPTO, Jul. 26, 2012.
U.S. Appl. No. 95/001,390—U.S. Appl. No. 95/000,589—Action closing prosecution for the U.S. Pat. No. 7,015,868, USPTO, Apr. 26, 2012.
U.S. Appl. No. 95/001,390—U.S. Appl. No. 95/000,589—Interpartes reexamination examiner's answer for the U.S. Pat. No. 7,015,868, USPTO, Jun. 21, 2013.
U.S. Appl. No. 95/001,390—U.S. Appl. No. 95/000,589—Patent owner's notice of appeal in inter partes reexamination for the U.S. Pat. No. 7,015,868, Edell , Shapiro & Finnan, Jan. 10, 2013.
U.S. Appl. No. 95/001,390—U.S. Appl. No. 95/000,589—Patent owner's petition requesting continued reexamination for U.S. Pat. No. 7,015,868, Edell , Shapiro & Finnan, Feb. 8, 2013.
U.S. Appl. No. 95/001,390—U.S. Appl. No. 95/000,589—Patent owner's reply to action closing prosecution mailed on Jul. 26, 2012 for U.S. Pat. No. 7,015,868, Edell , Shapiro & Finnan , LLC, Aug. 27, 2012.
U.S. Appl. No. 95/001,390—U.S. Appl. No. 95/000,589—Patent owner's reply to right of appeal notice for the U.S. Pat. No. 7,015,868, Edell , Shapiro & Finnan, Feb. 8, 2013.
U.S. Appl. No. 95/001,390—U.S. Appl. No. 95/000,589—Patents owner's appeal brief for the U.S. Pat. No. 7,015,868, Edell, Shapiro & Finnan, May 6, 2013.
U.S. Appl. No. 95/001,390—U.S. Appl. No. 95/000,589—Petition for suspension of interpartes reexamination proceedings including

(56) References Cited

OTHER PUBLICATIONS exhibits O-1 through O-19 for U.S. Pat. No. 7,015,868, Edell , Shapiro & Finnan , LLC, Oct. 1, 2012.
U.S. Appl. No. 95/001,390—U.S. Appl. No. 95/000,589—Response to the Action Closing Prosecution mailed on Apr. 26, 2012 for U.S. Pat. No. 7,015,868, Edell , Shapiro & Finnan , LLC, Jun. 26, 2012.
U.S. Appl. No. 95/001,390—U.S. Appl. No. 95/000,589—Right of appeal notice for the U.S. Pat. No. 7,015,868, USPTO, Dec. 10, 2012.
U.S. Appl. No. 95/001,390—U.S. Appl. No. 95/000,589—Third party requester's comments to patent owner's ACP reply for the U.S. Pat. No. 7,015,868 on Aug. 27, 2012, Edell , Shapiro & Finnan , LLC, Aug. 31, 2012.
U.S. Appl. No. 95/001,390—U.S. Appl. No. 95/000,589—Third party requester's respondent brief for the U.S. Pat. No. 7,015,868, Samsung—Kyocera, Jun. 6, 2013.
U.S. Appl. No. 95/001,390—U.S. Appl. No. 95/000,589—U.S. Appl. No. 95/001,498—Decision sua sponte to merge reexamination proceedings of U.S. Pat. No. 7,015,868, USPTO, May 23, 2011.
U.S. Appl. No. 95/001,390—U.S. Appl. No. 95/000,589—U.S. Appl. No. 95/001,498—Office action for U.S. Pat. No. 7,015,868 dated on Jul. 1, 2011, USPTO, Jul. 1, 2011.
U.S. Appl. No. 95/001,414—Third party requester's comments to patent owner's reply dated on Jan. 10, 2011 for U.S. Pat. No. 7,202,822, Samsung, Feb. 9, 2011.
U.S. Appl. No. 95/001,455—Corrected patent owner's response to office action for the U.S. Pat. No. 7,528,782 dated on Nov. 19, 2010, Sterne Kessler Goldstein Fox, Apr. 12, 2011.
U.S. Appl. No. 95/001,455—Corrected patent owner's response to office action for the U.S. Pat. No. 7,528,782 dated on Nov. 19, 2010—Exhibit 1, Sterne Kessler Goldstein Fox, Apr. 12, 2011.
U.S. Appl. No. 95/001,455—Office action for the U.S. Pat. No. 7,528,782 dated on Nov. 19, 2010, USPTO, Nov. 19, 2010.
U.S. Appl. No. 95/001,455—Request for inter partes reexamination of U.S. Pat. No. 7,528,782 including exhibits CCA-CCN, Samsung, Sep. 30, 2010.
U.S. Appl. No. 95/001,455—Response to office action for the U.S. Pat. No. 7,528,782 dated on Nov. 19, 2010, Sterne Kessler Goldstein Fox, Feb. 22, 2011.
U.S. Appl. No. 95/001,455—Response to office action for U.S. Pat. No. 7,528,782 dated on Nov. 19, 2010—Exhibits, Sterne Kessler Goldstein Fox, Feb. 22, 2011.
U.S. Appl. No. 95/001,455—Third party requester's comments to patent owner's reply of Feb. 22, 2011 for U.S. Pat. No. 7,528,782—, Samsung, Mar. 24, 2011.
U.S. Appl. No. 95/001,455—Third party requester's comments to patent owner's reply of Feb. 22, 2011 for U.S. Pat. No. 7,528,782, Samsung, Apr. 28, 2011.
U.S. Appl. No. 95/001,455—U.S. Appl. No. 95/000,595—Action closing prosecution for the U.S. Pat. No. 7,528,782, USPTO, Apr. 26, 2012.
U.S. Appl. No. 95/001,455—U.S. Appl. No. 95/000,595—Action closing prosecution for U.S. Pat. No. 7,528,782 dated Jul. 27, 2012, USPTO, Jul. 27, 2012.
U.S. Appl. No. 95/001,455—U.S. Appl. No. 95/000,595—Patent owner's appeal brief for the U.S. Pat. No. 7,528,782, Edell, Shapiro & Finnan, LLC, Mar. 25, 2013.
U.S. Appl. No. 95/001,455—U.S. Appl. No. 95/000,595—Patent owner's appeal brief for the U.S. Pat. No. 7,528,782—Exhibits, Edell , Shapiro & Finnan, Mar. 25, 2013.
U.S. Appl. No. 95/001,455—U.S. Appl. No. 95/000,595—Patent owner's notice of appeal in inter partes reexamination for the U.S. Pat. No. 7,528,782, Edell , Shapiro & Finnan, Jan. 10, 2013.
U.S. Appl. No. 95/001,455—U.S. Appl. No. 95/000,595—Patent owner's rebuttal brief for the U.S. Pat. No. 7,528,782, Edell , Shapiro & Finnan, Jul. 8, 2013.
U.S. Appl. No. 95/001,455—U.S. Appl. No. 95/000,595—Patent owner's reply to action closing prosecution mailed for the U.S. Pat. No. 7,528,782 on Jul. 27, 2012, Edell , Shapiro & Finnan , LLC, Aug. 27, 2012.
U.S. Appl. No. 95/001,455—U.S. Appl. No. 95/000,595—Response to the Action Closing Prosecution mailed on Apr. 26, 2012 for U.S. Pat. No. 7,528,782, Edell , Shapiro & Finnan , LLC, Jun. 26, 2012.
U.S. Appl. No. 95/001,455—U.S. Appl. No. 95/000,595—Right of appeal notice for the U.S. Pat. No. 7,528,782, USPTO, Dec. 10, 2012.
U.S. Appl. No. 95/001,455—U.S. Appl. No. 95/000,595—Third party requester's comments to patent owner's reply for the U.S. Pat. No. 7,528,782 on Aug. 27, 2012, Samsung—Kyocera, Sep. 26, 2012.
U.S. Appl. No. 95/001,455—U.S. Appl. No. 95/000,595—Third party requester's comments to patent owner's reply of Oct. 31, 2011 pursant to 37 CFR 1947 for U.S. Pat. No. 7,528,782, Samsung—Kyocera, Feb. 1, 2012.
U.S. Appl. No. 95/001,455—U.S. Appl. No. 95/000,595—Third party requester's comments to patent owner's reply of Oct. 31, 2011 pursant to 37 CFR 1947 for U.S. Pat. No. 7,528,782—Exhibits, Samsung—Kyocera, Feb. 1, 2012.
U.S. Appl. No. 95/001,455—U.S. Appl. No. 95/000,595—Third party requester's notice of cross-appeal for the U.S. Pat. No. 7,528,782, Samsung—Kyocera, Jan. 24, 2013.
U.S. Appl. No. 95/001,455—U.S. Appl. No. 95/000,595—U.S. Appl. No. 95/001,499—Office Action for U.S. Pat. No. 7,528,782 dated on Jul. 29, 2011, USPTO, Jul. 29, 2011.
U.S. Appl. No. 95/001,455—U.S. Appl. No. 95/000,595—U.S. Appl. No. 95/001,499—Response to office action dated on Jul. 29, 2011 of U.S. Pat. No. 7,528,782, Sterne Kessler Goldstein Fox, Oct. 31, 2011.
U.S. Appl. No. 95/001,455—U.S. Appl. No. 95/000,595 , U.S. Appl. No. 95/001,499—Decision sua sponte to merge reexamination proceedings of U.S. Pat. No. 7,528,782, USPTO, May 24, 2011.
U.S. Appl. No. 95/001,455—U.S. Appl. No. 95/000,595—Third party requester's respondent brief for the U.S. Pat. No. 7,528,782, Samsung—Kyocera, Apr. 25, 2013.
U.S. Appl. No. 95/001,482—Action closing prosecution for U.S. Pat. No. 7,397,431 dated on Dec. 1, 2011, USPTO, Dec. 1, 2011.
U.S. Appl. No. 95/001,482—Request for inter partes reexamination of U.S. Pat. No. 7,397,431 including exhibits CC-A-CC-L, Samsung, Nov. 11, 2010.
U.S. Appl. No. 95/001,482—Third party requester's comments to patent owner's reply of Aug. 15, 2011 for U.S. Pat. No. 7,397,431, Samsung, Sep. 14, 2011.
U.S. Appl. No. 95/001,482—U.S. Appl. No. 95/000,586—Corrected patent owner's Appeal Brief for U.S. Pat. No. 7,397,431, Edell, Shapiro & Finnan , LLC, Feb. 22, 2013.
U.S. Appl. No. 95/001,482—U.S. Appl. No. 95/000,586—Patent Owner amendment in response to the right of appeal notice for the U.S. Pat. No. 7,397,431 mailed on Jun. 1, 2012, Edell , Shapiro & Finnan , LLC, Jul. 2, 2012.
U.S. Appl. No. 95/001,482—U.S. Appl. No. 95/000,586—Patent owner's Appeal Brief—Exhibits—for U.S. Pat. No. 7,397,431, Edell , Shapiro & Finnan , LLC, Nov. 13, 2012.
U.S. Appl. No. 95/001,482—U.S. Appl. No. 95/000,586—Patent owner's Appeal Brief for U.S. Pat. No. 7,397,431, Edell, Shapiro & Finnan , LLC, Nov. 13, 2012.
U.S. Appl. No. 95/001,482—U.S. Appl. No. 95/000,586—Patent owner's rebuttal brief for U.S. Pat. No. 7,397,431, Edell, Shapiro & Finnan, LLC, Aug. 16, 2013.
U.S. Appl. No. 95/001,482—U.S. Appl. No. 95/000,586—Patent owner's response to the Action Closing Prosecution of Dec. 1, 2011 for U.S. Pat. No. 7,397,431, Sterne Kessler Goldstein Fox, Jan. 3, 2012.
U.S. Appl. No. 95/001,482—U.S. Appl. No. 95/000,586—Petition for suspension of inter partes reexamination proceedings dated on Aug. 1, 2012 for U.S. Pat. No. 7,397,431, Edell , Shapiro & Finnan , LLC, Aug. 1, 2012.
U.S. Appl. No. 95/001,482—U.S. Appl. No. 95/000,586—Petition to terminate Inter Partes Reexamination for the U.S. Pat. No. 7,397,431 dated on Jul. 31, 2012, Edell , Shapiro & Finnan , LLC, Jul. 31, 2012.
U.S. Appl. No. 95/001,482—U.S. Appl. No. 95/000,586—Response to the Right of Appeal Notice (RAN) for the U.S. Pat. No. 7,397,431 mailed on Aug. 9, 2012, Edell , Shapiro & Finnan , LLC, Sep. 10, 2012.
U.S. Appl. No. 95/001,482—U.S. Appl. No. 95/000,586—Right of Appeal Notice for the U.S. Pat. No. 7,397,431 dated on Jan. 6, 2012, USPTO, Jun. 1, 2012.

(56) References Cited

OTHER PUBLICATIONS

U.S. Appl. No. 95/001,482—U.S. Appl. No. 95/000,586—Right of appeal notice for U.S. Pat. No. 7,397,431 dated on Aug. 9, 2012, USPTO, Aug. 9, 2012.
U.S. Appl. No. 95/001,482—U.S. Appl. No. 95/000,586—Third party requester's corrected respondent brief for the U.S. Pat. No. 7,397,431, Samsung—Kyocera, Apr. 16, 2013.
U.S. Appl. No. 95/001,482—U.S. Appl. No. 95/000,586—Third party requester's notice of cross-appeal for the U.S. Pat. No. 7,397,431 dated on Jul. 6, 2012, Samsung—Kyocera, Jul. 6, 2012.
U.S. Appl. No. 95/001,482—U.S. Appl. No. 95/000,586—Third party requester's notice of cross-appeal for the U.S. Pat. No. 7,397,431 issued on Jun. 1, 2012, Samsung—Kyocera, Sep. 11, 2012.
U.S. Appl. No. 95/001,482—U.S. Appl. No. 95/000,586—Third party requester's opposition to patent owner's petition for suspension for U.S. Pat. No. 7,397,431 filed on Aug. 1, 2012, Samsung—Kyocera, Aug. 30, 2012.
U.S. Appl. No. 95/001,482—U.S. Appl. No. 95/000,586—Third party requester's respondent brief for the U.S. Pat. No. 7,397,431, Samsung—Kyocera, Mar. 8, 2013.
U.S. Appl. No. 95/001,482—U.S. Appl. No. 95/000,586—Third party requester's respondent brief for U.S. Pat. No. 7,397,431 issued on Aug. 9, 2012, USPTO, Dec. 13, 2012.
U.S. Appl. No. 95/001,482—U.S. Appl. No. 95/000,586—U.S. Appl. No. 95/001,497—Decision sua sponte to merge reexamination proceedings of U.S. Pat. No. 7,397,431, USPTO, May 4, 2011.
U.S. Appl. No. 95/001,482—U.S. Appl. No. 95/000,586—U.S. Appl. No. 95/001,497—Exhibits of response to first office action dated on May 13, 2011 for U.S. Pat. No. 7,397,431, Sterne Kessler Goldstein Fox, Aug. 15, 2011.
U.S. Appl. No. 95/001,482—U.S. Appl. No. 95/000,586—U.S. Appl. No. 95/001,497—Office Action in inter partes reexamination dated on May 13, 2011 for the U.S. Pat. No. 7,397,431, USPTO, May 13, 2011.
U.S. Appl. No. 95/001,482—U.S. Appl. No. 95/000,586—U.S. Appl. No. 95/001,497—Response to first office action dated on May 13, 2011 for U.S. Pat. No. 7,397,431, Sterne Kessler Goldstein Fox, Aug. 15, 2011.
U.S. Appl. No. 95/001,482—U.S. Appl. No. 95/000,586—U.S. Appl. No. 95/001,497—Third party requester's comments to patent owner's reply of Jan. 3, 2012 for U.S. Pat. No. 7,397,431, Samsung—Kyocera—HTC, Feb. 2, 2012.
U.S. Appl. No. 95/001,483—Request for inter partes reexamination of U.S. Pat. No. 7,394,432 including exhibits CC-A-CC-L, Samsung, Nov. 11, 2010.
U.S. Appl. No. 95/001,483—U.S. Appl. No. 95/000,586—Third party requester's notice of cross-appeal for the U.S. Pat. No. 7,394,432, Samsung—Kyocera, Jan. 22, 2013.
U.S. Appl. No. 95/001,483—U.S. Appl. No. 95/000,588—Action closing prosecution dated Aug. 2, 2012 for U.S. Pat. No.7,394,432, USPTO, Aug. 2, 2012.
U.S. Appl. No. 95/001,483—U.S. Appl. No. 95/000,588—Corrected Reply to the action closing prosecution dated on Mar. 7, 2012 for the U.S. Pat. No. 7,394,432, Sterne Kessler Goldstein Fox, Apr. 9, 2012.
U.S. Appl. No. 95/001,483—U.S. Appl. No. 95/000,588—Corrected Third party requester's comments to patent owner's reply of Apr. 9, 2012 for the U.S. Pat. No. 7,394,432, USPTO, May 9, 2012.
U.S. Appl. No. 95/001,483—U.S. Appl. No. 95/000,588—Patent owner's petition requesting continued reexamination for U.S. Pat. No. 7,394,432, Edell , Shapiro & Finnan, LLC, Feb. 8, 2013.
U.S. Appl. No. 95/001,483—U.S. Appl. No. 95/000,588—Patent owner's rebuttal brief for U.S. Pat. No. 7,394,432, Edell, Shapiro & Finnan, LLC, Aug. 5, 2013.
U.S. Appl. No. 95/001,483—U.S. Appl. No. 95/000,588—Patent owner's reply to right of appeal notice for the U.S. Pat. No. 7,394,432, Edell , Shapiro & Finnan, Feb. 8, 2013.
U.S. Appl. No. 95/001,483—U.S. Appl. No. 95/000,588—Patent owner's response to the Action Closing Prosecution of Nov. 4, 2011 for U.S. Pat. No. 7,394,432, Sterne Kessler Goldstein Fox, Jan. 4, 2012.
U.S. Appl. No. 95/001,483—U.S. Appl. No. 95/000,588—Patents owner's appeal brief for the U.S. Pat. No. 7,394,432, Edell, Shapiro & Finnan, May 6, 2013.
U.S. Appl. No. 95/001,483—U.S. Appl. No. 95/000,588—Petition for suspension of Interpartes Reexamination Proceedings including exhibits O-1 through O-19 for U.S. Pat. No.7,394,432, Edell , Shapiro & Finnan , LLC, Oct. 5, 2012.
U.S. Appl. No. 95/001,483—U.S. Appl. No. 95/000,588—Reply to ACP including exhibits O-1 through O-10 for U.S. Pat. No. 7,394,432, Edell , Shapiro & Finnan , LLC, Oct. 2, 2012.
U.S. Appl. No. 95/001,483—U.S. Appl. No. 95/000,588—Response to the right of appeal notice for the U.S. Pat. No. 7,394,432, Edell , Shapiro & Finnan, Jan. 7, 2013.
U.S. Appl. No. 95/001,483—U.S. Appl. No. 95/000,588—Right of appeal notice for the U.S. Pat. No. 7,394,432, USPTO, Dec. 6, 2012.
U.S. Appl. No. 95/001,483—U.S. Appl. No. 95/000,588—Third party requester's respondent brief for the U.S. Pat. No. 7,394,432, Samsung—Kyocera, Jun. 6, 2013.
U.S. Appl. No. 95/001,483—U.S. Appl. No. 95/000,588—U.S. Appl. No. 95/001,500—Action closing prosecution for U.S. Pat. No. 7,394,432 dated on Nov. 4, 2011, USPTO, Nov. 4, 2011.
U.S. Appl. No. 95/001,483—U.S. Appl. No. 95/000,588—U.S. Appl. No. 95/001,500—Corrected Action closing prosection for U.S. Pat. No. 7,394,432 dated on Mar. 7, 2012, USPTO, Mar. 7, 2012.
U.S. Appl. No. 95/001,483—U.S. Appl. No. 95/000,588—U.S. Appl. No. 95/001,500—Decision sua sponte to merge reexamination proceedings of U.S. Pat. No. 7,394,432, USPTO, Mar. 17, 2011.
U.S. Appl. No. 95/001,483—U.S. Appl. No. 95/000,588—U.S. Appl. No. 95/001,500—Exhibits from Third party requester's comments to patent owner's reply of Jul. 7, 2011 of U.S. Pat. No. 7,394,432, Samsung—Kyocera—HTC, Aug. 8, 2011.
U.S. Appl. No. 95/001,483—U.S. Appl. No. 95/000,588—U.S. Appl. No. 95/001,500—Office action in inter partes reexamination for the U.S. Pat. No. 7,394,432, USPTO, Apr. 7, 2011.
U.S. Appl. No. 95/001,483—U.S. Appl. No. 95/000,588—U.S. Appl. No. 95/001,500—Response to office action dated on Apr. 7 , 2011 for U.S. Pat. No. 7,394,432, Sterne Kessler Goldstein Fox, Jul. 7, 2011.
U.S. Appl. No. 95/001,483—U.S. Appl. No. 95/000,588—U.S. Appl. No. 95/001,500—Third party requester's comments to patent owner's reply of Jul. 7, 2011 of U.S. Pat. No. 7,394,432, Samsung—Kyocera—HTC, Aug. 8, 2011.
U.S. Appl. No. 95/001,483—U.S. Appl. No. 95/000,588—U.S. Appl. No. 95/001,500—Third party requester's comments to patent owner's reply of Jan. 4, 2012 pursant to 37 CFR 1947 for U.S. Pat. No. 7,394,432, Samsung—Kyocera—HTC, Feb. 3, 2012.
U.S. Appl. No. 95/001,497—Request for inter partes reexamination of U.S. Pat. No. 7,397,431 including exhibits C1-C5, HTC, Dec. 3, 2010.
U.S. Appl. No. 95/001,498—Request for inter partes reexamination of U.S. Pat. No. 7,015,868 including exhibits C1-C6, HTC, Dec. 3, 2010.
U.S. Appl. No. 95/001,499—Request for inter partes reexamination of U.S. Pat. No. 7,528,782 including exhibits C1-C6, HTC, Dec. 3, 2010.
U.S. Appl. No. 95/001,500—Request for inter partes reexamination of U.S. Pat. No. 7,394,432 including exhibits C1-C5, HTC, Dec. 3, 2010.
U.S. Appl. No. 95/001,501—Request for inter partes reexamination of U.S. Pat. No. 7,123,208 including exhibits C1-C7, HTC, Dec. 3, 2010.
Infringement Chart—LG VX8560 Chocolate 3. U.S. Pat. No. 7,528,782, Fractus, Nov. 5, 2009.
Infringement Chart—LG VX8610, Fractus, Nov. 5, 2009.
Infringement Chart—LG VX8610. U.S. Pat. No. 7,0158,68, Fractus, Nov. 5, 2009.
Infringement Chart—LG VX8610. U.S. Pat. No. 7,123,208, Fractus, Nov. 5, 2009.
Infringement Chart—LG VX8610. U.S. Pat. No. 7,397,431, Fractus, Nov. 5, 2009.

(56) References Cited

OTHER PUBLICATIONS

Infringement Chart—LG VX8610. U.S. Pat. No. 7,528,782, Fractus, Nov. 5, 2009.
Infringement Chart—LG VX8800, Fractus, Nov. 5, 2009.
Infringement Chart—LG VX8800. U.S. Pat. No. 7,015,868, Fractus, Nov. 5, 2009.
Infringement Chart—LG VX8800. U.S. Pat. No. 7,123,208, Fractus, Nov. 5, 2009.
Infringement Chart—LG VX8800. U.S. Pat. No. 7,397,431, Fractus, Nov. 5, 2009.
Infringement Chart—LG VX8800. U.S. Pat. No. 7,528,782, Fractus, Nov. 5, 2009.
Infringement Chart—LG VX9400, Fractus, Nov. 5, 2009.
Infringement Chart—LG VX9400. U.S. Pat. No. 7,015,868, Fractus, Nov. 5, 2009.
Infringement Chart—LG VX9400. U.S. Pat. No. 7,123,208, Fractus, Nov. 5, 2009.
Infringement Chart—LG VX9400. U.S. Pat. No. 7,394,432, Fractus, Nov. 5, 2009.
Infringement Chart—LG VX9400. U.S. Pat. No. 7,397,431, Fractus, Nov. 5, 2009.
Infringement Chart—LG VX9400. U.S. Pat. No. 7,528,782, Fractus, Nov. 5, 2009.
Infringement Chart—LG Xenon GR500., Fractus, Nov. 5, 2009.
Infringement Chart—LG Xenon GR500. U.S. Pat. No. 7,015,868, Fractus, Nov. 5, 2009.
Infringement Chart—LG Xenon GR500. U.S. Pat. No. 7,123,208, Fractus, Nov. 5, 2009.
Infringement Chart—LG Xenon GR500. U.S. Pat. No. 7,394,432, Fractus, Nov. 5, 2009.
Infringement Chart—LG Xenon GR500. U.S. Pat. No. 7,397,431, Fractus, Nov. 5, 2009.
Infringement Chart—LG Xenon GR500. U.S. Pat. No. 7,528,782, Fractus, Nov. 5, 2009.
Infringement Chart—Palm Centro 685, Fractus, Nov. 5, 2009.
Infringement Chart—Palm Centro 685. U.S. Pat. No. 7,015,868, Fractus, Nov. 5, 2009.
Infringement Chart—Palm Centro 685. U.S. Pat. No. 7,123,208, Fractus, Nov. 5, 2009.
Infringement Chart—Palm Centro 685. U.S. Pat. No. 7,394,432, Fractus, Nov. 5, 2009.
Infringement Chart—Palm Centro 685. U.S. Pat. No. 7,397,431, Fractus, Nov. 5, 2009.
Infringement Chart—Palm Centro 685. U.S. Pat. No. 7,528,782, Fractus, Nov. 5, 2009.
Infringement Chart—Palm Centro 690, Fractus, Nov. 5, 2009.
Infringement Chart—Palm Centro 690. U.S. Pat. No. 7,015,868, Fractus, Nov. 5, 2009.
Infringement Chart—Palm Centro 690. U.S. Pat. No. 7,123,208, Fractus, Nov. 5, 2009.
Infringement Chart—Palm Centro 690. U.S. Pat. No. 7,397,431, Fractus, Nov. 5, 2009.
Infringement Chart—Palm Centro 690. U.S. Pat. No. 7,528,782, Fractus, Nov. 5, 2009.
Infringement Chart—Palm Pre, Fractus, Nov. 5, 2009.
Infringement Chart—Palm Pre. U.S. Appl. No. 7,015,868, Fractus, Nov. 5, 2009.
Infringement Chart—Palm Pre. U.S. Pat. No. 7,123,208, Fractus, Nov. 5, 2009.
Infringement Chart—Palm Pre. U.S. Pat. No. 7,397,431, Fractus, Nov. 5, 2009.
Infringement Chart—Palm Pre. U.S. Pat. No. 7,528,782, Fractus, Nov. 5, 2009.
Infringement Chart—Pantech Breeze C520., Fractus, Nov. 5, 2009.
Infringement Chart—Pantech Breeze C520. U.S. Pat. No. 7,015,868, Fractus, Nov. 5, 2009.
Infringement Chart—Pantech Breeze C520. U.S. Pat. No. 7,123,208, Fractus, Nov. 5, 2009.
Infringement Chart—Pantech C610, Fractus, Nov. 5, 2009.
Infringement Chart—Pantech C610. U.S. Pat. No. 7,015,868, Fractus, Nov. 5, 2009.
Infringement Chart—Pantech C610. U.S. Pat. No. 7,123,208, Fractus, Nov. 5, 2009.
Infringement Chart—Pantech C610. U.S. Pat. No. 7,394,432, Fractus, Nov. 5, 2009.
Infringement Chart—Pantech C610. U.S. Pat. No. 7,397,431, Fractus, Nov. 5, 2009.
Infringement Chart—Pantech C610. U.S. Pat. No. 7,528,782, Fractus, Nov. 5, 2009.
Infringement Chart—Pantech C740, Fractus, Nov. 5, 2009.
Infringement Chart—Pantech C740. U.S. Pat. No. 7,015,868, Fractus, Nov. 5, 2009.
Infringement Chart—HTC My Touch. U.S. Pat. No. 7,394,432, Fractus, Nov. 5, 2009.
Infringement Chart—HTC My Touch. U.S. Pat. No. 7,397,431, Fractus, Nov. 5, 2009.
Infringement Chart—HTC My Touch. U.S. Pat. No. 7,528,782, Fractus, Nov. 5, 2009.
Infringement Chart—HTC Ozone, Fractus, Nov. 5, 2009.
Infringement Chart—HTC Ozone. U.S. Pat. No. 7,015,868, Fractus, Nov. 5, 2009.
Infringement Chart—HTC Ozone. U.S. Pat. No. 7,123,208, Fractus, Nov. 5, 2009.
Infringement Chart—HTC Ozone. U.S. Pat. No. 7,394,432, Fractus, Nov. 5, 2009.
Infringement Chart—HTC Ozone. U.S. Pat. No. 7,397,431, Fractus, Nov. 5, 2009.
Infringement Chart—HTC Ozone. U.S. Pat. No. 7,528,782, Fractus, Nov. 5, 2009.
Infringement Chart—HTC Pure, Fractus, Nov. 5, 2009.
Infringement Chart—HTC Pure. U.S. Pat. No. 7,015,868, Fractus, Nov. 5, 2009.
Infringement Chart—HTC Pure. U.S. Pat. No. 7,123,208, Fractus, Nov. 5, 2009.
Infringement Chart—HTC Pure. U.S. Pat. No. 7,394,432, Fractus, Nov. 5, 2009.
Infringement Chart—HTC Pure. U.S. Pat. No. 7,397,431, Fractus, Nov. 5, 2009.
Infringement Chart—HTC Pure. U.S. Pat. No. 7,528,782, Fractus, Nov. 5, 2009.
Infringement Chart—HTC Snap, Fractus, Nov. 5, 2009.
Infringement Chart—HTC Snap. U.S. Pat. No. 7,015,868, Fractus, Nov. 5, 2009.
Infringement Chart—HTC Snap. U.S. Pat. No. 7,123,208, Fractus, Nov. 5, 2009.
Infringement Chart—HTC Snap. U.S. Pat. No. 7,397,431, Fractus, Nov. 5, 2009.
Infringement Chart—HTC Snap. U.S. Pat. No. 7,528,782, Fractus, Nov. 5, 2009.
Infringement Chart—HTC TILT 8925., Fractus, Nov. 5, 2009.
Infringement Chart—HTC TILT 8925. U.S. Pat. No. 7,015,868, Fractus, Nov. 5, 2009.
Infringement Chart—HTC TILT 8925. U.S. Pat. No. 7,123,208, Fractus, Nov. 5, 2009.
Infringement Chart—HTC TILT 8925. U.S. Pat. No. 7,394,432, Fractus, Nov. 5, 2009.
Infringement Chart—HTC TILT 8925. U.S. Pat. No. 7,397,431, Fractus, Nov. 5, 2009.
Infringement Chart—HTC TILT 8925. U.S. Pat. No. 7,528,782, Fractus, Nov. 5, 2009.
Infringement Chart—HTC Touch Pro 2, Fractus, Nov. 5, 2009.
Infringement Chart—HTC Touch Pro 2. U.S. Pat. No. 7,015,868, Fractus, Nov. 5, 2009.
Infringement Chart—HTC Touch Pro 2. U.S. Pat. No. 7,123,208, Fractus, Nov. 5, 2009.
Infringement Chart—HTC Touch Pro 2. U.S. Pat. No. 7,394,432, Fractus, Nov. 5, 2009.
Infringement Chart—HTC Touch Pro 2. U.S. Pat. No. 7,397,431, Fractus, Nov. 5, 2009.
Infringement Chart—HTC Touch Pro 2. U.S. Pat. No. 7,528,782, Fractus, Nov. 5, 2009.

(56) References Cited

OTHER PUBLICATIONS

Infringement Chart—HTC Touch Pro Fuze, Fractus, Nov. 5, 2009.
Infringement Chart—HTC Touch Pro Fuze. U.S. Pat. No. 7,015,868, Fractus, Nov. 5, 2009.
Infringement Chart—HTC Touch Pro Fuze. U.S. Pat. No. 7,123,208, Fractus, Nov. 5, 2009.
Infringement Chart—HTC Touch Pro Fuze. U.S. Pat. No. 7,394,432, Fractus, Nov. 5, 2009.
Infringement Chart—HTC Touch Pro Fuze. U.S. Pat. No. 7,397,431, Fractus, Nov. 5, 2009.
Infringement Chart—HTC Touch Pro Fuze. U.S. Pat. No. 7,528,782, Fractus, Nov. 5, 2009.
Infringement Chart—HTC Touch Pro., Fractus, Nov. 5, 2009.
Infringement Chart—HTC Touch Pro. U.S. Pat. No. 7,015,868, Fractus, Nov. 5, 2009.
Infringement Chart—HTC Touch Pro. U.S. Pat. No. 7,123,208, Fractus, Nov. 5, 2009.
Infringement Chart—HTC Touch Pro. U.S. Pat. No. 7,397,431, Fractus, Nov. 5, 2009.
Infringement Chart—HTC Touch Pro. U.S. Pat. No. 7,528,782, Fractus, Nov. 5, 2009.
Infringement Chart—HTC Wing, Fractus, Nov. 5, 2009.
Infringement Chart—HTC Wing. U.S. Pat. No. 7,015,868, Fractus, Nov. 5, 2009.
Infringement Chart—HTC Wing. U.S. Pat. No. 7,123,208, Fractus, Nov. 5, 2009.
Infringement Chart—HTC Wing. U.S. Pat. No. 7,394,432, Fractus, Nov. 5, 2009.
Infringement Chart—HTC Wing. U.S. Pat. No. 7,397,431, Fractus, Nov. 5, 2009.
Infringement Chart—HTC Wing. U.S. Pat. No. 7,528,782, Fractus, Nov. 5, 2009.
Infringement Chart—Kyocera Jax, Fractus, Nov. 5, 2009.
Document 0297—Defendant HTC Corporation's amended answer and counterclaim to plaintiff's second amended complaint, Defendants, Feb. 25, 2010.
Document 0298—Defendant HTC America, Inc.'s amended answer and counterclaim to plaintiff's second amended complaint, Defendants, Feb. 25, 2010.
Document 0351—Plaintiff Fractus, S. A.'s answer to amended counterclaims of defendant Samsung Telecommunications America LLC's to Fractus's Second Amended Complaint, Susman Godfrey, Apr. 1, 2010.
Document 0352—Plaintiff Fractus, S. A.'s answer to amended counterclaims of defendant HTC Corporation to Fractus's Second Amended Complaint, Susman Godfrey, Apr. 1, 2010.
Document 0353—Plaintiff Fractus, S. A.'s answer to amended counterclaims of defendant HTC America, Inc. To Fractus's Second Amended Complaint, Susman Godfrey, Apr. 1, 2010.
Document 0354—Plaintiff Fractus, S. A.'s answer to amended counterclaims of defendant LG Electronics Inc., LG Electronics USA, Inc., and LG Electronics Mobilecomm USA Inc's to Fractus's Second Amended Complaint, Susman Godfrey, Apr. 1, 2010.
Document 0415—P.R. 4-3 joint claim construction statement, Susman Godfrey, Jun. 14, 2010.
Document 0423—Fractus SA's Opening Claim Construction Brief with Parties' Proposed and Agreed Constructions in the case of *Fractus SA* v. *Samsung Electornics Co. Ltd. et al.*, Susman Godfrey, Jul. 16, 2010.
Document 0428—Response of defendants Kyocera Communications, Inc; Palm Inc. and UTStarcom, Inc. to plaintiff Fractus SA's opening claim construction brief in "Case 6:09-cv-00203-LED-JDL", Defendants, Jul. 30, 2010.
Document 0429—Declaration of Jeffery D. Baxter—Including Exhibits: J, K, L, M ,N ,O, P, Q, R, S, T, U, Z, AA, KK, LL, Defendants, Jul. 30, 2010.
Document 0430—Defendants RIM, Samsung, HTC, LG and Pantech's response to plaintiff Fractus SA's opening claim construction brief, Defendants, Jul. 30, 2010.
Document 0430—Defendants RIM, Samsung, HTC, LG and Pantech's response to plaintiff Fractus SA's opening claim construction brief—Exhibit 1—Chart of Agreed Terms and Disputed Terms, Defendants, Jul. 30, 2010.
Document 0430—Defendants RIM, Samsung, HTC, LG and Pantech's response to plaintiff Fractus SA's opening claim construction brief—Exhibit 2—Family Tree of Asserted Patents, Defendants, Jul. 30, 2010.
Document 0430—Defendants RIM, Samsung, HTC, LG and Pantech's response to plaintiff Fractus SA's opening claim construction brief—Exhibit 33—Excerpt from Plaintiff's '868 pat. inf.cont. For Samsung SPH M540, Defendants, Jul. 30, 2010.
Document 0430—Defendants RIM, Samsung, HTC, LG and Pantech's response to plaintiff Fractus SA's opening claim construction brief—Exhibit 34—Excerpts from Plaintiff's '431 patent Infringement Contentions of HTC Diamond, Defendants, Jul. 30, 2010.
Document 0430—Defendants RIM, Samsung, HTC, LG and Pantech's response to plaintiff Fractus SA's opening claim construction brief—Exhibit 41—Demonstrative re: counting segments, Defendants, Jul. 30, 2010.
Document 0430—Defendants RIM, Samsung, HTC, LG and Pantech's response to plaintiff Fractus SA's opening claim construction brief—Exhibit 42—Demonstrative showing how straight segments can be fitted over a curved surface, Defendants, Jul. 30, 2010.
Document 0430—Defendants RIM, Samsung, HTC, LG and Pantech's response to plaintiff Fractus SA's opening claim construction brief—Exhibit 57—Excerpts from Plaintiff's '868 and '762 Pat. Int. cont. for RIM 8310, Defendants, Jul. 30, 2010.
Document 0440—Fractus's opposition to defendants' motion for summary judgement of invalidity based on indefiniteness and lack of written description for certain terms, Susman Godfrey, Aug. 16, 2010.
Document 0440-1—Expert declaration by Dr. D. Jaggard including exhibits (curriculum and datasheets from Cushcraft, Antenova, Ethertronics and Taoglas), Susman Godfrey, Aug. 16, 2010.
Document 0440-2—Declaration of Micah Howe in support of Fractus SA opposition to defendants' motion for summary judgement of invalidity based on indefiniteness and lack of written description for certain terms, Heim , Payne and Chorus LLP, Aug. 16, 2010.
Document 0452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, Defendants, Aug. 30, 2010.
Document 0475—Order. Provisional claim construction and motion for summary judgement. Provisional markman order, Court, Nov. 9, 2010.
Document 0526—Memorandum order and opinion, Court, Dec. 17, 2010.
Document 0575—Fractus 's Objections to claim construction memorandum and order, Susman Godfrey, Nov. 14, 2011.
Document 0582—Memorandum opinion and order, Court, Jan. 20, 2011.
Document 0583—Defendant's notice of compliance regarding second amended invalidity contentions, Defendants, Jan. 21, 2011.
Document 0607—Declaration of Thomas E. Nelson—Exhibit A—Antenna photos, Defendants, Feb. 3, 2011.
Document 0609—Fractus' reply to defendant's motion for reconsideration of, and objections to, magistrate Judge Love's markman order, Susman Godfrey, Feb. 4, 2011.
Document 0611—Report and recommendation of United States magistrate judge, Court, Feb. 8, 2011.
Document 0622—Order adopting report and recommendation of magistrate judge, Court, Feb. 11, 2011.
Document 0624—Notice of compliance with motion practice orders, Susman Godfrey, Feb. 14, 2011.
Document 0641—Defendant HTC America, Inc's second amended answer and counterclaim to plaintiff's second amended complaint, Defendants, Feb. 25, 2011.
Document 0642—Defendant HTC Corporation's second amended answer and counterclaim to plaintiff's second amended complaint, Defendants, Feb. 25, 2011.

(56) References Cited

OTHER PUBLICATIONS

Document 0645—Reply brief in support of Defendant's motion for reconsideration of the court's ruling on the term "at least a portion" in the court's Dec. 17, 2010 claim construction order based on newly-available evidence, Defendants, Feb. 25, 2011.
Document 0647—Defendants Samsung Electronics Co LTD (et al) second amended answer and counterclaims to the second amended complaint of plaintiff Fractus SA—Document 647, Defendants, Feb. 28, 2011.
Document 0649—Defendants LG Electronics Inc, LG Electronics USA, and LG Electronics Mobilecomm USA Inc's second amended answer and counterclaim to second amended complaint, Defendants, Feb. 28, 2011.
Document 0657—Defendant Pantech Wireless Inc amended answer, affirmative defenses, and counterclaims to Fractus' second amended complaint, Defendants, Feb. 28, 2011.
Document 0666—Fractus's sur-reply to defendants' motion for reconsideration of the court's Dec. 17, 2010 claim construction order based on newly-available evidence, Susman Godfrey, Mar. 8, 2011.
Document 0670—Order, Court, Mar. 9, 2011.
Document 0678—Plaintiff Fractus SA's answer to second amended counterclaims of defendant HTC Corporation to Fractus's second amended complaint, Susman Godfrey, Mar. 14, 2011.
Document 0680—Plaintiff Fractus SA's answer to second amended counterclaims of defendant HTC to Fractus's second amended complaint, Susman Godfrey, Mar. 14, 2011.
Document 0694—Plaintiff Fractus SA's answer to second amended counterclaims of defendant LG Electronics to Fractus's second amended complaint, Susman Godfrey, Mar. 15, 2011.
Document 0695—Plaintiff Fractus SA's answer to second amended counterclaims of defendant Samsung to Fractus's second amended complaint, Susman Godfrey, Mar. 15, 2011.
Document 0696—Plaintiff Fractus SA's answer to amended counterclaims of defendant Pantech Wireless Inc to Fractus's second amended complaint, Susman Godfrey, Mar. 15, 2011.
Document 0715—Letter to John D. Love—Permission to file a summary judgment motion of no indefiniteness on the issues wher the Court's Report and Recommendation already has held that the claim term is not indefinite, Susman Godfrey, Mar. 18, 2011.
Document 0716—Letter to John D. Love—Permission to file a partial summary judgement motion on infringement., Susman Godfrey , LLP, Mar. 18, 2011.
Document 0721—Letter to John D. Love—Permission to file a motion for summary judgment of invalidity of the following 7 asserted claims from the MLV, patent family . . . , Defendants—Baker Botts, LLP, Mar. 18, 2011.
Document 0768—Fractus, S.A.'s objections to the Court's Mar. 9, 2011, Order, Susman Godfrey, Mar. 25, 2011.
Document 0780—Defendants' opposition to Fractus SA objections to the Court's Mar. 9, 2011 Order, Defendants—Baker Botts, LLP, Mar. 31, 2011.
Document 0032—Defendants LG Electronics Mobilecomm USA., Inc.'s answer and counterclaim to complaint, Defendants, Oct. 1, 2009.
Document 0064—Defendant Pantech Wireless, Inc.'s answer, affirmative defenses and counterclaims to Fractus SA' s Amended complaint, Defendants, Jun. 4, 2009.
Document 0066—Defendant UTStarcom, Inc's answer affirmative defenses and counterclaims to plaintiff's amended complaint, Defendants, Jun. 8, 2009.
Document 0073—Plaintiff Fractus SA' s answer to defendant Pantech Wireless, Inc' s counterclaims, Defendants, Jun. 24, 2009.
Document 0079—Plaintiff Fractus SA' s answer to defendant UTStarcom, Inc' s counterclaims, Fractus, Jun. 29, 2009.
Document 0091—Answer, affirmative defenses and counterclaims to the amended complaint for patent infringement on behalf of Defendant Personal Communications Devices Holdings, LLC, Defendants, Jul. 20, 2009.
Document 0099—Defendant Sanyo North America Corporation's partial answer to amended complaint for patent infringement, Defendants, Jul. 20, 2009.
Document 0106—Kyocera Communications Inc's answer, affirmative defenses and counterclaims to plaintiff's amended complaint, Defendants, Jul. 21, 2009.
Document 0107—Kyocera Wireless Corp's answer, affirmative defenses and counterclaims to plaintiff's amended complaint, Defendants, Jul. 21, 2009.
Document 0108—Palm Inc.'s answer, affirmative defenses and counterclaims to plaintiff's amended complaint, Defendants, Jul. 21, 2009.
Document 0111—Civil cover sheet, Susman Godfrey, May 5, 2009.
Document 0175—Defendant HTC Corporation's amended answer and counterclaim to plaintiff's second amended complaint, Defendants, Sep. 25, 2009.
Document 0176—Defendant HTC America Inc's answer and counterclaim to plaintiff's amended complaint, Defendants, Sep. 25, 2009.
Document 0180—Defendants Samsung Electronics Co., Ltd.'s; Samsung Electronics Research Institute's and Samsung Semiconductor Europe GMBH' s answer; and Samsung Telecommunications America LLC' s answer and counterclaim, Defendants, Oct. 1, 2009.
Document 0185—Defendants Research in Motion LTD, and Research in Motion Corporation's answers, defenses and counterclaims to plaintiff's amended complaint, Defendants, Oct. 1, 2009.
Document 0187—Defendants LG Electronics Inc., LG Electronics USA, Inc., and LG Electronics Mobilecomm USA Inc. answer and counterclaim to amended complaint, Defendants, Oct. 1, 2009.
Document 0190—Defendant HTC Corporation's First amended answer and counterclaim to plaintiff's amended complaint, Defendants, Oct. 2, 2009.
Document 0191—Defendant HTC America, Inc's first amended answer and counterclaims to plaintiff's amended complaint, Defendants, Oct. 2, 2009.
Document 0217—Defendants Research in Motion LTD, and Research in Motion Corporation's amended answer, defenses and counterclaims to plaintiff's amended complaint, Defendants, Nov. 24, 2009.
Document 0222—Second amended complaint for patent infringement, Susman Godfrey, Dec. 2, 2009.
Document 0227—Second amended complaint for patent infringement—Case 6:09-cv-00203, Fractus, Dec. 8, 2009.
Document 0235—Answer, affirmative defenses and counterclaims to the second amended complaint for patent infringement on behalf of Defendant Personal Communications Devices Holdings, LLC, Defendants, Dec. 17, 2009.
Document 0238—Defendant HTC America, Inc's answer and counterclaims to plaintiff's second amended complaint, Defendants, Dec. 21, 2009.
Document 0239—Defendant HTC Corporation's answer and counterclaims to plaintiff's second amended complaint, Defendants, Dec. 21, 2009.
Document 0241—Defendant Research in Motion LTD and Research in Motion Corporation's second answer, defenses and counterclaims to plaintiff's second amended complaint, Defendants, Dec. 21, 2009.
Document 0242—Defendant Pantech Wireless, Inc's answer, affirmative defenses and counterclaims to Fractus SA's second amended complaint, Defendants, Dec. 21, 2009.
Document 0243—Defendant Sanyo Electric Co. LTD's answer to second amended complaint for patent infringement, Defendants, Dec. 22, 2009.
Document 0244—Defendant Sanyo North America Corporation's answer to second amended complaint for patent infringement, Defendants, Dec. 22, 2009.
Document 0246—Defendant UTStarcom, Inc's answer, affirmative defenses and counterclaims to Fractus SA's second amended complaint, Defendants, Dec. 22, 2009.
Document 0247—Palm, Inc's answer, affirmative defenses and counterclaims to plaintiff's second amended complaint, Defendants, Dec. 22, 2009.

(56) References Cited

OTHER PUBLICATIONS

Document 0248—Kyocera Communications, Inc's answer, affirmative defenses and counterclaims to plaintiff's second amended complaint, Defendants, Dec. 22, 2009.
Document 0249—Kyocera Wireless Corp's answer, affirmative defenses and counterclaims to plaintiff's second amended complaint, Defendants, Dec. 22, 2009.
Document 0250—Defendants Samsung Electronics Co., Ltd.'s: Samsung Electronics answer and counterclaim to the second amended complaint of plaintiff Fractus, Defendants, Dec. 23, 2009.
Document 0251—Defendants LG Electronics Inc., LG Electronics USA, Inc., and LG Electronics Mobilecomm USA Inc. answer and counterclaim to second amended complaint, Defendants, Dec. 28, 2009.
Document 0252—Answer of the Sharp Defendants to plaintiff's second amended complaint, Defendants, Dec. 29, 2009.
Document 0255—Plaintiff Fractus, S. A.'s answer to defendant Personal Communications Devices Holdings, LLC's counterclaims to the Second Amended Complaint, Susman Godfrey, Jan. 4, 2010.
Document 0256—Plaintiff Fractus, S. A.'s answer to the counterclaims of defendants Research in Motion LTD. and Research in Motion Corporation to the Second Amended Complaint, Susman Godfrey, Jan. 4, 2010.
Document 0257—Plaintiff Fractus, S. A.'s answer to counterclaims of defendant Pantech Wireless, Inc. to the Second Amended Complaint, Susman Godfrey, Jan. 4, 2010.
Document 0258—Plaintiff Fractus, S. A.'s answer to defendant Kyocera Communications, Inc's Counterclaims to the Second Amended Complaint, Susman Godfrey, Jan. 4, 2010.
Document 0259—Plaintiff Fractus, S. A.'s answer to defendant Kyocera Wireless Corp's Counterclaims to the Second Amended Complaint, Susman Godfrey, Jan. 4, 2010.
Document 0260—Plaintiff Fractus, S. A.'s answer to defendant Palm, Inc's Counterclaims to the Second Amended Complaint, Susman Godfrey, Jan. 4, 2010.
Document 0261—Plaintiff Fractus, S. A.'s answer to defendant UTStarcom, Inc's Counterclaims to the Second Amended Complaint, Susman Godfrey, Jan. 4, 2010.
Document 0262—Plaintiff Fractus, S. A.'s answer to counterclaims of defendant Samsung Telecommunications America LLC to the Second Amended Complaint, Susman Godfrey, Jan. 4, 2010.
Document 0263—Plaintiff Fractus, S. A.'s answer to counterclaims of defendants LG Electronics Inc., Electronics USA, Inc., and LG Electronics Mobilecomm USA, Inc. to the Second Amended Complaint, Susman Godfrey, Jan. 4, 2010.
Document 0273—Plaintiff Fractus, S. A.'s answer to counterclaims of defendants HTC America, Inc to the Second Amended Complaint, Susman Godfrey, Jan. 14, 2010.
Document 0286—Amended answer of the Sharp defendants to plaintiff's second amended complaint, Defendants, Feb. 24, 2010.
Document 0287—Defendants Samsung Electronics Co., Ltd.'s; Samsung Electronics Research Institute's and Samsung Semiconductor Europe GMBH' s first amended answer; and Samsung Telecommunications America LLC' s first amended answer, Defendants, Feb. 24, 2010.
Document 0288—Defendants LG Electronics Inc., LG Electronics USA, Inc., and LG Electronics Mobilecomm USA Inc. First amended answer and counterclaim to second amended complaint, Defendants, Feb. 24, 2010.
Document 0290—Defendant HTC America, Inc.'s amended answer and counterclaim to plaintiff's second amended complaint, Defendants, Feb. 24, 2010.
Document 0291—Defendant HTC Corporation's amended answer and counterclaim to plaintiff's second amended complaint, Defendants, Feb. 24, 2010.
Infringement Chart—LG AX380. U.S. Pat. No. 7,394,432, Fractus, Nov. 5, 2009.
Infringement Chart—LG AX380. U.S. Pat. No. 7,397,431, Fractus, Nov. 5, 2009.
Infringement Chart—LG AX380. U.S. Pat. No. 7,528,782, Fractus, Nov. 5, 2009.
Infringement Chart—LG AX585., Fractus, Nov. 5, 2009.
Infringement Chart—LG AX585. U.S. Pat. No. 7,015,868, Fractus, Nov. 5, 2009.
Infringement Chart—LG AX585. U.S. Pat. No. 7,123,208, Fractus, Nov. 5, 2009.
Infringement Chart—LG AX585. U.S. Pat. No. 7,397,431, Fractus, Nov. 5, 2009.
Infringement Chart—LG AX585. U.S. Pat. No. 7,528,782, Fractus, Nov. 5, 2009.
Infringement Chart—LG AX8600, Fractus, Nov. 5, 2009.
Infringement Chart—LG AX8600. U.S. Pat. No. 7,015,868, Fractus, Nov. 5, 2009.
Infringement Chart—LG AX8600. U.S. Pat. No. 7,123,208, Fractus, Nov. 5, 2009.
Infringement Chart—LG AX8600. U.S. Pat. No. 7,394,432, Fractus, Nov. 5, 2009.
Infringement Chart—LG AX8600. U.S. Pat. No. 7,397,431, Fractus, Nov. 5, 2009.
Infringement Chart—LG AX8600. U.S. Pat. No. 7,528,782, Fractus, Nov. 5, 2009.
Infringement Chart—LG CF360., Fractus, Nov. 5, 2009.
Infringement Chart—LG CF360. U.S. Pat. No. 7,015,868, Fractus, Nov. 5, 2009.
Infringement Chart—LG CF360. U.S. Pat. No. 7,123,208, Fractus, Nov. 5, 2009.
Infringement Chart—LG CF360. U.S. Pat. No. 7,394,432, Fractus, Nov. 5, 2009.
Infringement Chart—LG CF360. U.S. Appl. No. 7,397,431, Fractus, Nov. 5, 2009.
Infringement Chart—LG CF360. U.S. Pat. No. 7,528,782, Fractus, Nov. 5, 2009.
Infringement Chart—LG Chocolate VX8550, Fractus, Nov. 5, 2009.
Infringement Chart—LG Chocolate VX8550. U.S. Pat. No. 7,015,868, Fractus, Nov. 5, 2009.
Infringement Chart—LG Chocolate VX8550. U.S. Pat. No. 7,123,208, Fractus, Nov. 5, 2009.
Infringement Chart—LG Chocolate VX8550. U.S. Pat. No. 7,397,431, Fractus, Nov. 5, 2009.
Infringement Chart—LG Chocolate VX8550. U.S. Pat. No. 7,528,782, Fractus, Nov. 5, 2009.
Infringement Chart—LG CU515, Fractus, Nov. 5, 2009.
Infringement Chart—LG CU515. U.S. Pat. No. 7,015,868, Fractus, Nov. 5, 2009.
Infringement Chart—LG CU515. U.S. Pat. No. 7,123,208, Fractus, Nov. 5, 2009.
Infringement Chart—LG CU515. U.S. Pat. No. 7,394,432, Fractus, Nov. 5, 2009.
Infringement Chart—LG CU515. U.S. Pat. No. 7,397,431, Fractus, Nov. 5, 2009.
Infringement Chart—LG CU515. U.S. Pat. No. 7,528,782, Fractus, Nov. 5, 2009.
Infringement Chart—LG Dare VX9700 . U.S. Pat. No. 7,528,782, Fractus, Nov. 5, 2009.
Infringement Chart—LG Dare VX9700. U.S. Pat. No. 7,015,868, Fractus, Nov. 5, 2009.
Infringement Chart—LG Dare VX9700. U.S. Pat. No. 7,123,208, Fractus, Nov. 5, 2009.
Infringement Chart—LG Dare VX9700. U.S. Pat. No. 7,397,431, Fractus, Nov. 5, 2009.
Infringement Chart—LG enV Touch VX1100., Fractus, Nov. 5, 2009.
Infringement Chart—LG enV Touch VX1100. U.S. Pat. No. 7,015,868, Fractus, Nov. 5, 2009.
Infringement Chart—LG enV Touch VX1100. U.S. Pat. No. 7,123,208, Fractus, Nov. 5, 2009.
Infringement Chart—LG enV Touch VX1100. U.S. Pat. No. 7,394,432, Fractus, Nov. 5, 2009.
Infringement Chart—LG enV Touch VX1100. U.S. Pat. No. 7,397,431, Fractus, Nov. 5, 2009.
Infringement Chart—LG enV Touch VX1100. U.S. Pat. No. 7,528,782, Fractus, Nov. 5, 2009.

(56) References Cited

OTHER PUBLICATIONS

Infringement Chart—LG enV VX-9900, Fractus, Nov. 5, 2009.
Infringement Chart—LG enV VX-9900. U.S. Pat. No. 7,015,868, Fractus, Nov. 5, 2009.
Infringement Chart—LG enV VX-9900. U.S. Pat. No. 7,123,208, Fractus, Nov. 5, 2009.
Infringement Chart—LG enV VX-9900. U.S. Pat. No. 7,397,431, Fractus, Nov. 5, 2009.
Infringement Chart—LG enV VX-9900. U.S. Pat. No. 7,528,782, Fractus, Nov. 5, 2009.
Infringement Chart—LG EnV2 VX9100, Fractus, Nov. 5, 2009.
Infringement Chart—LG EnV2 VX9100. U.S. Pat. No. 7,123,208, Fractus, Nov. 5, 2009.
Infringement Chart—LG EnV2 VX9100. U.S. Pat. No. 7,397,431, Fractus, Nov. 5, 2009.
Carver , K. R. et al., Microstrip antenna technology, Antennas and Propagation, IEEE Transactions on, Jan. 1, 1981, vol. AP29, No. 1.
Carver , K. R. et al., Microstrip antenna technology, in "Microstrip antennas" to D.M. Pozar; IEEE Antennas and Propagation Society, Jan. 1, 1995, p. 3-26.
Caswell , W. E., Invisible errors in dimensions calculations: geometric and systematic effects, Dimensions and Entropies in Chaotic Systems, Jan. 1, 1986, p. 123-136.
Chang , J. et al, Hybrid fractal cross antenna, Microwave and Optical Technology Letters, Jun. 20, 2000.
Chen , H., Dual frequency microstrip antenna with embedded reactive loading, Microwave and Optical Technology Letters, Nov. 5, 1999, vol. 23, No. 3.
Chen , M.H., A compact EHF/SHF dual frequency antenna, Antennas and Propagation Society (APS), 1990. IEEE International Symposium, May 7, 1990, vol. 4.
Chen , S. et al., On the calculation of Fractal features from images, Pattern Analysis and Machine Intelligence, IEEE Transactions on, Oct. 1, 1993, vol. 15, No. 10.
Chen , W. S., Square-ring microstrip antenna with a cross strip for compact circular polarization operation, Antennas and Propagation, IEEE Transactions on, Oct. 1, 1999.
Chen , X. ; Ying , Z., Small Antenna Design for Mobile Handsets (part I), Sony Ericsson, Mar. 25, 2009.
Chen , Z. N. ; Chia , M. Y.W., Broadband rectangular slotted plate antenna, Antennas and Propagation Society (APS), 2000. IEEE International Symposium, Jul. 16, 2000.
Chiba , N. et al, Dual frequency planar antenna for handsets, Electronics Letters, Dec. 10, 1998.
Cho , M. et al, Modified slot-loaded triple-band microstrip patch antenna, Antennas and Propagation Society (APS), 2002. IEEE International Symposium, Jun. 16, 2002.
Cohen , N., Fractal antenna applications in wireless telecommunications, Electronics Industries Forum of New England, 1997. IEEE Professional Program Proceedings, May 6, 1997, p. 43-49.
Cohen , N., Fractal element antennas, Journal of Electronic Defense, Jul. 1, 1997.
Cohen , N., NEC4 analysis of a fractalized monofiliar helix in an axial mode, Wireless Communications and Applied Computational Electromagnetics (ACES), 1998. IEEE International Conference on, Apr. 1, 1998, p. 1051.
Cohen , N., Fractal antennas—Part 2—A discussion of relevant, but disparate, qualities, Communications Quarterly, Jul. 1, 1996.
Cohen , N., Fractal and shaped dipoles—Some simple fractal dipoles, their benefits and limitations, Communications Quarterly, Mar. 1, 1996.
Cohen , N., Fractal antennas—Part 1—Introduction and the fractal quad, Communications Quarterly, Jul. 1, 1995.
Cohn , S. B., Flush airborne radar antennas, USAF Antenna Research and Development Program, 3th , 1953. Symposium on the, Oct. 18, 1953.
Collier , C. P., Geometry for teachers, Waveland Press, Inc., Jan. 1, 1984.
Collier , D. ; Shnitkin , H., The monopole as a wideband array antenna element, Antenna Applications, 1993. Symposium, Sep. 22, 1993.
Counter , V. A., Flush, re-entrant, impedance phased, circularly polarized cavity antenna for missiles, USAF Antenna Research and Development Program, 2th , 1952. Symposium on the, Oct. 19, 1952.
Counter , V. A. ; Margerum , D. L., Flush dielectric disc antenna for radar, USAF Antenna Research and Development Program, 2th , 1952. Symposium on the, Oct. 19, 1952.
Cristal , E. G. et al, Hairpin-line and hybrid hairpin-line / Half-wave parallel-coupled-line filers, Microwave Theory and Techniques, IEEE Transactions on, Nov. 1, 1972.
Croq , F. ; Pozar , D. M., Multifrequency operation of microstrip antennas using aperture coupled parallel resonators, Antennas and Propagation, IEEE Transactions on, Nov. 1, 1992.
Daniel , A. E. ; Kumar , G., Rectangular microstrip antennas with stub along the non-radiating edge for dual band operation, Antennas and Propagation Society (APS), 1995. IEEE International Symposium, Jun. 18, 1995, vol. 4, p. 2136-2139.
Deng , S. M., A t-strip loaded rectangular microstrip patch antenna for dual-frequency operation, Antennas and Propagation Society (APS), 1999. IEEE International Symposium, Jul. 1, 1999.
Deschamps , G., Microstrip Microwave Antenna, USAF Antenna Research and Development Program, 3th , 1953. Symposium on the, Oct. 18, 1953.
Dickstein , H. D., Antenna system for a ground passive electronic reconnaissance facility, USAF Antenna Research and Development Program, 8th , 1958. Symposium on the, Oct. 20, 1958.
Du Plessis , M. ; Cloete , J. H., Tuning stubs for microstrip patch antennas, Antennas and Propagation Society (APS), 1993. IEEE International Symposium, Jun. 28, 1993, vol. 2, p. 964-967.
Dubost , G., Wideband flat dipole and short-circuit microstrip patch elements and arrays. In Handbook of microstrip antennas—Chapter 7, Peter Peregrinus Ltd. James , J. R. ; Hall , P. S. (ed.), Jan. 1, 1989, vol. 1, p. 354-359.
DuHamel , R. H., Broadband logarithmically periodic antenna structures, Convention Record, 1957. IRE International, Mar. 14, 1957, vol. 5, p. 119-128.
Durgun , A. C. ; Reese , M. S. ; Balanis , C. A. et al, Flexible bow-tie antennas with reduced metallization, Radio and Wireless (RWS), 2011. IEEE Symposium, Jan. 16, 2011, p. 50-53.
Dyson , J. D., The non-planar equiangular spiral antenna, USAF Antenna Research and Development Program, 8th , 1958. Symposium on the, Oct. 20, 1958.
Dyson , J. D., The equiangular spiral antenna, Antennas and Propagation, IRE Transactions on, Apr. 1, 1959.
Ellis , A. R., Airborne UHF antenna pattern improvements, USAF Antenna Research and Development Program, 3th , 1953. Symposium on the, Oct. 18, 1953.
Esteban , J. ; Rebollar , J. M., Design and optimization of a compact Ka-Band antenna diplexer, Antennas and Propagation Society (APS), 1995. IEEE International Symposium, Jun. 18, 1995.
Falconer , K., Fractal geometry _Full, John Wiley Sons—2nd ed., Jan. 1, 2003.
Falconer , K., Fractal Geometry: Mathematical Foundations and Applications, John Wiley & Sons, Jan. 1, 1990, p. 38-44.
Falconer , K., Fractal geometry. Mathematical foundations and applications, John Wiley and Sons, Jan. 1, 1990, p. 38-41.
Feder, J., Fractals, Plenum Press, Jan. 1, 1988, p. 10-11, 15-17, and 25.
Feng , J., Fractional box-counting approach to fractal dimension estimation, Pattern Recognition, 13th , 1996. International Conference on, Jan. 1, 1996.
Fenwick , R. C., A new class of electrically small antennas, Antennas and Propagation, IEEE Transactions on, May 1, 1965.
Ferris , J. E., A status report of an Azimuth and elevation direction finder, USAF Antenna Research and Development Program, 18th , 1968. Symposium on the, Oct. 15, 1968.
Fleishmann , M. ; Tildesley , D. J. ; Balls , R. C., Fractals in the natural sciences, Royal Society of London, Jan. 1, 1999.
Force , R. et al., Synthesis of multilayer walls for radomes of aerospace vehicles, USAF Antenna Research and Development Program, 17th , 1967. Symposium on the, Nov. 14, 1967.

(56) References Cited

OTHER PUBLICATIONS

Foroutan-Pour , K. ; Dutilleul , P. ; Smith , D.L., Advances in the implementation of the box-counting method of fractal dimension estimation, Applied Mathematics and Computation, May 1, 1999, vol. 105, p. 195-210.
Fuhl , J. et al, Improved internal antenna for handheld terminal, Electronics Letters, Oct. 27, 1994.
George , J. ; Aanandan , C. K. ; Mohanan , P. et al, Analysis of a new compact microstrip antenna, Antennas and Propagation, IEEE Transactions on, Nov. 1, 1998.
Gianvittorio , J. P., Fractal antenna research at UCLA, University of California (UCLA)—Los Angeles. Antenna Lab, Nov. 19, 1999.
Adcock , M. D, New type feed for high speed conical scanning, USAF Antenna Research and Development Program, 2th , 1952. Symposium on the, Aug. 11, 1952.
Addison , P. S., Fractals and Chaos—An illustrated course—Full, Institute of Physics Publising Bristol and Philadelphia, Jan. 1, 1997.
Ali , M. ; Hayes , G. J. et al, A triple band internal antenna for mobile handheld terminals, Antennas and Propagation Society (APS), 2002. IEEE International Symposium, Jun. 16, 2002.
Andersen , J. B., The handbook of antenna design—Low- and medium-gain microwave antennas, Rudge , A. W. et al—IEE Eletromagnetic Waves Series; Peter Peregrinus Ltd. (2nd ed.), Jan. 1, 1986, vol. 1 and 2, p. 526-543.
Ando , A., A novel electromagnetically coupled microstrip antenna with a rotatable patch for personal handy phone system units, Antennas and Propagation, IEEE Transactions on, Jun. 1, 1998.
Anguera , J. ; Font , G. ; Puente , C. ; Borja , C. ; Soler , J., Multifrequency microstrip patch antenna using multiple stacked elements, Microwave and Wireless Components Letters, IEEE, Mar. 1, 2003, vol. 13, No. 3.
Anguera , J. ; Puente , C. ; Borja , C., A procedure to design stacked microstrip patch antennas on a simple network model, Microwave and Optical Technology Letters, Aug. 1, 2001.
Anguera , J. ; Puente , C. ; Borja , C., A procedure to design wide-band electromagnetically-coupled stacked microstrip antennas based on a simple network model, Antennas and Propagation Society (APS), 1999. IEEE International Symposium, Jul. 11, 1999.
Anguera , J. ; Puente , C. ; Borja , C. ; Font , G. ; Romeu , J., Diseño de antenas impresas de banda ancha alimentadas mediante acoplo capacitivo, Unión Científica Internacional de la Radio (URSI), 15th , Zaragoza, 2000. Simposium Nacional de la, Sep. 1, 2000.
Anguera , J. ; Puente , C. ; Borja , C. ; Montero , R. ; Soler , J., Antena microstrip miniatura y de alta directividad basada en el fractal de Sierpinski, Unión Científica Internacional de la Radio (URSI), 16th , Villaviciosa de Odón, 2001. Simposium Nacional de la, Sep. 1, 2001.
Anguera , J. ; Puente , C. ; Borja , C. ; Romeu , J., Miniature wideband stacked microstrip patch antenna based on the sierpinski fractal geometry, Antennas and Propagation Society (APS), 2000. IEEE International Symposium, Jul. 1, 2000, vol. 3, p. 1700-1703.
Anguera J. ; Puente , C. ; Romeu , J., An optimum method to design probe-fed single-layer single-path wideband microstrip antenna, Antennas and Propagation Society (APS), 2000. IEEE International Symposium, Apr. 1, 2000.
Azadegan , R. ; Sarabandi , K., Design of miniaturized slot antennas, Antennas and Propagation Society (APS), 2001. IEEE International Symposium, Jul. 8, 2001, vol. 4, p. 565-568.
Bach Andersen , J. et al., On closely coupled dipoles in a random field, Antennas and Wireless Propagation Letters, IEEE, Dec. 1, 2006, vol. 5.
Bahar , E. ; Son Lee , B., Full wave vertically polarized bistatic radar cross sections for random rough surfaces, Antennas and Propagation, IEEE Transactions on, Feb. 1, 1995.
Balanis , C. A., Antenna Theory—Analysis and design—Chapter 10—Travelling wave and broadband antennas, Hamilton Printing, Jan. 1, 1982, p. 498-502.
Balanis , C. A., Antenna theory—Analysis and Design—Chapter 9 / Chapter 14—Broadband dipoles and matching techniques / Microstrip antennas, Hamilton Printing, Jan. 1, 1982, p. 465-484 and 722-767.
Balanis , C. A., Antenna theory—Analysis and design—Chapter 1.4—Current distribution on the thin wire antenna, John Wiley & Sons, Jan. 1, 2005, p. 17-20.
Barnsley , M., Fractals Everywhere, Academic Press Professional, Jan. 1, 1993, vol. 2.
Barreiros , J. ; Cameirao , P. ; Peixeiro , C., Microstrip patch antenna for gsm 1800 handsets, Antennas and Propagation Society (APS), 1999. IEEE International Symposium, Jul. 11, 1999.
Barrick , W., A helical resonator antenna diplexer, USAF Antenna Research and Development Program, 10th , 1960. Symposium on the, Oct. 3, 1960.
Batson , D. D. et al, VHF unfurlable turnstile antennas, USAF Antenna Research and Development Program, 19th , 1969. Symposium on the, Oct. 14, 1969.
Berizzi , F., Fractal analysis of the signal scattered from the sea surface, Antennas and Propagation, IEEE Transactions on, Feb. 1, 1999, vol. 47, No. 2.
Best , S. R., On the significance of self-similar fractal geometry in determining the multiband behaviour of the Sierpinski gasket antenna, Antennas and Wireless Propagation Letters, IEEE, Jan. 1, 2002, vol. 1.
Best , S. R., The fractal loop antenna : understanding the significance of fractal geometry in determining antenna performance, QEX Magazine, Mar. 1, 2002, p. 25-34.
Besthom, 1.0 to 21.0 GHz Log-periodic dipole antenna, USAF Antenna Research and Development Program, 18th , 1968. Symposium on the, Oct. 15, 1968.
Blackband , W. T., The handbook of antenna design—Chapter 18—Coaxial transmisison lines and components, Rudge , A. W. et al.Peter Peregrinus, Jan. 1, 1986, vol. 1 and vol. 2, p. 1612-1623.
Bokhari , S. A. ; Zürcher , J. F. ; Mosig , J. R. et al, A small microstrip patch antenna with a convenient tuning option, Antennas and Propagation, IEEE Transactions on, Nov. 1, 1996.
Borja , C., High directivity fractal boundary microstrip patch antenna, Electronics Letters, Apr. 27, 2000, vol. 36, No. 9.
Borja , C., Panel 01, Fractus—Telefonica, Jan. 1, 1998.
Borja , C., MSPK product, Fractus—Telefonica, Jan. 1, 1998.
Borja , C., Fractal microstrip antennas : Antenas fractales microstrip, Universitat Politecnica de Catalunya (UPC), Jul. 1, 1997.
Borja , C. ; Puente , C., Iterative network models to predict the performance of Sierpinski fractal antennas and networks, Antennas and Propagation Society (APS), 1999. IEEE International Symposium, Jul. 11, 1999.
Borja , C. ; Puente , C. ; Anguera , J. et al, Estudio experimental del parche de Sierpinski, Unión Cientifica Internacional de la Radio (URSI), 14th , Santiago de Compostela, 1999. Simposium Nacional de la, Sep. 1, 1999.
Borja , C. ; Puente , C. ; Medina , A., Iterative network model to predict the behaviour of a sierpinski fractal network, Electronics Lettters, Jul. 23, 1998, vol. 34, No. 15, p. 1443-1445.
Borja , C. ; Puente , C. ; Medina , A. et al, Modelo sencillo para el estudio de los parametros de entrada de una antena fractal de Sierpinski, Unión Científica Internacional de la Radio (URSI), 12th , Bilbao, 1997. Simposium Nacional de la, Sep. 1, 1997.
Borja , C. ; Puente , C. ; Medina , A. et al, Traslacion de la propiedad de autosemejanza de los fractales al comportamiento electromagnetico de parches con geometria fractal, Unión Científica Internacional de la Radio (URSI), 12th , Bilbao, 1997. Simposium Nacional de la, Sep. 1, 1998.
Borja , C. ; Puente , C. ; Romeu , J , Anguera , J., Fractal multiband patch antenna, Antennas and Propagation Society (APS), 2000. IEEE International Symposium, Apr. 1, 2000.
Borja , C. ; Romeu , J., Parche de Sierpinski perturbado, Unión Científica Internacional de la Radio (URSI), 15th , Zaragoza, 2000. Simposium Nacional de la, Sep. 13, 2000.
Borja , C. ; Romeu , J., Multiband Sierpinski fractal patch antenna, Antennas and Propagation Society (APS), 2000. IEEE International Symposium, Jul. 16, 2000.
Borowski , E. J., Dictionary of Mathematics, Collins, Jan. 1, 1989, p. 456-457.
Boshoff , H., A fast box counting algorithm for determining the fractal dimension of sampled continuous functions, IEEE, Jan. 1, 1992.

(56) References Cited

OTHER PUBLICATIONS

Breden , R. et al., Multiband printed antenna for vehicles, University of Kent, Jan. 3, 2000.
Breden , R. et al., Printed fractal antennas, Antennas and Propagation, 1999. IEE National Conference on, Apr. 1, 1999.
Brown, A., A high-performance integrated K-band diplexer, Microwave Theory and Techniques, IEEE Transactions on, Aug. 8, 1999, vol. 47.
Buczkowski , S. ; Kyriacos , S. ; Nekka , F. ; Cartilier , L., The modified box-countig method: analysis of some characteristic parameters, Pattern Recognition, Apr. 20, 1998, vol. 31, p. 411-418(8).
Burnett , G. F., Antenna installations on super constellation airbone early warning and control aircraft, USAF Antenna Research and Development Program, 4th , 1954. Symposium on the, Oct. 17, 1954.
Bushman , F. W., The boeing B-52 all flush antenna system, USAF Antenna Research and Development Program, 5th , 1955. Symposium on the, Oct. 16, 1955.
Campi , M., Design of microstrip linear array antennas, Antenna Applications, 1981. Symposium, Aug. 8, 1981.
Campos , O., Multiband and miniature fractal antennas study : Estudi d'antenes fractal multibanda i en miniatura, Universitat Politecnica de Catalunya (UPC), Jan. 1, 1998.
Pozar , D. M. ; Schaubert , D. H., Microstrip antennas. The analysis and design of microstrip antennas and arrays, IEEE Press; Pozar, Schaubert, Jan. 1, 1995, p. 431.
Pribetich , P. ; Combet , Y. et al, Quasifractal planar microstrip resonators for microwave circuits, Microwave and Optical Technology Letters, Jun. 20, 1999, vol. 21, No. 6, p. 433-436.
Puente , C., Fractal multiband antenna based on the Sierpinski gasket, Electronics Letters, Jan. 4, 1996.
Puente , C., Fractal design of multiband antenna arrays, University of Illinois at Urbana-Champaign—Universitat Politecnica de Catalunya (UPC), Jan. 1, 1994.
Puente , C., Fractal antennas, Universitat Politecnica de Catalunya (UPC), May 1, 1997.
Puente , C. ; Anguera , J. ; Romeu , J.; Borja , C. ; Navarro , M. ; Soler , J., Fractal-shaped antennas and their application to gsm 900 1800, The Journal of the Institution of British Telecommunications Engineers, Jul. 1, 2001, vol. 2, Part 3.
Puente , C. ; Borja , C. ; Navarro , M. et al, An iterative model for fractal antennas—application to the Sierpinski gasket antenna, Antennas and Propagation, IEEE Transactions on, May 1, 2000.
Puente , C. ; Claret , J. ; Sagues , F. et al, Multiband properties of a fractal tree antenna generated by electrochemical deposition, Electronics Letters, Dec. 5, 1996, vol. 32, No. 25, p. 2298-2299.
Puente , C. ; Navarro , M. ; Romeu , J. ; Pous , R., Variations on the fractal sierpinski antenna flare angle, Antennas and Propagation Society (APS), 1998. IEEE International Symposium, Jun. 1, 1998.
Puente , C. ; Navarro , M. ; Romeu , J. et al, Efecto de la variacion angular del vertice de alimentacion en la antena fractal de Sierpinski, Unión Científica Internacional de la Radio (URSI), 12th , Bilbao, 1997. Simposium Nacional de la, Sep. 1, 1997.
Puente , C. ; Pous , R., Fractal design of multiband and low side-lobe arrays, Antennas and Propagation, IEEE Transactions on, May 1, 1996, vol. 44, No. 5.
Puente , C. ; Pous , R., Diseño fractal de agrupaciones de antenas—Fractal design of antenna arrays, Unión Cientófica Internacional de la Radio (URSI), 9th , La Palma, 1994. Simposium Nacional de la, Sep. 1, 1994.
Puente , C. ; Romeu , J. ; Bartolome , R. ; Pous , R., Perturbation of the Sierpinski antenna to allocate operating bands, Electronics Letters, Nov. 21, 1996, vol. 32, No. 24.
Puente , C. ; Romeu , J. ; Cardama , A., Fractal-shaped antennas, Frontiers in electromagnetics—IEEE Press, Jan. 1, 2000, Chapter 2, p. 48-50.
Puente , C. ; Romeu , J. ; Cardama , A. ; Pous , R., Multiband fractal antennas and arrays, Fractals engineering—from theory to industrial applications, Jan. 1, 1997.
Puente , C. ; Romeu , J. ; Cardama , A. ; Pous , R., On the behavior of the Sierpinski multiband fractal antenna, Antennas and Propagation, IEEE Transactions on, Apr. 1, 1998, vol. 46, No. 4.
Puente , C. ; Romeu , J. ; Cardama, A., The Koch monopole—a small fractal antenna, Antennas and Propagation, IEEE Transactions on, Nov. 1, 2000, vol. 48, No. 11.
Puente , C. et al, Small but long Koch fractal monopole, Electronics Letters, Jan. 8, 1998, vol. 34, No. 1, p. 9-10.
Qing , X. ; Chia , Y. W. M., A novel single feed circular polarized slotted loop antenna, Antennas and Propagation Society (APS), 1999. IEEE International Symposium, Jul. 11, 1999.
Rademacher , H. ; Toeplitz , O., The Enjoyment of Math, Princeton Science Library, Jan. 1, 1957., p. 164-169.
Rahman , M. et al, Dual band strip sleeve monopole for handheld telephones, Microwave and Optical Technology Letters, Apr. 20, 1999.
Rao , B. R. et al, GPS microstrip antenna array on a resistivity tapered ground plane for multipath mitigation, The Mitre Corporation, Apr. 1, 2000.
Rathi , V. ; Kumar , G. ; Ray , K. P., Improved coupling for aperture coupled microstrip antennas, Electronics Letters, Jun. 20, 1991.
Ray , K. ; Kumar , G., Multi-frequency and broadband hybrid-coupled circular microstrip antennas, Electronics Letters, Mar. 13, 1997.
Rensh , Y. A., Broadband microstrip antenna, Antenna Theory and Techniques, 1998. International Conference on, Sep. 22, 1998, vol. 28, p. 420-423.
Rich , B., Review of Elementary Mathematics 2d ed.1997, McGraw-Hill , Jan. 1, 1997, pp. 245-247.
Rikuta , Y. ; Arai , H., A self-diplexing antenna using stacked patch antennas, Antennas and Propagation Society (APS), 2000. IEEE International Symposium, Jul. 1, 2000.
Romeu , J. ; Blanch , S., A three dimensional hilbert antenna, Antennas and Propagation Society (APS), 2002. IEEE International Symposium, Jun. 16, 2002.
Romeu , J. ; Navarro , M. ; Puente , C. ; Berenguer , J., Dual Fractal antennas for cellular telephony. Correction of truncation effect (CET), Universitat Politecnica de Catalunya (UPC). Electromagnetic and Photonic Engineering Group (EEF). Department of Signal Theory and Communications., Nov. 20, 1997.
Romeu , J. ; Navarro , M. ; Puente , C. ; Berenguer , J., Dual fractal antennas for cellular teiphony—Adjustment of input impedance. P2/3SPK dual monopole, Universitat Politecnica de Catalunya (UPC). Electromagnetic and Photonic Engineering Group (EEF). Department of Signal Theory and Communications., Apr. 2, 1998.
Romeu , J. ; Navarro , M. ; Puente , C. ; Berenguer , J., Dual fractal antennas for cellular telephony . Dual monopole microcell application. Fractus II, Universitat Politecnica de Catalunya (UPC). Electromagnetic and Photonic Engineering Group (EEF). Department of Signal Theory and Communications., May 28, 1998.
Romeu , J. ; Puente , C. ; Cardama , J., Small fractal antennas, Fractals in Engineering, 1999. India Conference, Jun. 1, 1999, p. 35-36.
Romeu , J. ; Rahmat-Samii , Y., A fractal based FSS with dual band characteristics, Antennas and Propagation Society (APS), 1999. IEEE International Symposium, Aug. 1, 1999.
Romeu , J. ; Rahmat-Samii , Y., Dual band FSS with fractal elements, Electronics Letters, Apr. 29, 1999.
Rosa , J. ; Case E. W., A wide angle circularly polarized omnidirectional array antenna, USAF Antenna Research and Development Program, 18th , 1968. Symposium on the, Oct. 15, 1968.
Roscoe , D. J. et al, Tunable dipole antennas, Antennas and Propagation Society (APS), 1993. IEEE International Symposium, Jun. 28, 1993.
Rotman , W., Problems encountered in the design of flush-mounted antennas for high speed aircraft, USAF Antenna Research and Development Program, 2th , 1952. Symposium on the, Oct. 19, 1952, vol. 46.
Rouvier , R. et al., Fractal analysis of bidimensional profiles and application to electromagnetic scattering from soils, IEEE, Jan. 1, 1996.
Rowell , C. R. ; Murch , R. D., A compact PIFA suitable for dual-frequency 900-1800-MHz operation, Antennas and Propagation, IEEE Transactions on, Apr. 1, 1998.

(56) References Cited

OTHER PUBLICATIONS

Rowell , C. R. ; Murch , R.D., A capacitively loaded PIFA for compact mobile telephone handsets, Antennas and Propagation, IEEE Transactions on, May 1, 1997.
Rumsey , V., Frequency independent antennas, Academic Press, Jan. 1, 1996, p. 2-3.
Russell , D. A. et al., Dimension of strange attractors, Physical Review, Oct. 6, 1980, vol. 45, No. 14.
Salvador , C. et al., Dual frequency planar antenna at S and X bands, Electronics Letters, Sep. 1, 1995, vol. 31, p. 1706-1707.
Samavati , H. ; Hajimiri , A. et al, Fractal capacitors, Solid State Circuits, IEEE Journal of, Dec. 1, 1998, vol. 33, No. 12, p. 2035-2041.
Sanad , M., A compact dual broadband microstrip antenna having both stacked and planar parasitic elements, Antennas and Propagation Society (APS), 1996. IEEE International Symposium, Jul. 21, 1996, p. 6-9.
Sanad , M. et al., An internal integrated microstrip antenna for PCS/cellular telephones and other hand-held portable communication equipment, Microwave Journal, Jul. 1, 1998.
Sanad , M. et al., Compact internal multiband microstrip antennas for portable GPS, PCS, cellular and satellite phones, Microwave Journal, Jan. 1, 1999.
Sanchez Hernandez , D., A survey of broadband microstrip patch antennas, Microwave Journal, Sep. 1, 1996.
Sanchez Hernandez , D., Single-fed dual band circularly polarised microstrip patch antennas, Microwave Conference (EuMC), 20th , Praga, 1990. European, Sep. 9, 1996.
Sanchez Hernandez , D. et al, Analysis and design of a dual-band circularly polarized microstrip patch antenna, Antennas and Propagation, IEEE Transactions on, Feb. 1, 1995.

* cited by examiner

FIG. 2.1
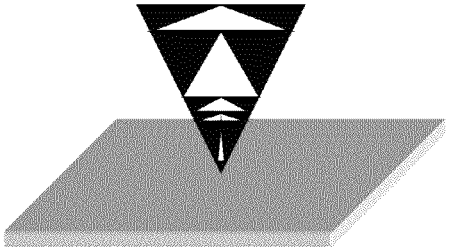
FIG. 2.2
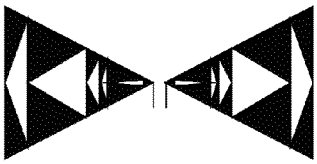
FIG. 2.3
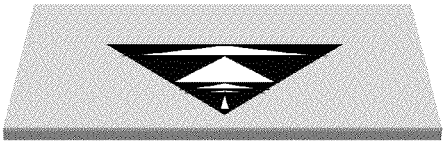
FIG. 2.4
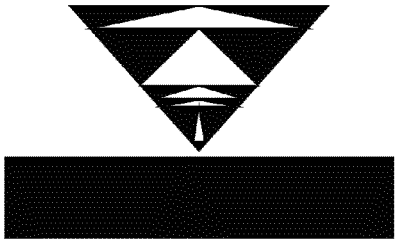
FIG. 2.5
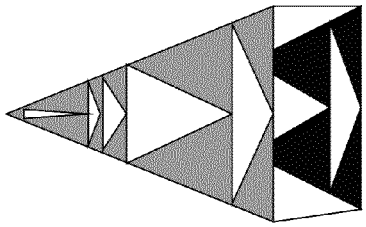
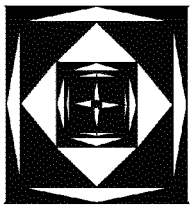
FIG. 2.6
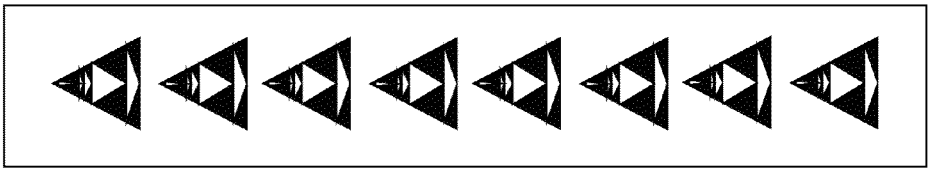
FIG. 2.7

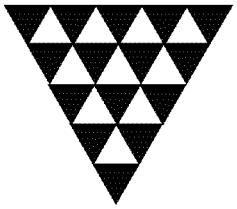
FIG. 3.1
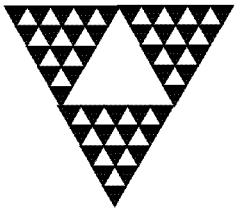
FIG. 3.2
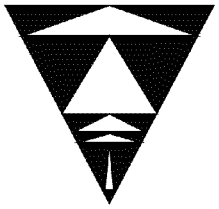
FIG. 3.3
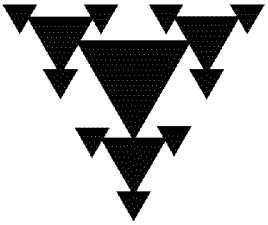
FIG. 3.4
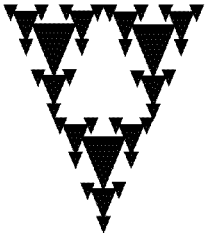
FIG. 3.5
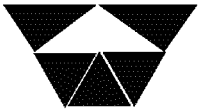
FIG. 3.6
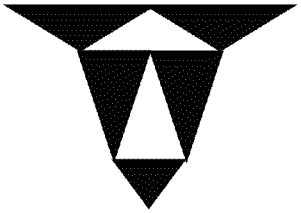
FIG. 3.7
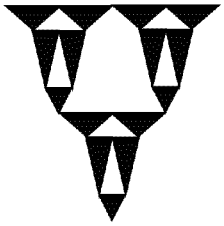
FIG. 3.8
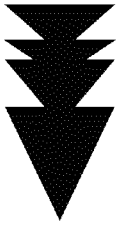
FIG. 3.9
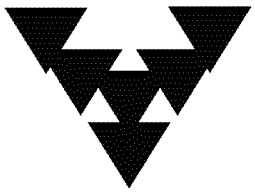
FIG. 3.10
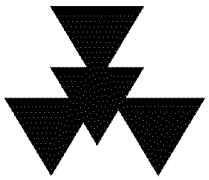
FIG. 3.11
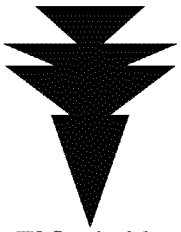
FIG. 3.12
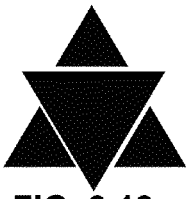
FIG. 3.13
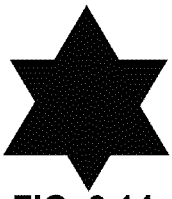
FIG. 3.14
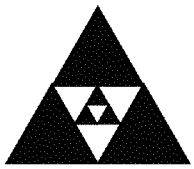
FIG. 3.15

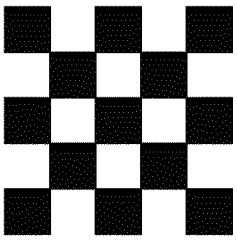
FIG. 4.1
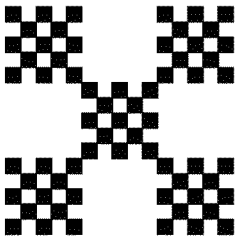
FIG. 4.2
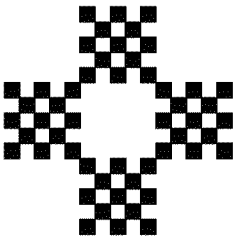
FIG. 4.3
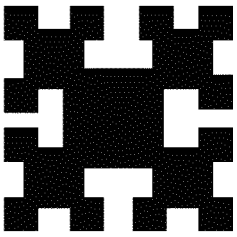
FIG. 4.4
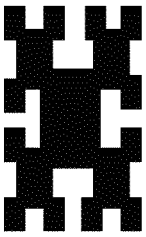
FIG. 4.5
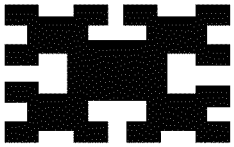
FIG. 4.6
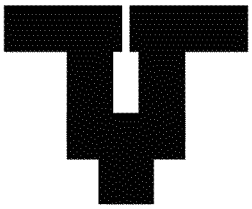
FIG. 4.7
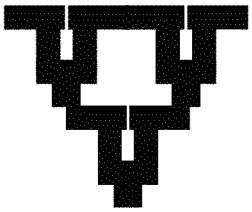
FIG. 4.8
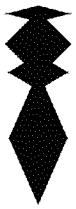
FIG. 4.9
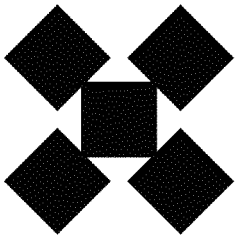
FIG. 4.10
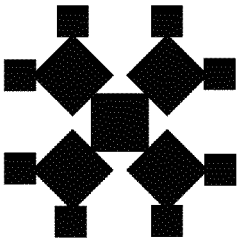
FIG. 4.11
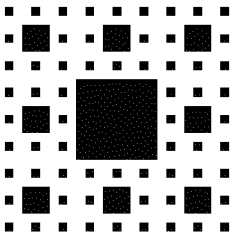
FIG. 4.12
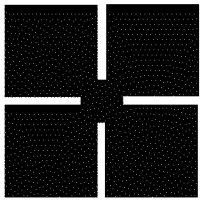
FIG. 4.13
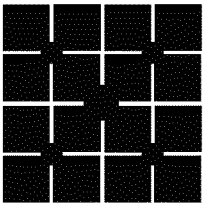
FIG. 4.14
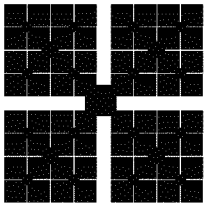
FIG. 4.15

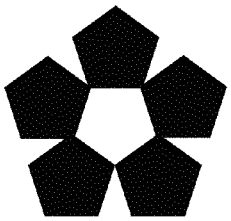
FIG. 5.1
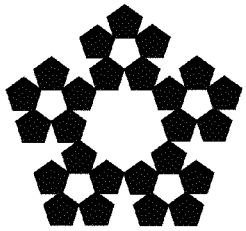
FIG. 5.2
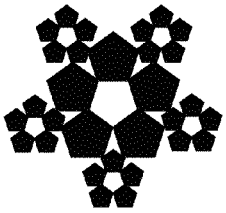
FIG. 5.3
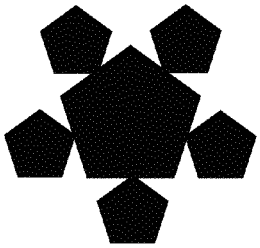
FIG. 5.4
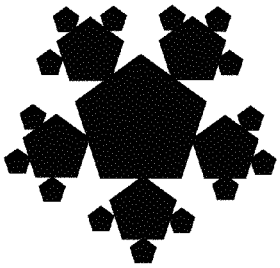
FIG. 5.5
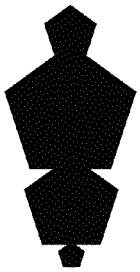
FIG. 5.6
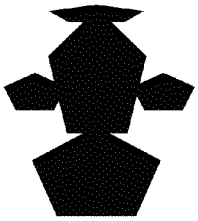
FIG. 5.7
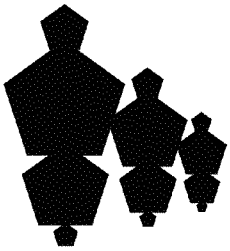
FIG. 5.8
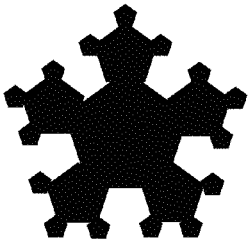
FIG. 5.9

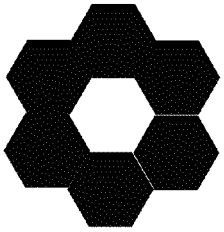
FIG. 6.1
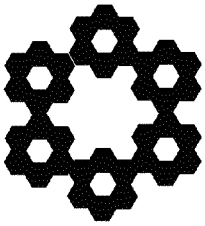
FIG. 6.2
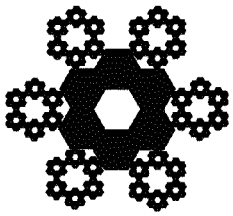
FIG. 6.3
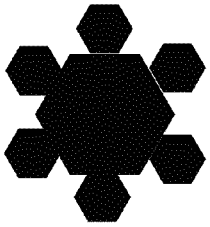
FIG. 6.4
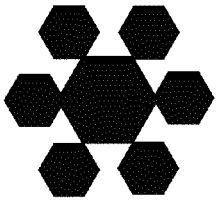
FIG. 6.5
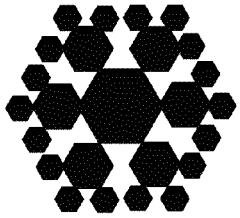
FIG. 6.6
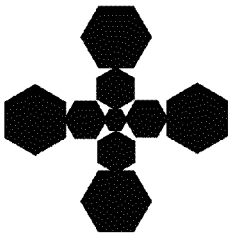
FIG. 6.7
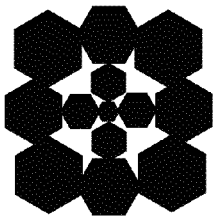
FIG. 6.8
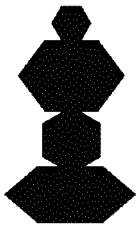
FIG. 6.9

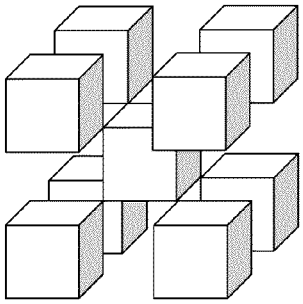
FIG. 7.1
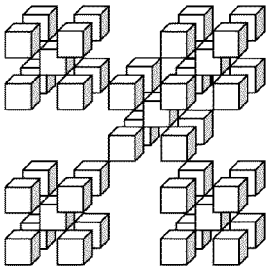
FIG. 7.2
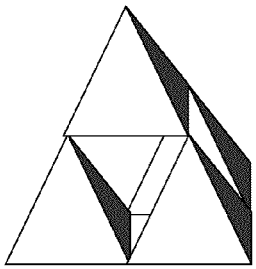
FIG. 7.3
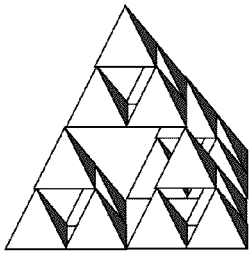
FIG. 7.4
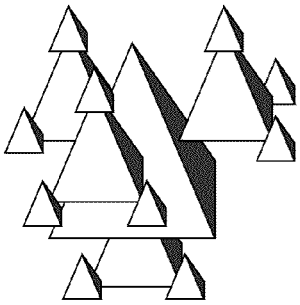
FIG. 7.5
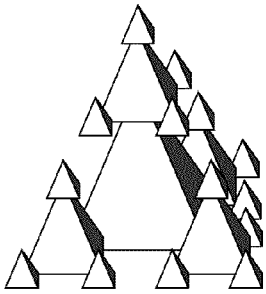
FIG. 7.6
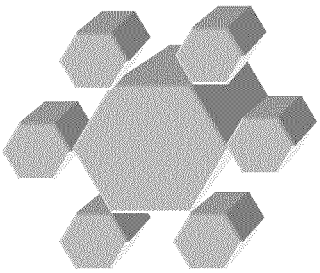
FIG. 7.7
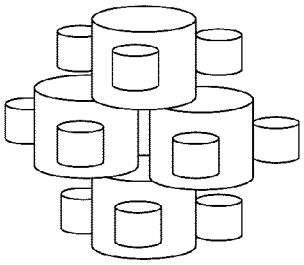
FIG. 7.8

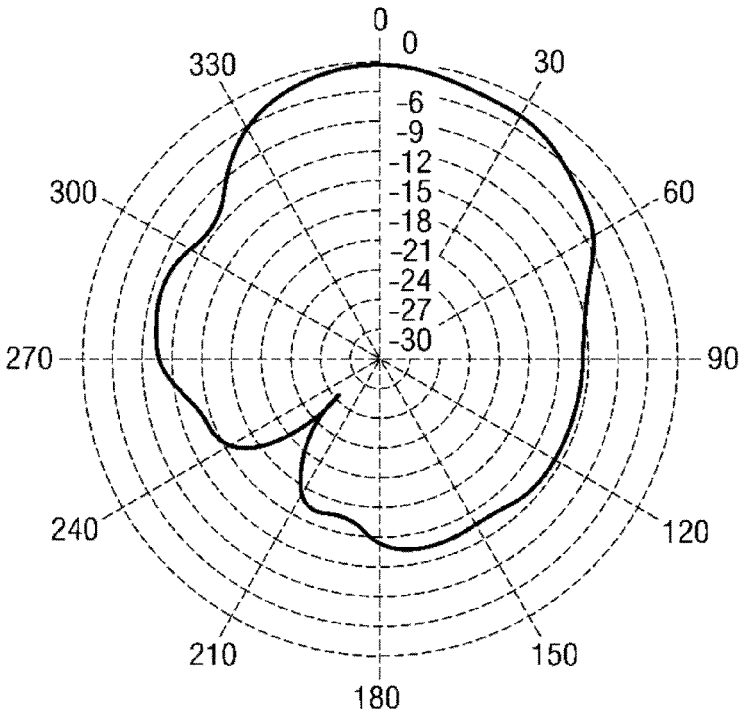
FIG. 10 A.1
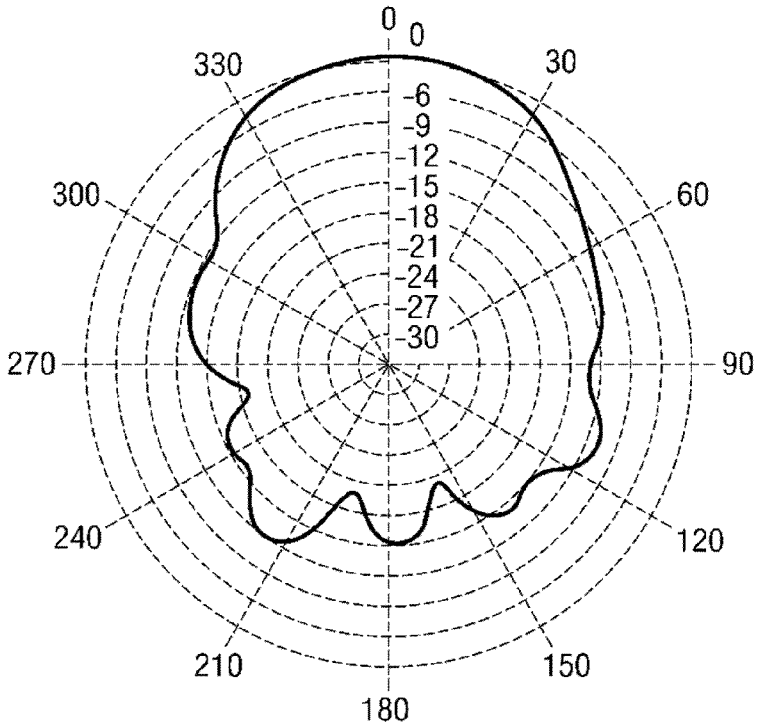
FIG. 10 A.2

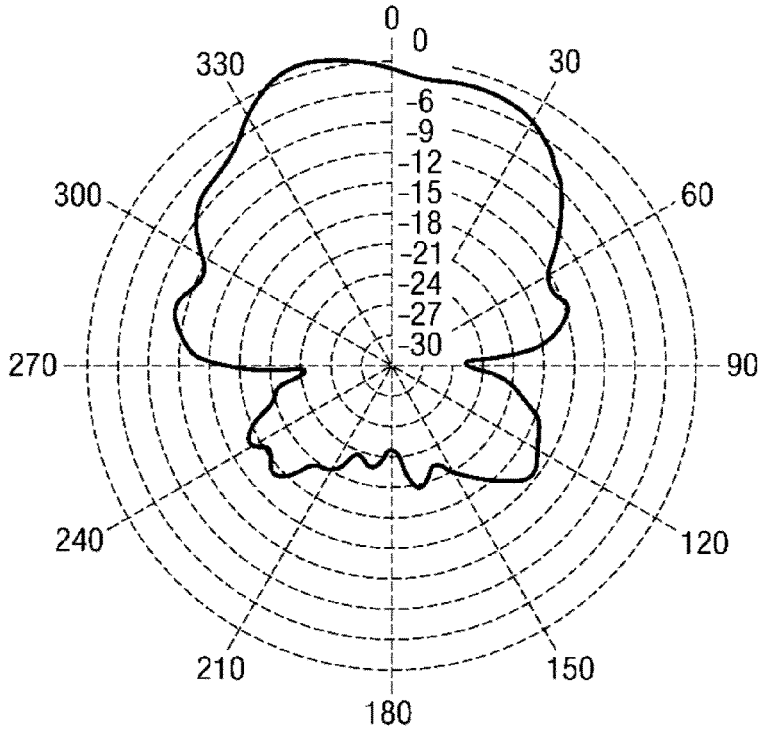
FIG. 10 B.1
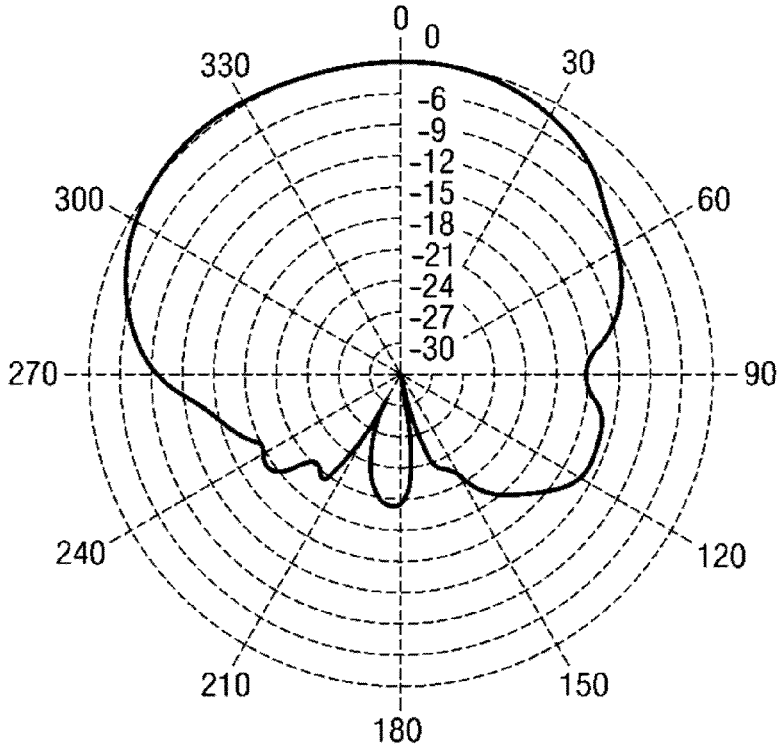
FIG. 10 B.2

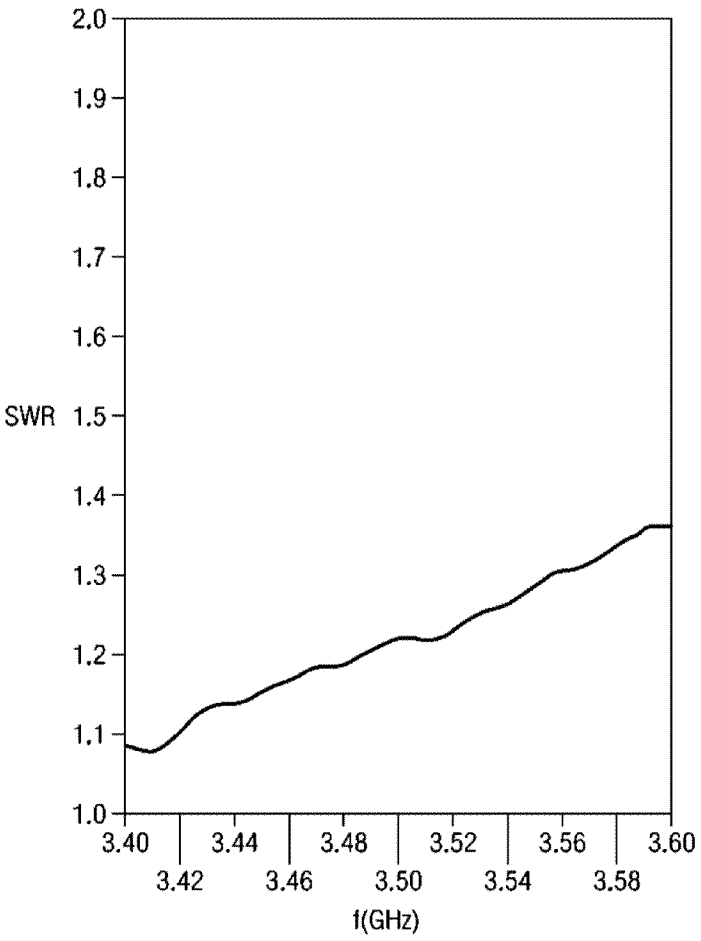
FIG. 12.2
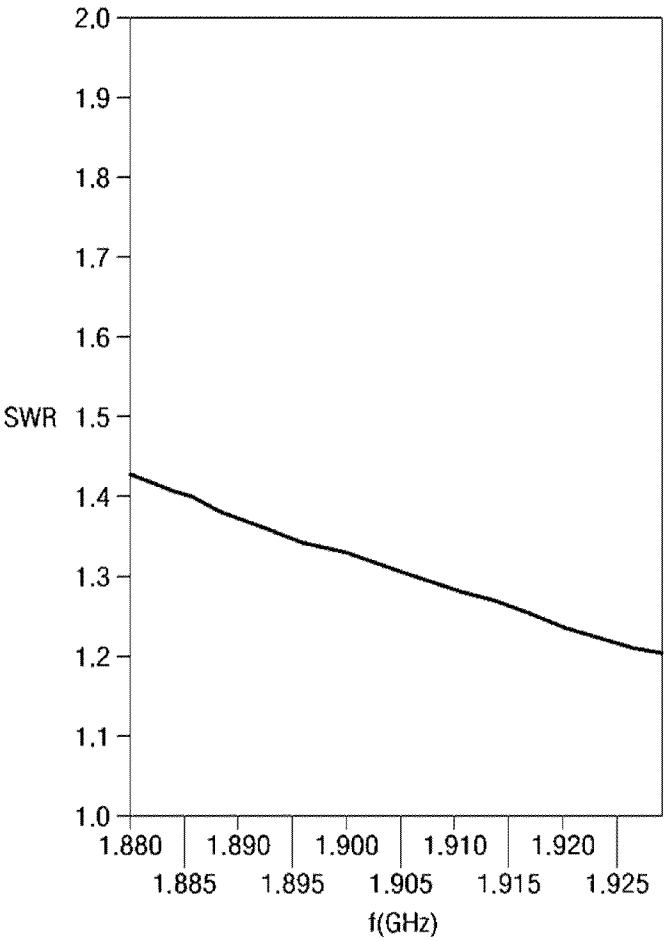
FIG. 12.1

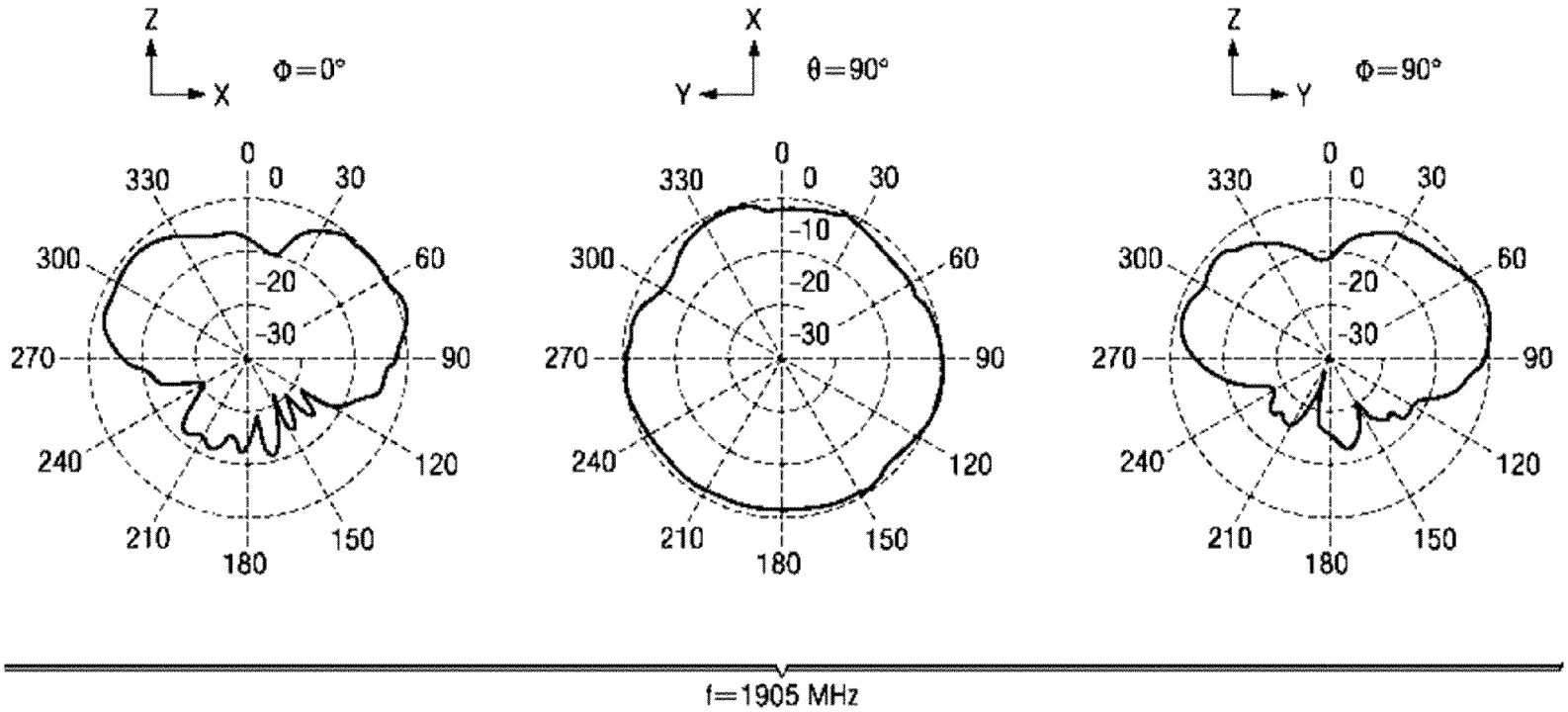
FIG. 13 A.1
FIG. 13 A.2
FIG. 13 A.3

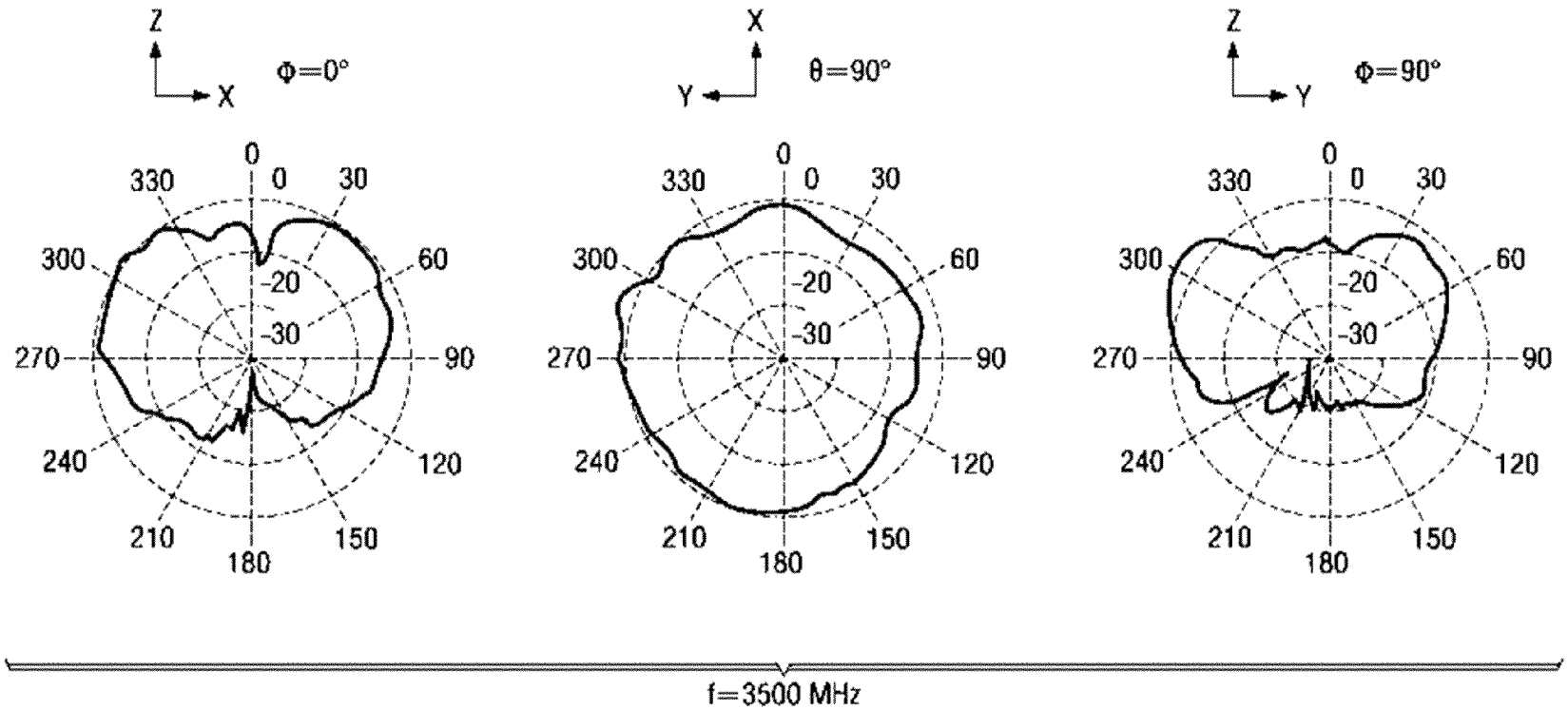
FIG. 13 B.1
FIG. 13 B.2
FIG. 13 B.3

MULTILEVEL ANTENNAE

CROSS REFERENCE TO RELATED APPLICATIONS

This application is a Continuation application of U.S. patent application Ser. No. 13/929,441, filed Jun. 27, 2013, entitled MULTILEVEL ANTENNAE, which is a Continuation application of U.S. patent application Ser. No. 13/732,743, filed Jan. 2, 2013, entitled MULTILEVEL ANTENNAE, which is a Continuation application of U.S. patent Ser. No. 13/669,916, filed Nov. 6, 2012, entitled MULTILEVEL ANTENNAE, which is a Continuation application of U.S. patent application Ser. No. 13/411,212, filed Mar. 2, 2012, entitled MULTILEVEL ANTENNAE, now U.S. Pat. No. 8,330,659, issued on Dec. 11, 2012, which is a Continuation application of U.S. patent application Ser. No. 13/044,189, filed on Mar. 9, 2011, entitled MULTILEVEL ANTENNAE, now U.S. Pat. No. 8,154,463, issued on Apr. 10, 2012, which is a Continuation application of U.S. patent application Ser. No. 12/400,888, filed on Mar. 10, 2009, entitled MULTILEVEL ANTENNAE, now U.S. Pat. No. 8,009,111, issued on Aug. 30, 2011, which is a Continuation application of U.S. patent application Ser. No. 11/780,932, filed on Jul. 20, 2007, entitled MULTILEVEL ANTENNAE, now U.S. Pat. No. 7,528,782, issued on May 5, 2009, which is a Continuation application of U.S. patent application Ser. No. 11/179,257, filed on Jul. 12, 2005, entitled MULTILEVEL ANTENNAE, now U.S. Pat. No. 7,397,431, issued on Jul. 8, 2008, which is a Continuation application of U.S. patent application Ser. No. 11/102,390, filed on Apr. 8, 2005, entitled MULTILEVEL ANTENNAE, now U.S. Pat. No. 7,123,208, issued on Oct. 17, 2006, which is a Continuation application of U.S. patent application Ser. No. 10/963,080, filed on Oct. 12, 2004, entitled MULTILEVEL ANTENNAE, now U.S. Pat. No. 7,015,868, issued on Mar. 21, 2006, which is a Continuation application of U.S. patent application Ser. No. 10/102,568, filed Mar. 18, 2002, entitled MULTILEVEL ANTENNAE, now abandoned, which is a National Phase Application of PCT/ES99/00296, filed on Sep. 20, 1999, entitled MULTILEVEL ANTENNAE, the specifications of each of which are incorporated herein by reference.

FIELD OF THE INVENTION

The present invention relates to antennae formed by sets of similar geometrical elements (polygons, polyhedrons electro magnetically coupled and grouped such that in the antenna structure may be distinguished each of the basic elements which form it.

More specifically, it relates to a specific geometrical design of said antennae by which two main advantages are provided: the antenna may operate simultaneously in several frequencies and/or its size can be substantially reduced.

The scope of application of the present invention is mainly within the field of telecommunications, and more specifically in the field of radio-communication.

BACKGROUND

Antennae were first developed towards the end of the past century, when James C. Maxwell in 1864 postulated the fundamental laws of electromagnetism. Heinrich Hertz may be attributed in 1886 with the invention of the first antenna by which transmission in air of electromagnetic waves was demonstrated. In the mid forties were shown the fundamental restrictions of antennae as regards the reduction of their size relative to wavelength, and at the start of the sixties the first frequency-independent antennae appeared. At that time helixes, spirals, logoperiodic groupings, cones and structures defined solely by angles were proposed for construction of wide band antennae.

In 1995 were introduced the fractal or multifractal type antennae (Patent no. 9501019), which due to their geometry presented a multifrequency behavior and in certain cases a small size. Later were introduced multitriangular antennae (Patent no. 9800954) which operated simultaneously in bands GSM 900 and GSM 1800.

The antennae described in the present patent have their origin in fractal and multitriangular type antennae, but solve several problems of a practical nature which limit the behavior of said antennae and reduce their applicability in real environments.

From a scientific standpoint strictly fractal antennae are impossible, as fractal objects are a mathematical abstraction which include an infinite number of elements. It is possible to generate antennae with a form based on said fractal objects, incorporating a finite number of iterations. The performance of such antennae is limited to the specific geometry of each one. For example, the position of the bands and their relative spacing is related to fractal geometry and it is not always possible, viable or economic to design the antennae maintaining its fractal appearance and at the same time placing the bands at the correct area of the radioelectric spectrum. To begin, truncation implies a clear example of the limitations brought about by using a real fractal type antenna which attempts to approximate the theoretical behavior of an ideal fractal antenna. Said effect breaks the behavior of the ideal fractal structure in the lower band, displacing it from its theoretical position relative to the other bands and in short requiring a too large size for the antenna which hinders practical applications.

In addition to such practical problems, it is not always possible to alter the fractal structure to present the level of impedance of radiation diagram which is suited to the requirements of each application. Due to these reasons, it is often necessary to leave the fractal geometry and resort to other types of geometries which offer a greater flexibility as regards the position of frequency bands of the antennae, adaptation levels and impedances, polarization and radiation diagrams.

Multitriangular structures (Patent no. 9800954) were an example of non-fractal structures with a geometry designed such that the antennae could be used in base stations of GSM and DCS cellular telephony. Antennae described in said patent consisted of three triangles joined only at their vertices, of a size adequate for use in bands 890 MHz-960 MHz and 1710 MHz-1880 MHz. This was a specific solution for a specific environment which did not provide the flexibility and versatility required to deal with other antennae designs for other environments.

Multilevel antennae solve the operational limitations of fractal and multitriangular antennae. Their geometry is much more flexible, rich and varied, allowing operation of the antenna from two to many more bands, as well as providing a greater versatility as regards diagrams, band positions and impedance levels, to name a few examples. Although they are not fractal, multilevel antennae are characterized in that they comprise a number of elements which may be distinguished in the overall structure. Precisely because they clearly show several levels of detail (that of the overall structure and that of the individual elements which make it up), antennae provide a multiband behavior and/or a small size. The origin of their name also lies in said property.

The present invention consists of an antenna whose radiating element is characterized by its geometrical shape, which basically comprises several polygons or polyhedrons of the same type. That is, it comprises for example triangles, squares, pentagons, hexagons or even circles and ellipses as a limiting case of a polygon with a large number of sides, as well as tetrahedra, hexahedra, prisms, dodecahedra, etc. coupled to each other electrically (either through at least one point of contact or through a small separation providing a capacitive coupling) and grouped in structures of a higher level such that in the body of the antenna can be identified the polygonal or polyhedral elements which it comprises. In turn, structures generated in this manner can be grouped in higher order structures in a manner similar to the basic elements, and so on until reaching as many levels as the antenna designer desires.

Its designation as multilevel antenna is precisely due to the fact that in the body of the antenna can be identified at least two levels of detail: that of the overall structure and that of the majority of the elements (polygons or polyhedrons) which make it up. This is achieved by ensuring that the area of contact or intersection (if it exists) between the majority of the elements forming the antenna is only a fraction of the perimeter or surrounding area of said polygons or polyhedrons.

A particular property of multilevel antennae is that their radioelectric behavior can be similar in several frequency bands. Antenna input parameters (impedance and radiation diagram) remain similar for several frequency bands (that is, the antenna has the same level of adaptation or standing wave relationship in each different band), and often the antenna presents almost identical radiation diagrams at different frequencies. This is due precisely to the multilevel structure of the antenna, that is, to the fact that it remains possible to identify in the antenna the majority of basic elements (same type polygons or polyhedrons) which make it up. The number of frequency bands is proportional to the number of scales or sizes of the polygonal elements or similar sets in which they are grouped contained in the geometry of the main radiating element.

In addition to their multiband behavior, multilevel structure antennae usually have a smaller than usual size as compared to other antennae of a simpler structure. (Such as those consisting of a single polygon or polyhedron). This is because the path followed by the electric current on the multilevel structure is longer and more winding than in a simple geometry, due to the empty spaces between the various polygon or polyhedron elements. Said empty spaces force a given path for the current (which must circumvent said spaces) which travels a greater distance and therefore resonates at a lower frequency. Additionally, its edge-rich and discontinuity-rich structure simplifies the radiation process, relatively increasing the radiation resistance of the antenna and reducing the quality factor Q, i.e., increasing its bandwidth.

Thus, the main characteristic of multilevel antennae are the following:

- A multilevel geometry comprising polygon or polyhedron of the same class, electromagnetically coupled and grouped to form a larger structure. In multilevel geometry most of these elements are clearly visible as their area of contact, intersection or interconnection (if these exist) with other elements is always less than 50% of their perimeter.
- The radioelectric behavior resulting from the geometry: multilevel antennae can present a multiband behavior (identical or similar for several frequency bands) and/or operate at a reduced frequency, which allows to reduce their size.

In specialized literature it is already possible to find descriptions of certain antennae designs which allow to cover a few bands. However, in these designs the multiband behavior is achieved by grouping several single band antennae or by incorporating reactive elements in the antennae (concentrated elements as inductors or capacitors or their integrated versions such as posts or notches) which force the apparition of new resonance frequencies. Multilevel antennae on the contrary base their behavior on their particular geometry, offering a greater flexibility to the antenna designer as to the number of bands (proportional to the number of levels of detail), position, relative spacing and width, and thereby offer better and more varied characteristics for the final product.

A multilevel structure can be used in any known antenna configuration. As a nonlimiting example can be cited: dipoles, monopoles, patch or microstrip antennae, coplanar antennae, reflector antennae, wound antennae or even antenna arrays. Manufacturing techniques are also not characteristic of multilevel antennae as the best suited technique may be used for each structure or application. For example: printing on dielectric substrate by photolithography (printed circuit technique); dieing on metal plate, repulsion on dielectric, etc.

Publication WO 97/06578 discloses a fractal antenna, which has nothing to do with a multilevel antenna being both geometries essentially different.

BRIEF DESCRIPTION OF THE DRAWINGS

Further characteristics and advantages of the invention will become apparent in view of the detailed description which follows of a preferred embodiment of the invention given for purposes of illustration only and in no way meant as a definition of the limits of the invention, made with reference to the accompanying drawings, in which:

FIGS. 2.1 to 2.7 show examples of assemblies of multilevel antennae in several configurations: monopole (2.1), dipole (2.2), patch (2.3), coplanar antennae (2.4), horn (2.5-2.6) and array (2.7);

FIGS. 3.1 to 3.15 show examples of multilevel structures based on triangles;

FIGS. 4.1 to 4.15 show examples of multilevel structures based on parallelepipeds;

FIGS. 5.1 to 5.9 show examples of multilevel structures based on pentagons;

FIGS. 6.1 to 6.9 show examples of multilevel structures based on hexagons;

FIGS. 7.1 to 7.8 show examples of multilevel structures based on polyhedrons;

FIGS. 10A.1, 10A.2, 10B.1 and 10B.2 show radiation diagrams for the multilevel antenna of FIG. 8A-8B: horizontal and vertical planes;

FIGS. 12.1-12.2 show input parameters (return loss on so ohms) for the multilevel antenna of the previous figure; and FIGS. 13A.1 to 13A.3 and 13B.1 to 13B.3 show radiation diagrams for the multilevel antenna of FIG. 11.

DETAILED DESCRIPTION

In the detailed description which follows of a preferred embodiment of the present invention permanent reference is made to the figures of the drawings, where the same numerals refer to the identical or similar parts.

The present invention relates to an antenna which includes at least one construction element in a multilevel structure form. A multilevel structure is characterized in that it is formed by gathering several polygon or polyhedron of the same type (for example triangles, parallelepipeds, pentagons, hexagons, etc., even circles or ellipses as special limiting cases of a polygon with a large number of sides, as well as tetrahedra, hexahedra, prisms, dodecahedra, etc. coupled to each other electromagnetically, whether by proximity or by direct contact between elements. A multilevel structure or figure is distinguished from another conventional figure precisely by the interconnection (if it exists) between its component elements (the polygon or polyhedron). In a multilevel structure at least 75% of its component elements have more than 50% of their perimeter (for polygons) not in contact with any of the other elements of the structure. Thus, in a multilevel structure it is easy to identify geometrically and individually distinguish most of its basic component elements, presenting at least two levels of detail: that of the overall structure and that of the polygon or polyhedron elements which form it. Its name is precisely due to this characteristic and from the fact that the polygon or polyhedron can be included in a great variety of sizes. Additionally, several multilevel structures may be grouped and coupled electromagnetically to each other to form higher level structures. In a multilevel structure all the component elements are polygons with the same number of sides or polyhedron with the same number of faces. Naturally, this property is broken when several multilevel structures of different natures are grouped and electromagnetically coupled to form meta-structures of a higher level.

In this manner, in FIGS. 1 to 7 are shown a few specific examples of multilevel structures.

Figure 1:
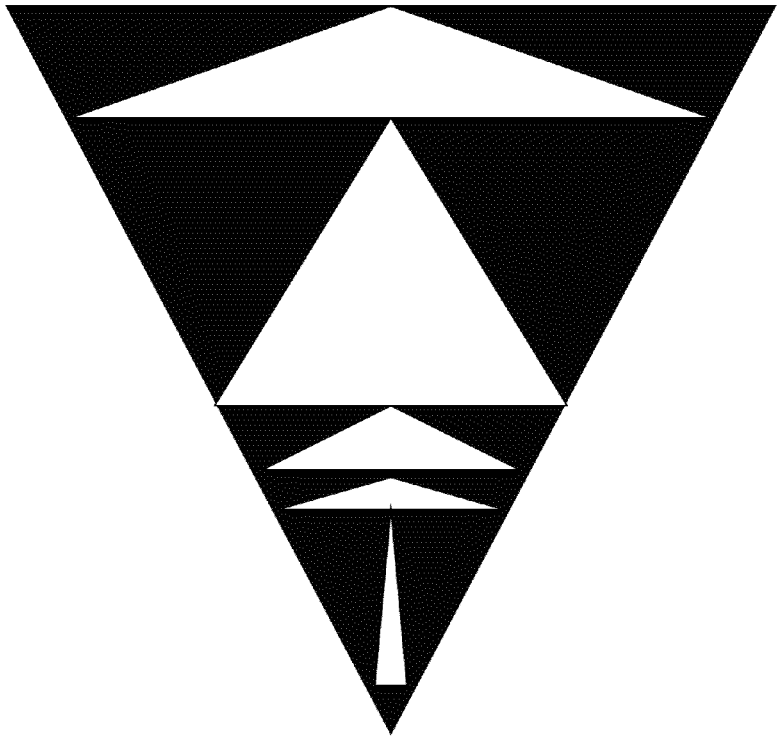
FIG. 1 shows a specific example of a multilevel element comprising only triangular polygons.

FIG. 1 shows a multilevel element exclusively consisting of triangles of various sizes and shapes. Note that in this particular case each and every one of the elements (triangles, in black) can be distinguished, as the triangles only overlap in a small area of their perimeter, in this case at their vertices.

FIGS. 2.1 to 2.7 show examples of assemblies of multilevel antennae in various configurations: monopole (21), dipole (22), patch (23), coplanar antennae (24), coil in a side view (25) and front view (26) and array (27). With this it should be remarked that regardless of its configuration the multilevel antenna is different from other antennae in the geometry of its characteristic radiant element.

FIGS. 3.1 to 3.15 show further examples of multilevel structures with a triangular origin, all comprised of triangles. Note that case (3.14) is an evolution of case (3.13); despite the contact between the 4 triangles, 75% of the elements (three triangles, except the central one) have more than 50% of the perimeter free.

FIGS. 4.1 to 4.15 describe multilevel structures formed by parallelepipeds (squares, rectangles, rhombi . . . ). Note that the component elements are always individually identifiable (at least most of them are). In case (4.12), specifically, said elements have 100% of their perimeter free, without there being any physical connection between them (coupling is achieved by proximity due to the mutual capacitance between elements).

FIGS. 5.1-5.9, 6.1-6.9 and 7.1-7.8 show non-limiting examples of other multilevel structures based on pentagons, hexagons and polyhedron respectively.

It should be remarked that the difference between multilevel antennae and other existing antennae lies in the particular geometry, not in their configuration as an antenna or in the materials used for construction. Thus, the multilevel structure may be used with any known antenna configuration, such as for example and in a non-limiting manner: dipoles, monopoles, patch or microstrip antennae, coplanar antennae, reflector antennae, wound antennae or even in arrays. In general, the multilevel structure forms part of the radiative element characteristic of said configurations, such as the arm, the mass plane or both in a monopole, an arm or both in a dipole, the patch or printed element in a microstrip, patch or coplanar antenna; the reflector for an reflector antenna, or the conical section or even antenna walls in a horn type antenna. It is even possible to use a spiral type antenna configuration in which the geometry of the loop or loops is the outer perimeter of a multilevel structure. In all, the difference between a multilevel antenna and a conventional one lies in the geometry of the radiative element or one of its components, and not in its specific configuration.

As regards construction materials and technology, the implementation of multilevel antennae is not limited to any of these in particular and any of the existing or future techniques may be employed as considered best suited for each application, as the essence of the invention is found in the geometry used in the multilevel structure and not in the specific configuration. Thus, the multilevel structure may for example be formed by sheets, parts of conducting or superconducting material, by printing in dielectric substrates (rigid or flexible) with a metallic coating as with printed circuits, by imbrications of several dielectric materials which form the multilevel structure, etc. always depending on the specific requirements of each case and application. Once the multilevel structure is formed the implementation of the antenna depends on the chosen configuration (monopole, dipole, patch, horn, reflector . . . ). For monopole, spiral, dipole and patch antennae the multisimilar structure is implemented on a metal support (a simple procedure involves applying a photolithography process to a virgin printed circuit dielectric plate) and the structure is mounted on a standard microwave connector, which for the monopole or patch cases is in turn connected to a mass plane (typically a metal plate or case) as for any conventional antenna. For the dipole case two identical multilevel structures form the two arms of the antenna; in an opening antenna the multilevel geometry may be part of the metal wall of a horn or its cross section, and finally for a reflector the multisimilar element or a set of these may form or cover the reflector.

The most relevant properties of the multilevel antennae are mainly due to their geometry and are as follows: the possibility of simultaneous operation in several frequency bands in a similar manner (similar impedance and radiation diagrams) and the possibility of reducing their size compared to other conventional antennae based exclusively on a single polygon or polyhedron. Such properties are particularly relevant in the field of communication systems. Simultaneous operation in several frequency bands allows a single multilevel antenna to integrate several communication systems, instead of assigning an antenna for each system or service as is conventional. Size reduction is particularly useful when the antenna must be concealed due to its visual impact in the urban or rural landscape, or to its unaesthetic or unaerodynamic effect when incorporated on a vehicle or a portable telecommunication device.

An example of the advantages obtained from the use of a multiband antenna in a real environment is the multilevel antenna AM1, described further below, used for GSM and DCS environments. These antennae are designed to meet radioelectric specifications in both cell phone systems. Using a single GSM and DCS multilevel antenna for both bands (900 MHz and 1800 MHz) cell telephony operators can reduce costs and environmental impact of their station networks while increasing the number of users' (customers) supported by the network.

It becomes particularly relevant to differentiate multilevel antennae from fractal antennae. The latter are based on fractal geometry, which is based on abstract mathematical concepts which are difficult to implement in practice. Specialized scientific literature usually defines as fractal those geometrical objects with a non-integral Haussdorf dimension. This means that fractal objects exist only as an abstraction or a concept, but that said geometries are unthinkable (in a strict sense) for a tangible object or drawing, although it is true that antennae based on this geometry have been developed and widely described in the scientific literature, despite their geometry not being strictly fractal in scientific terms. Nevertheless some of these antennae provide a multiband behavior (their impedance and radiation diagram remains practically constant for several frequency bands), they do not on their own offer all of the behavior required of an antenna for applicability in a practical environment. Thus, Sierpinski's antenna for example has a multiband behavior with N bands spaced by a factor of 2, and although with this spacing one could conceive its use for communications networks GSM 900 MHz and GSM 1800 MHz (or DCS), its unsuitable radiation diagram and size for these frequencies prevent a practical use in a real environment. In short, to obtain an antenna which in addition to providing a multiband behavior meets all of the specifications demanded for each specific application it is almost always necessary to abandon the fractal geometry and resort for example to multilevel geometry antennae. As an example, none of the structures described in FIGS. 1, 3.1-3.15, 4.1-4.15, 5.1-5.9 and 6.1-6.9 are fractal. Their Hausdorff dimension is equal to 2 for all, which is the same as their topological dimension. Similarly, none of the multilevel structures of FIGS. 7.1-7.8 are fractal, with their Hausdorff dimension equal to 3, as their topological dimension.

In any case multilevel structures should not be confused with arrays of antennae. Although it is true that an array is formed by sets of identical antennae, in these the elements are electromagnetically decoupled, exactly the opposite of what is intended in multilevel antennae. In an array each element is powered independently whether by specific signal transmitters or receivers for each element, or by a signal distribution network, while in a multilevel antenna the structure is excited in a few of its elements and the remaining ones are coupled electromagnetically or by direct contact (in a region which does not exceed 50% of the perimeter or surface of adjacent elements). In an array is sought an increase in the directivity of an individual antenna o forming a diagram for a specific application; in a multilevel antenna the object is to obtain a multiband behavior or a reduced size of the antenna, which implies a completely different application from arrays.

Below are described, for purposes of illustration only, two non-limiting examples of operational modes for Multilevel Antennae (AM1 and AM2) for specific environments and applications.

Mode AM1

Figure 8A:
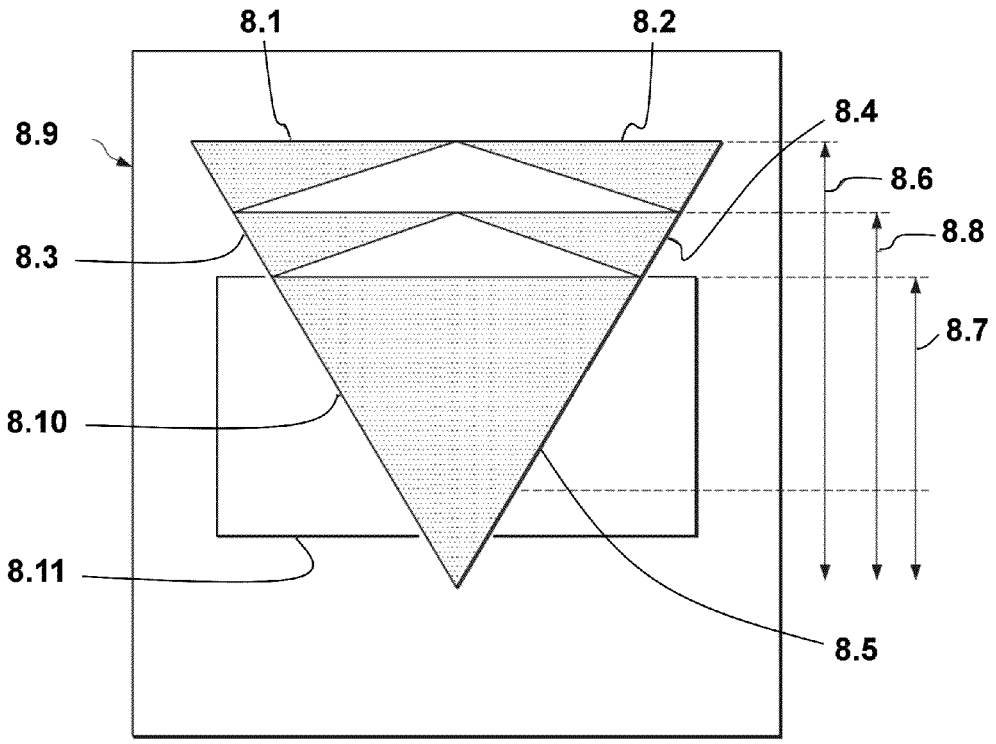
FIG. 8A-8B show an example of a specific operational mode for a multilevel antenna in a patch configuration for base stations of GSM (900 MHz) and DCS (1800 MHz) cellular telephony.
Figure 8B:
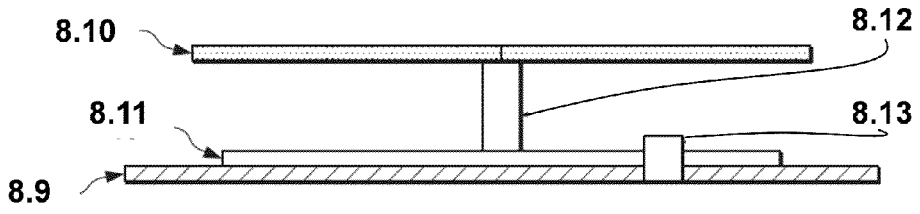

This model consists of a multilevel patch type antenna, shown in FIG. 8A-8B, which operates simultaneously in bands GSM 900 (890 MHz-960 MHz) and GSM 1800 (1710 MHz-1880 MHz) and provides a sector radiation diagram in a horizontal plane. The antenna is conceived mainly (although not limited to) for use in base stations of GSM 900 and 1800 mobile telephony.

The multilevel structure (8.10), or antenna patch, consists of a printed copper sheet on a standard fiberglass printed circuit board. The multilevel geometry consists of 5 triangles (8.1-8.5) joined at their vertices, as shown in FIG. 8A, with an external perimeter shaped as an equilateral triangle of height 13.9 cm (8.6). The bottom triangle has a height (8.7) of 8.2 cm and together with the two adjacent triangles form a structure with a triangular perimeter of height 10.7 cm (8.8).

The multilevel patch (8.10) is mounted parallel to an earth plane (8.9) of rectangular aluminum of 22.times.18.5 cm. The separation between the patch and the earth plane is 3.3 cm, which is maintained by a pair of dielectric spacers which act as support (8.12).

Connection to the antenna is at two points of the multilevel structure, one for each operational band (GSM 900 and GSM 1800). Excitation is achieved by a vertical metal post perpendicular to the mass plane and to the multilevel structure, capacitively finished by a metal sheet which is electrically coupled by proximity (capacitive effect) to the patch. This is a standard system in patch configuration antennae, by which the object is to compensate the inductive effect of the post with the capacitive effect of its finish.

At the base of the excitation post is connected the circuit which interconnects the elements and the port of access to the antenna or connector (8.13). Said interconnection circuit may be formed with microstrip, coaxial or strip-line technology to name a few examples, and incorporates conventional adaptation networks which transform the impedance measured at the base of the post to so ohms (with a typical tolerance in the standing wave relation (SWR) usual for these application under 1.5) required at the input/output antenna connector. Said connector is generally of the type N or SMA for microcell base station applications.

In addition to adapting the impedance and providing an interconnection with the radiating element the interconnection network (8.11) may include a diplexor allowing the antenna to be presented in a two connector configuration (one for each band) or in a single connector for both bands.

For a double connector configuration in order to increase the insulation between the GSM 900 and GSM 1800 (DCS) terminals, the base of the DCS and excitation post may be connected to a parallel stub of electrical length equal to half a wavelength, in the central DCS wavelength, and finishing in an open circuit. Similarly, at the base of the GSM 900 lead can be connected a parallel stub ending in an open circuit of electrical length slightly greater than one quarter of the wavelength at the central wavelength of the GSM band. Said stub introduces a capacitance in the base of the connection which may be regulated to compensate the residual inductive effect of the post. Furthermore, said stub presents very low impedance in the DCS band which aids in the insulation between connectors in said band.

In FIGS. 9A-9B, 10A and 10B are shown the typical radioelectric behavior for this specific embodiment of a dual multilevel antenna.

Figure 9A:
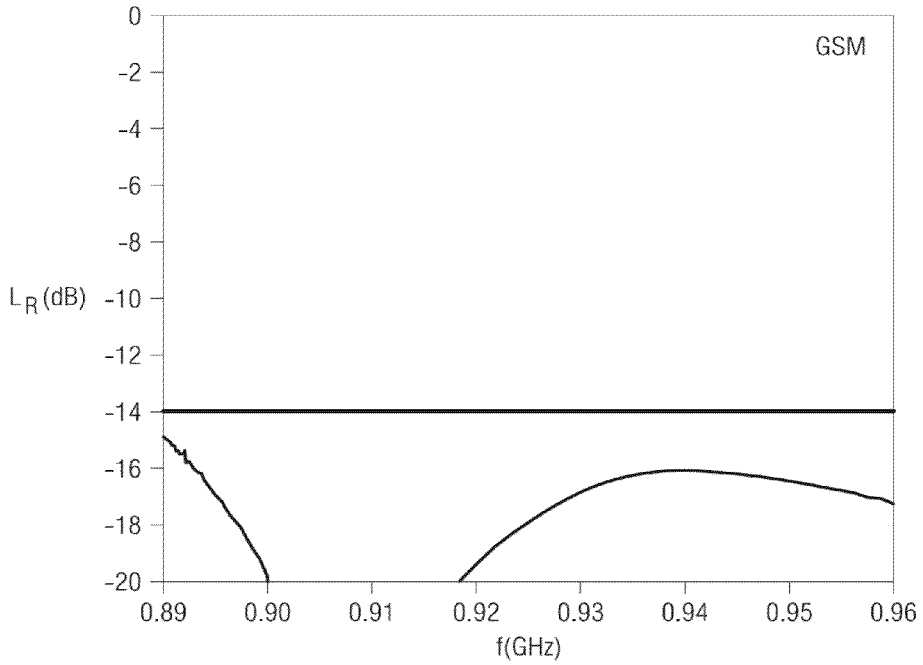
FIG. 9A-9B show input parameters (return loss on 50 ohms) for the multilevel antenna described in the previous figure.
Figure 9B:
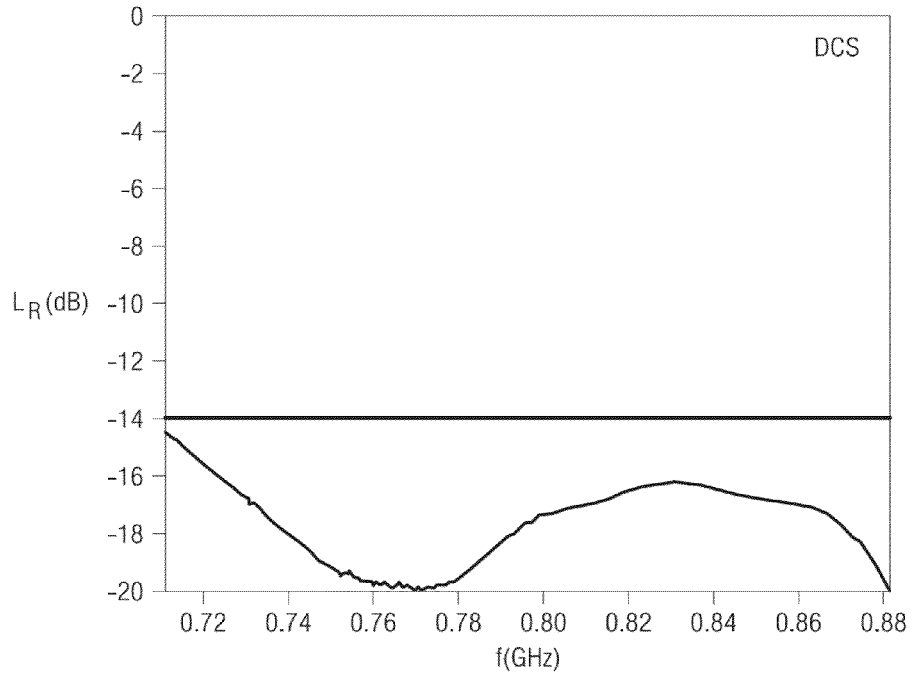

FIG. 9A-9B shows return losses (Lr) in GSM (9.1) and DCS (9.2), typically under −14 dB (which is equivalent to SWR<1.5), so that the antenna is well adapted in both operation bands (890 MHz-960 MHz and 1710 MHz-1880 MHz).

Radiation diagrams in the vertical (10A.1 and 10B.1) and the horizontal plane (10A.2 and 10B.2) for both bands are shown in FIGS. 10A.1, 10A.2, 10B.1 and 10B.2. It can be seen clearly that both antennae radiate using a main lobe in the direction perpendicular to the antenna (10A.1 and 10B.1), and that in the horizontal plane (10A.2 and 10B.2) both diagrams are sectorial with a typical beam width at 3 dB of 65°. Typical directivity (d) in both bands is d>7 Db.

Mode AM2

Figure 11:
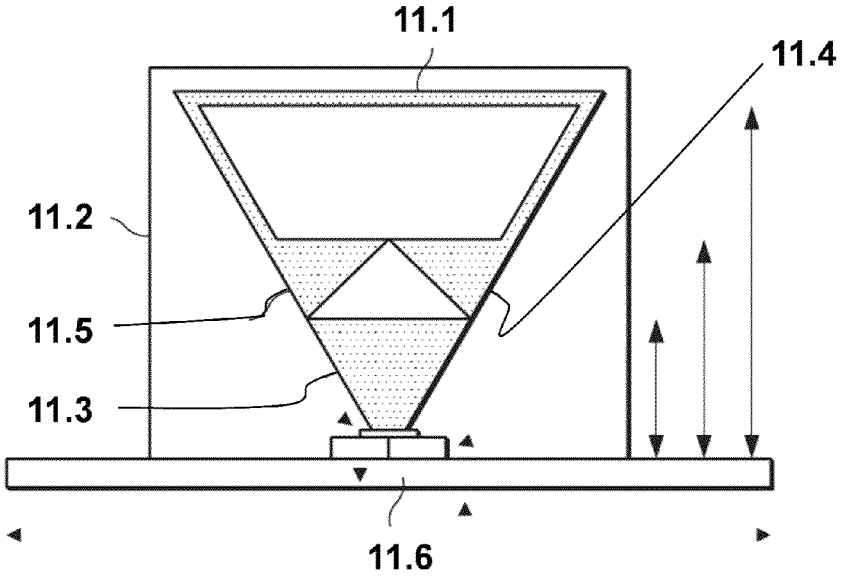
FIG. 11 shows an example of a specific operation mode for a multilevel antenna in a monopole construction for indoors wireless communication systems or in radio-accessed local network environments.

This model consists of a multilevel antenna in a monopole configuration, shown in FIG. 11, for wireless communications systems for indoors or in local access environments using radio.

The antenna operates in a similar manner simultaneously for the bands 1880 MHz-1930 MHz and 3400 MHz-3600 MHz, such as in installations with the system DECT. The multilevel structure is formed by three or five triangles (see FIGS. 11 and 3.6) to which may be added an inductive loop (11.1). The antenna presents an omnidirectional radiation diagram in the horizontal plane and is conceived mainly for (but not limited to) mounting on roof or floor.

The multilevel structure is printed on a Rogers® RO4003 dielectric substrate (11.2) of 5.5 cm width, 4.9 cm height and 0.8 mm thickness, and with a dielectric permittivity equal to 3.38. The multilevel element consists of three triangles (11.3-11.5) joined at the vertex; the bottom triangle (11.3) has a height of 1.82 cm, while the multilevel structure has a total height of 2.72 cm. In order to reduce the total size f the antenna the multilevel element is added an inductive loop (11.1) at its top with a trapezoidal shape in this specific application, so that the total size of the radiating element is 4.5 cm.

The multilevel structure is mounted perpendicularly on a metallic (such as aluminum) earth plane (11.6) with a square or circular shape about 18 cm in length or diameter. The bottom vertex of the element is placed on the center of the mass plane and forms the excitation point for the antenna. At this point is connected the interconnection network which links the radiating element to the input/output connector. Said interconnection network may be implemented as a microstrip, strip-line or coaxial technology to name a few examples. In this specific example the microstrip configuration was used. In addition to the interconnection between radiating element and connector, the network can be used as an impedance transformer, adapting the impedance at the vertex of the multilevel element to the 50 Ohms (Lr<−14 dB, SWR<1.5) required at the input/output connector.

FIGS. 12.1-12.2, 13A.1-13A.3 and 13B.1-13B.3 summarize the radioelectric behavior of antennae in the lower (1900) and higher bands (3500).

FIGS. 12.1-12.2 show the standing wave ratio (SWR) for both bands: FIG. 12.1 for the band between 1880 and 1930 MHz, and FIG. 12.2 for the band between 3400 and 3600 MHz. These show that the antenna is well adapted as return losses are under 14 dB, that is, SWR<1.5 for the entire band of interest.

FIGS. 13A.1-13A.3 and 13B.1-13B.3 show typical radiation diagrams. Diagrams (13A.1), (13A.2) and (13A.3) at 1905 MHz measured in the vertical plane, horizontal plane and antenna plane, respectively, and diagrams (13B.1), (13B.2) and (13B.3) at 3500 MHz measured in the vertical plane, horizontal plane and antenna plane, respectively.

One can observe an omnidirectional behavior in the horizontal plane and a typical bilobular diagram in the vertical plane with the typical antenna directivity above 4 dBi in the 1900 band and 6 dBi in the 3500 band.

In the antenna behavior it should be remarked that the behavior is quite similar for both bands (both SWR and in the diagram) which makes it a multiband antenna.

Both the AM1 and AM2 antennae will typically be coated in a dielectric radome which is practically transparent to electromagnetic radiation, meant to protect the radiating element and the connection network from external aggression as well as to provide a pleasing external appearance.

It is not considered necessary to extend this description in the understanding that an expert in the field would be capable of understanding its scope and advantages resulting thereof, as well as to reproduce it.

However, as the above description relates only to a preferred embodiment, it should be understood that within this essence may be introduced various variations of detail, also protected, the size and/or materials used in manufacturing the whole or any of its parts.

What is claimed is:

1. A multi-band antenna including:

at least one structure for the multi-band antenna useable at three ranges of frequencies, each of the three ranges of frequencies extending between two limiting frequencies and included in a portable communication device;

the at least one structure including at least three portions, a first portion having a first geometry configured to operate at a range of frequencies of the three ranges of frequencies, a second portion located substantially within the first portion and having a second geometry configured to operate at a range of frequencies of the three ranges of frequencies and a third portion located substantially within the first portion and having a third geometry configured to operate at a range of frequencies of the three ranges of frequencies, the at least one structure comprising a plurality of closed figures bounded by the same number of sides, wherein each of the closed figures is directly or proximately linked to at least one other of the closed figures such that electromagnetic power is exchanged between the closed figures either directly through at least one point of contact or through a small separation providing coupling, wherein, for at least 75% of the closed figures, the region or area of contact, intersection, or interconnection between the closed figures is less than 50% of their perimeter or area, wherein the multi-band antenna provides a substantially similar combined amount of resistance and reactance measured at an input/output connector and radiation pattern in the multiple ranges of frequencies, and wherein not all of the closed figures have the same size and the perimeter of the at least one structure has a different number of sides than the closed figures that compose the at least one structure.

2. The multi-band antenna of claim 1, wherein the third portion is smaller than the first portion.

3. The multi-band antenna of claim 2, wherein the second portion is smaller than the first portion.

4. The multi-band antenna of claim 2, wherein the third portion completely overlaps with the first portion.

5. The multi-band antenna of claim 4, further comprising an interconnection circuit that links the multi-band antenna to an input/output connector and that is configured to incorporate adaptation networks for impedances, filters or diplexers.

6. A multi-band antenna including:

at least one structure for the multi-band antenna useable at multiple ranges of frequencies, each of the multiple ranges of frequencies extending between two limiting frequencies and included in a portable communication device;

the at least one structure including at least two portions, a first portion having a first geometry configured to operate at a range of frequencies of the multiple ranges of frequencies, and a second portion located substantially within the first portion and having a second geometry configured to operate at a range of frequencies of the multiple ranges of frequencies, the second portion being smaller than the first portion and substantially overlapping within the first portion;

the at least one structure comprising a plurality of closed figures bounded by the same number of sides, wherein each of the closed figures is directly or proximately linked to at least one other of the closed figures such that electromagnetic power is exchanged between the closed figures either directly through at least one point of contact or through a small separation providing coupling, wherein, for at least 75% of the closed figures, the region or area of contact, intersection, or interconnection between the closed figures is less than 50% of their perimeter or area, wherein not all of the closed figures have the same size and the perimeter of the at least one structure has a different number of sides than the closed figures that compose the at least one structure, wherein the multi-band antenna provides a substantially similar combined amount of resistance and reactance measured at an input/output connector and radiation pattern in the multiple ranges of frequencies, and wherein the multi-band antenna is configured to operate at the multiple ranges of frequencies and wherein at least one of the multiples ranges of frequencies is within the 800 MHz-3600 MHz frequency range.

7. The multi-band antenna of claim 6, wherein the second portion completely overlaps with the first portion.

8. The multi-band antenna of claim 7, wherein the multi-band antenna is configured to operate in at least three frequency bands.

9. The multi-band antenna of claim 6, wherein the plurality of closed figures are plane figures.

10. The multi-band antenna of claim 6, wherein the at least three frequency bands are cellular frequency bands, and the antenna element is configured to transmit and receive wireless signals over an entirety of the cellular frequency bands.

11. A multi-band antenna including:

at least one structure for the multi-band antenna useable at multiple ranges of frequencies, each of the multiple ranges of frequencies extending between two limiting frequencies;

the at least one structure including at least two portions, a first portion having a first geometry configured to operate at a first range of frequencies of the multiple ranges of frequencies, and a second portion located substantially within the first portion and having a second geometry configured to operate at a second range of frequencies of the multiple ranges of frequencies, the second portion substantially overlapping within the first portion, the at least one structure comprising a plurality of closed figures bounded by the same number of sides, wherein each of the closed figures in the at least one structure is directly or proximately linked to at least one other of the closed figures such that electromagnetic power is exchanged between the closed figures in the at least one structure either directly through at least one point of contact or through a small separation providing coupling, wherein for at least 75% of the closed figures, the region or area of contact between the closed figures is less than 50% of their perimeter or area, wherein not all of the closed figures have the same size and the perimeter of the at least one structure has a different number of sides than the closed figures that compose the at least one structure, wherein the multi-band antenna provides a substantially similar combined amount of resistance and reactance measured at an input/output connector and radiation pattern in the multiple ranges of frequencies, and wherein the multi-band antenna operates at three or more range of frequencies of the multiple ranges of frequencies and the antenna is shared by three or more cellular services.

12. The multi-band antenna of claim 11, wherein the second portion is smaller than the first portion.

13. The multi-band antenna of claim 12, wherein the multi-band antenna is concealed within a portable communication device.

14. The multi-band antenna of claim 12, wherein the sides of the plurality of closed figures comprises straight lines.

15. The multi-band antenna of claim 11, wherein the first portion comprises substantially all of the at least one structure.

16. The multi-band antenna of claim 15, wherein the multi-band antenna is configured to operate in at least four frequency bands, two of the at least four frequency bands being the first range of frequencies and the second range of frequencies and the multi-band antenna is shared by four or more cellular services.

17. A multi-band antenna including:

at least one structure for the multi-band antenna useable at at least three ranges of frequencies, each of the at least three ranges of frequencies extending between two limiting frequencies, the at least one structure being included in a wireless communication device in a monopole configuration, the at least one structure including at least three portions, a first portion having a first geometry configured to operate at a range of frequencies of the three ranges of frequencies, a second portion located substantially within the first portion and having a second geometry configured to operate at a range of frequencies of the three ranges of frequencies and a third portion located substantially within the first portion and having a third geometry configured to operate at a range of frequencies of the three ranges of frequencies, the second and third portions substantially overlap with the first portion, the at least one structure including a generally identifiable non-convex geometric element, wherein said non-convex geometric element comprises a plurality of convex geometric elements defining the first portion, wherein said non-convex geometric element shapes the electric currents on the first portion, while at least a subset of said plurality of convex geometric elements shapes the electric currents on the second portion;

wherein not all of the convex geometric elements have the same size and the perimeter of the at least one structure has a different number of sides than the convex geometric elements that compose the the at least one structure, wherein the multi-band antenna provides a substantially similar combined amount of resistance and reactance measured at an input/output connector and radiation pattern in the at least three ranges of frequencies;

and wherein the multi-band antenna is configured to operate at the at least three ranges of frequencies and wherein at least one of the at least three ranges of frequencies is within the 800 MHz-3600 MHz frequency range.

18. The multi-band antenna of claim 17, wherein the multi-band antenna provides a substantially similar combined amount of resistance and reactance measured at an input/output connector and radiation pattern in at least four ranges of frequencies.

19. The multi-band antenna of claim 17, wherein the first portion comprises substantially all of the at least one structure.

20. The multi-band antenna of claim 19, wherein the third portion is smaller than the first portion.

* * * * *